US011136792B2

(12) United States Patent
Jeong

(10) Patent No.: US 11,136,792 B2
(45) Date of Patent: Oct. 5, 2021

(54) VEHICLE DOOR LATCH SYSTEM

(71) Applicant: WOOBO TECH CO., LTD., Pyeongtaek-si (KR)

(72) Inventor: Hae Il Jeong, Incheon (KR)

(73) Assignee: Woobo Tech Co., Ltd., Pyeongtaek-si (KR)

( * ) Notice: Subject to any disclaimer, the term of this patent is extended or adjusted under 35 U.S.C. 154(b) by 663 days.

(21) Appl. No.: 16/062,872

(22) PCT Filed: Dec. 9, 2016

(86) PCT No.: PCT/KR2016/014408
§ 371 (c)(1),
(2) Date: Jun. 15, 2018

(87) PCT Pub. No.: WO2017/116036
PCT Pub. Date: Jul. 6, 2017

(65) Prior Publication Data

US 2018/0355640 A1 Dec. 13, 2018

(30) Foreign Application Priority Data

Dec. 28, 2015 (KR) ..... 10-2015-0187329

(51) Int. Cl.
*E05B 77/26* (2014.01)
*E05B 77/30* (2014.01)
(Continued)

(52) U.S. Cl.
CPC ..... *E05B 77/265* (2013.01); *E05B 77/30* (2013.01); *E05B 79/20* (2013.01); *E05B 81/06* (2013.01);
(Continued)

(58) Field of Classification Search
CPC ..... E05B 77/30; E05B 77/265; E05B 81/06; E05B 81/16; E05B 81/20; E05B 81/34;
(Continued)

(56) References Cited

U.S. PATENT DOCUMENTS 5,090,751 A 2/1992 Kobayashi
5,603,539 A * 2/1997 Gruhn ..... E05B 85/243 292/199
(Continued)

FOREIGN PATENT DOCUMENTS

CN 1490489 A 4/2004
CN 203974691 U 12/2014
(Continued)

OTHER PUBLICATIONS

Korean Intellectual Property Office, Notification of Grounds for Rejection, Application No. 10-2015-0187326, dated Jul. 28, 2017, with English translation, 10 pages.
(Continued)

*Primary Examiner* — Kristina R Fulton
*Assistant Examiner* — Christopher F Callahan
(74) *Attorney, Agent, or Firm* — Sunstein LLP

(57) ABSTRACT

The present invention relates to a vehicle door latch system, more particularly, relates to a vehicle door latch system whose locking driving unit comprises a motor, a first gear connected to the motor, and a second gear interlocked with the first gear, wherein a connect through hole wherein a key connect is penetrating through, and two of a rotating stopping portion wherein a locking stopping portion is caught by are formed spaced apart along the circumferential direction so that a locking member is moved as the motor operates, and two of a key stopping portion are formed spaced apart along the circumferential direction so that the locking member is moved as the key connect is rotated.

9 Claims, 45 Drawing Sheets

(51) Int. Cl.

| | |
|---|---|
| ***E05B 79/20*** | (2014.01) |
| ***E05B 81/06*** | (2014.01) |
| ***E05B 81/16*** | (2014.01) |
| ***E05B 81/20*** | (2014.01) |
| ***E05B 81/36*** | (2014.01) |
| ***E05B 81/40*** | (2014.01) |
| ***E05B 81/34*** | (2014.01) |

(52) U.S. Cl.
CPC ..... *E05B 81/16* (2013.01); *E05B 81/20* (2013.01); *E05B 81/34* (2013.01); *E05B 81/36* (2013.01); *E05B 81/40* (2013.01)

(58) Field of Classification Search
CPC ..... E05B 81/36; E05B 81/40; E05B 79/20; Y10T 292/23; Y10T 292/307; Y10T 292/308; Y10T 292/1047; Y10T 292/1079; Y10T 292/1082
See application file for complete search history.

(56) References Cited

U.S. PATENT DOCUMENTS

| | | | | |
|---|---|---|---|---|
| 5,649,726 | A * | 7/1997 | Rogers, Jr. | E05B 81/06 292/201 |
| 5,702,136 | A | 12/1997 | Funk et al. | |
| 5,909,918 | A * | 6/1999 | Kowalewski | E05B 81/06 292/142 |
| 5,921,594 | A | 7/1999 | Bendel | |
| 6,062,613 | A | 5/2000 | Jung et al. | |
| 6,371,536 | B1 | 4/2002 | Koerwer et al. | |
| 6,386,599 | B1 | 5/2002 | Chevalier | |
| 8,151,610 | B2 | 4/2012 | Fujihara | |
| 9,121,202 | B2 | 9/2015 | Burciaga et al. | |
| 2001/0052705 | A1 | 12/2001 | Fisher | |
| 2004/0075281 | A1 | 4/2004 | Ueki | |
| 2004/0113438 | A1 | 6/2004 | Kachouh | |
| 2010/0223968 | A1* | 9/2010 | Krueger | E05B 81/28 70/283.1 |
| 2012/0061976 | A1* | 3/2012 | Tostado | E05B 81/34 292/200 |
| 2012/0274457 | A1* | 11/2012 | Burns | E05B 81/66 340/425.5 |
| 2013/0056996 | A1 | 3/2013 | Akizuki et al. | |
| 2015/0308163 | A1 | 10/2015 | Tomaszewski | |
| 2018/0371806 | A1 | 12/2018 | Jeong | |

FOREIGN PATENT DOCUMENTS

| | | | |
|---|---|---|---|
| CN | 204645895 | U | 9/2015 |
| DE | 195 12 573 | A1 | 10/1996 |
| EP | 0 917 612 | B1 | 4/2000 |
| EP | 1113133 | A1 | 7/2001 |
| EP | 1 748 130 | A2 | 1/2007 |
| EP | 1 739 258 | B1 | 7/2008 |
| JP | S63146066 | A | 6/1988 |
| KR | 10-0535053 | | 12/2005 |
| KR | 10-2015-0050268 | A | 5/2015 |
| KR | 10-2016-0082671 | | 7/2016 |
| WO | WO 2014/082175 | A1 | 6/2014 |
| WO | WO 2015/137774 | A1 | 9/2015 |

OTHER PUBLICATIONS

Japanese Patent Office, Office Action, Application No. 2018-551735, dated May 28, 2019, with English translation, 7 pages.
China National Intellectual Property Administration, Office Action, Application No. 201680076332.5, dated Apr. 26, 2020, with English translation, 21 pages.

* cited by examiner

[Fig. 1]
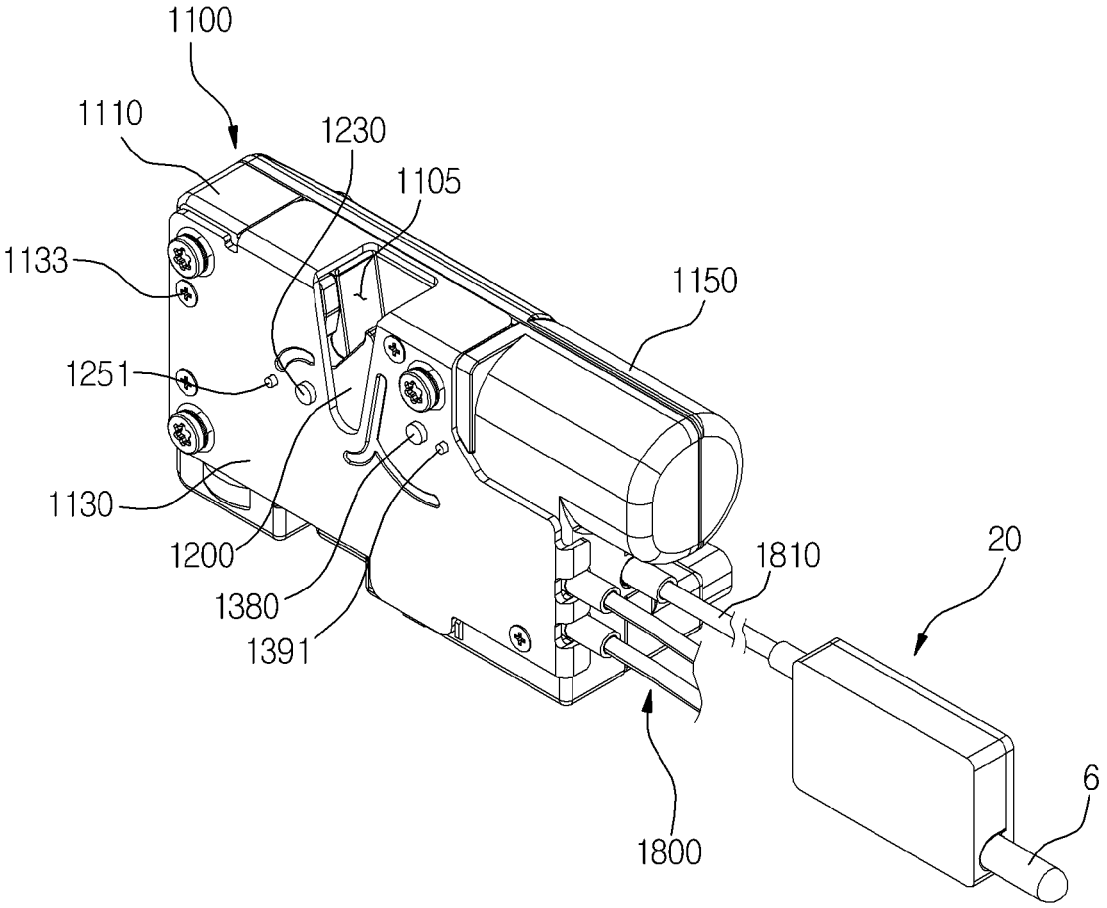

[Fig. 2]
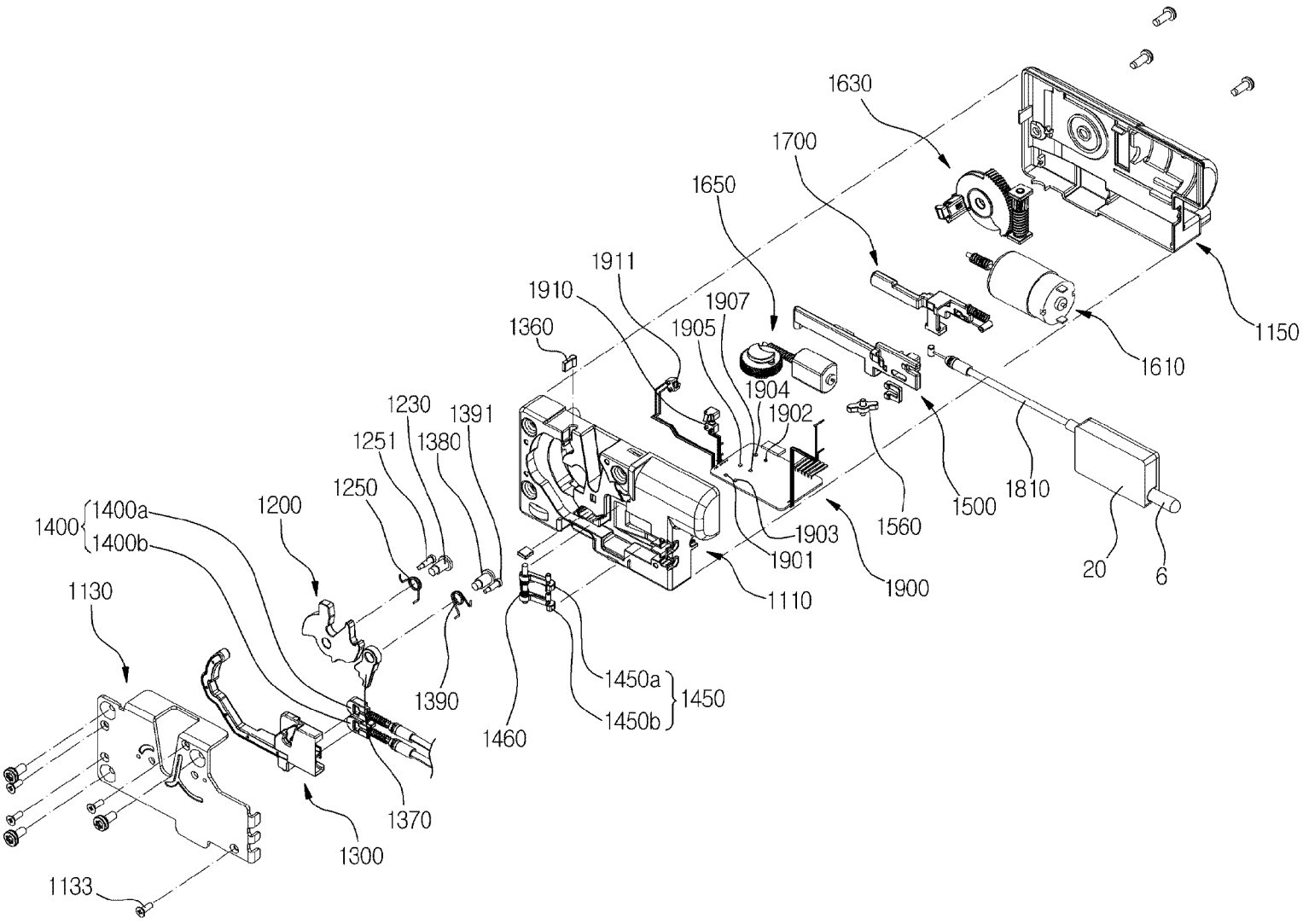

[Fig. 3]
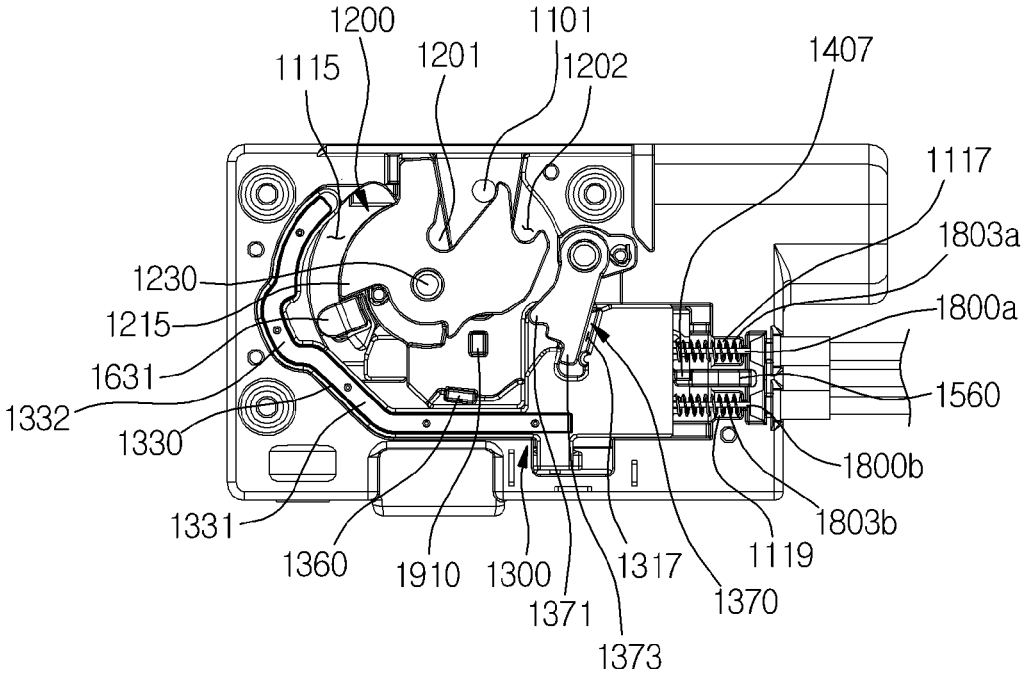

[Fig. 4]
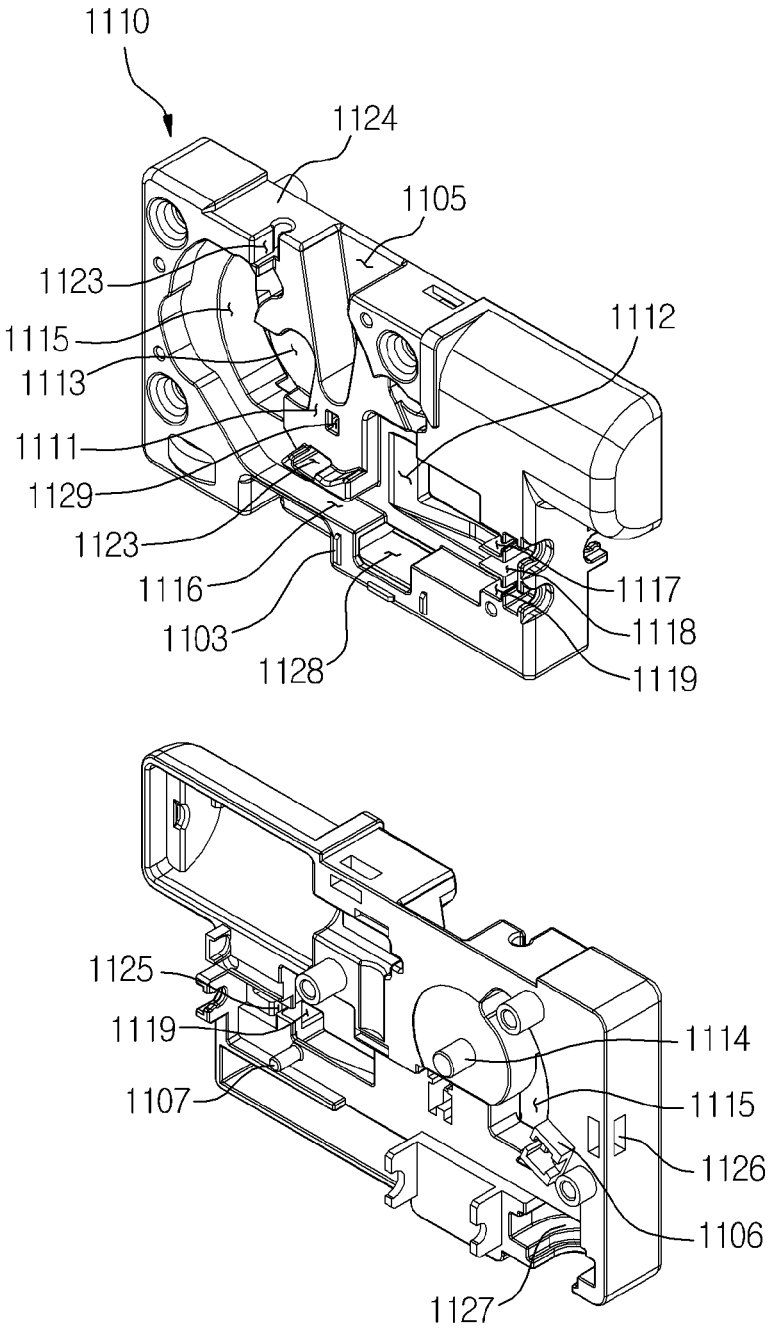

[Fig. 5]
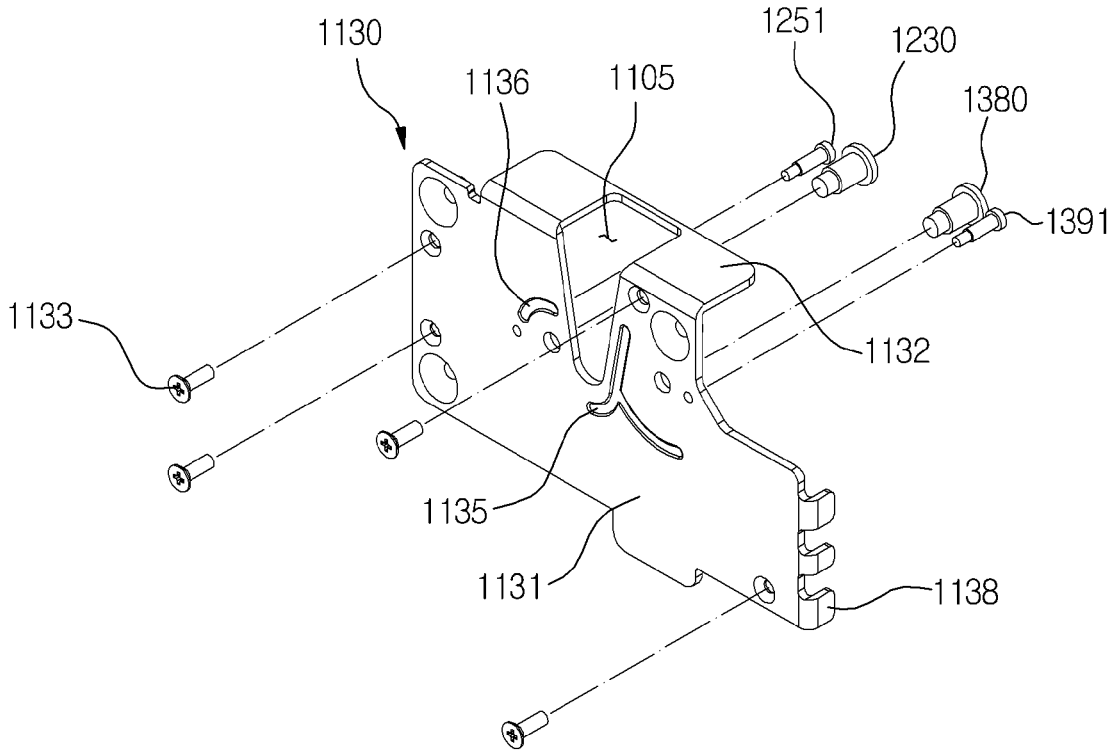
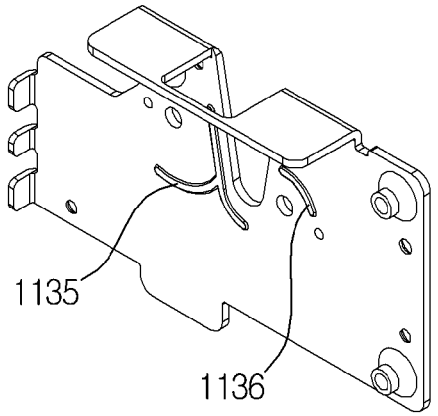

[Fig. 6]
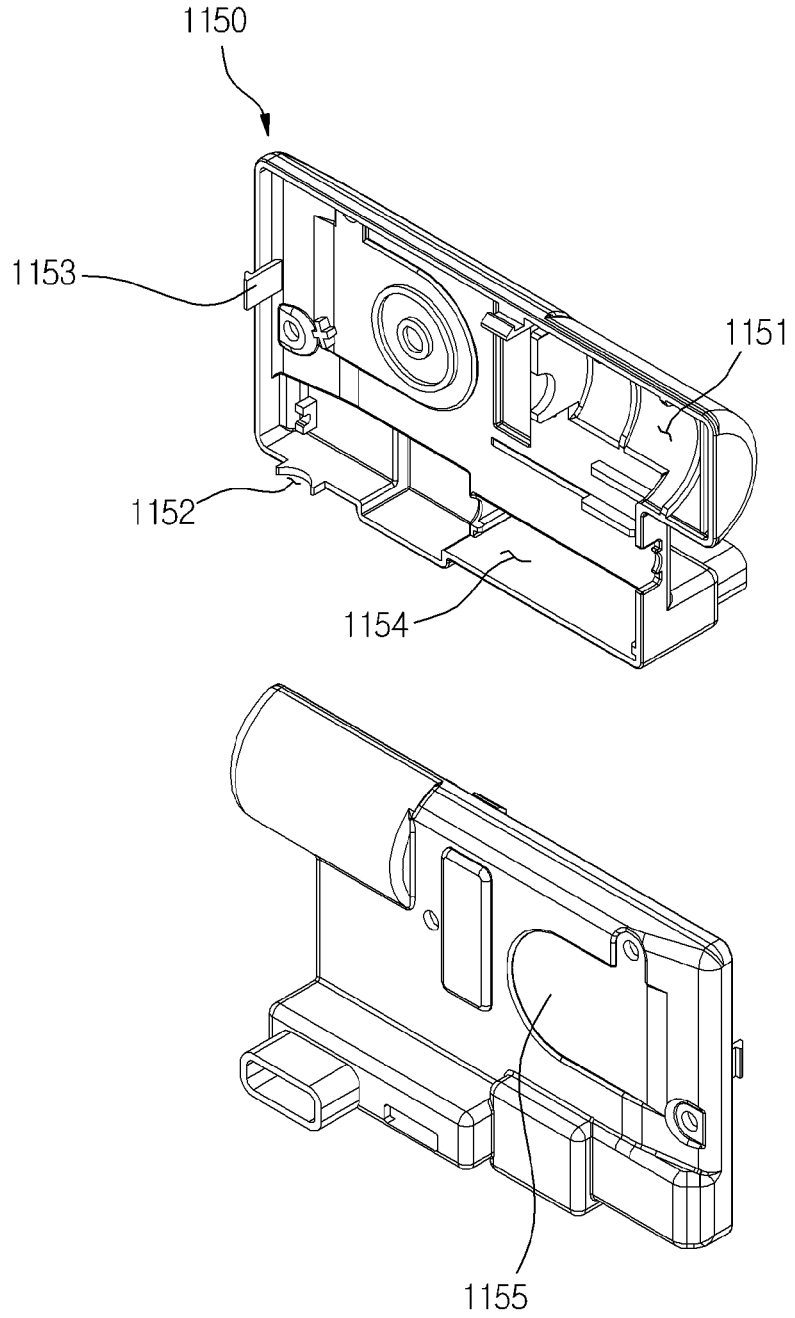

[Fig. 7]
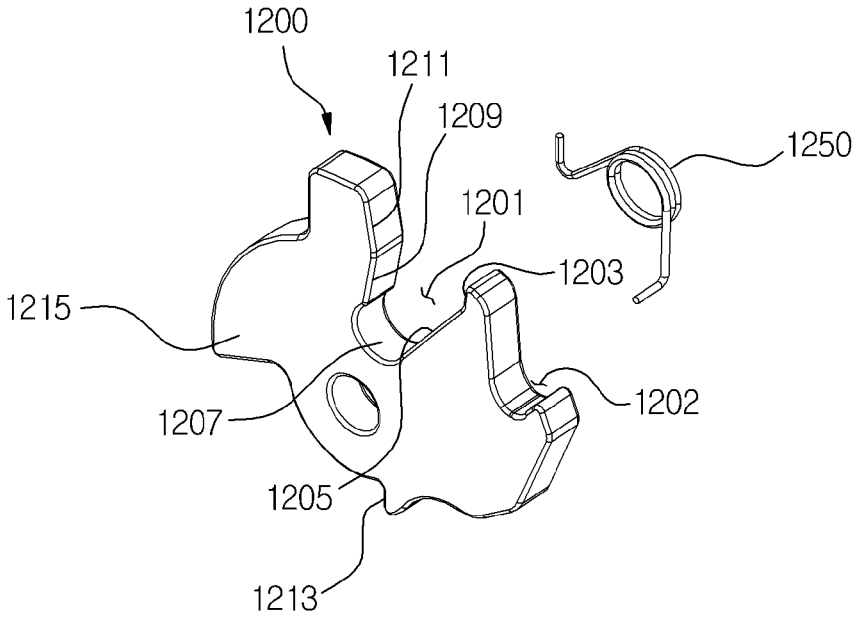

[Fig. 8]
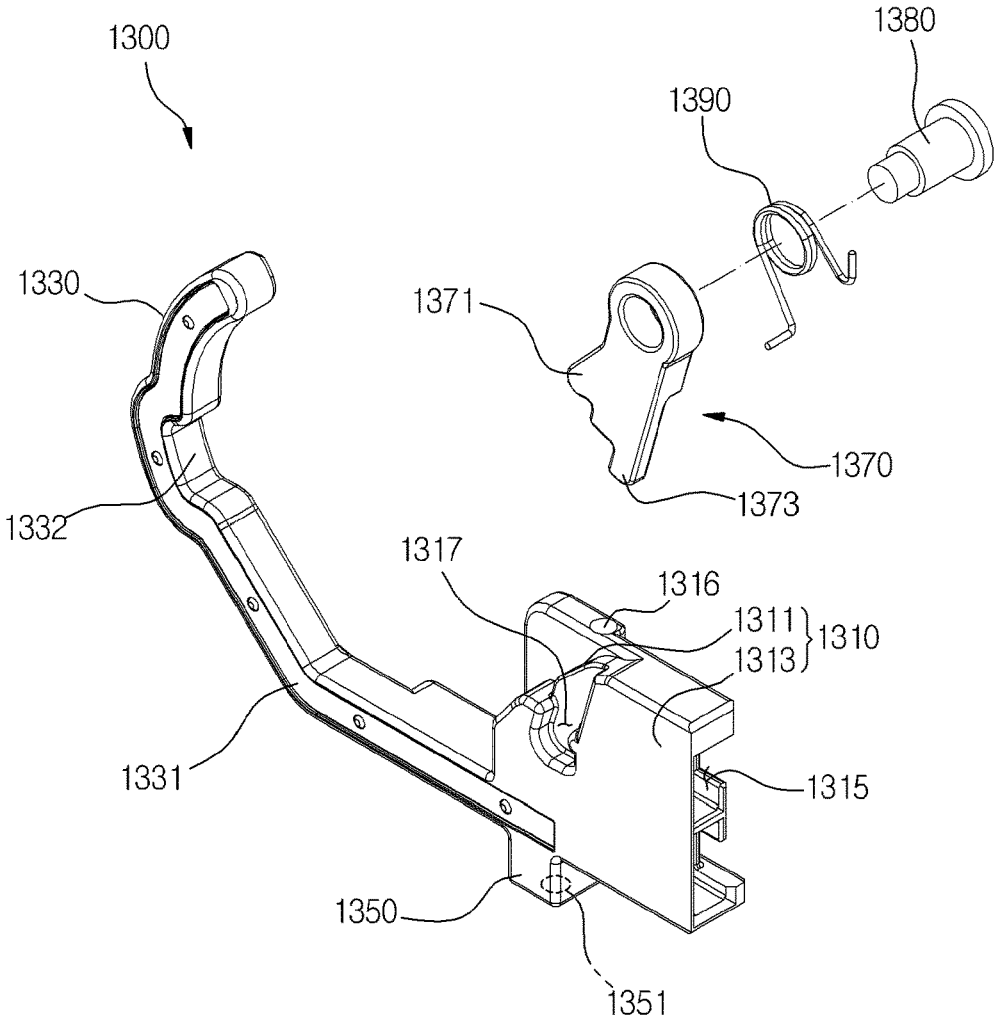
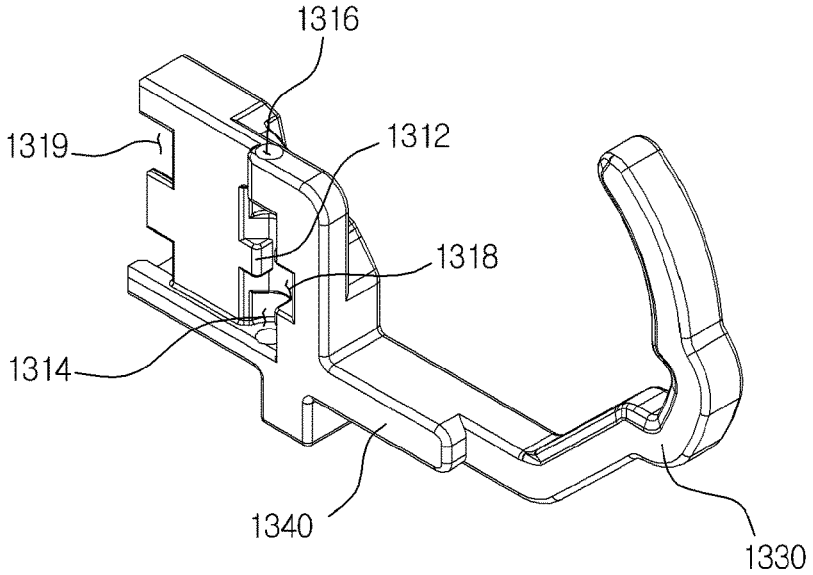

[Fig. 9]
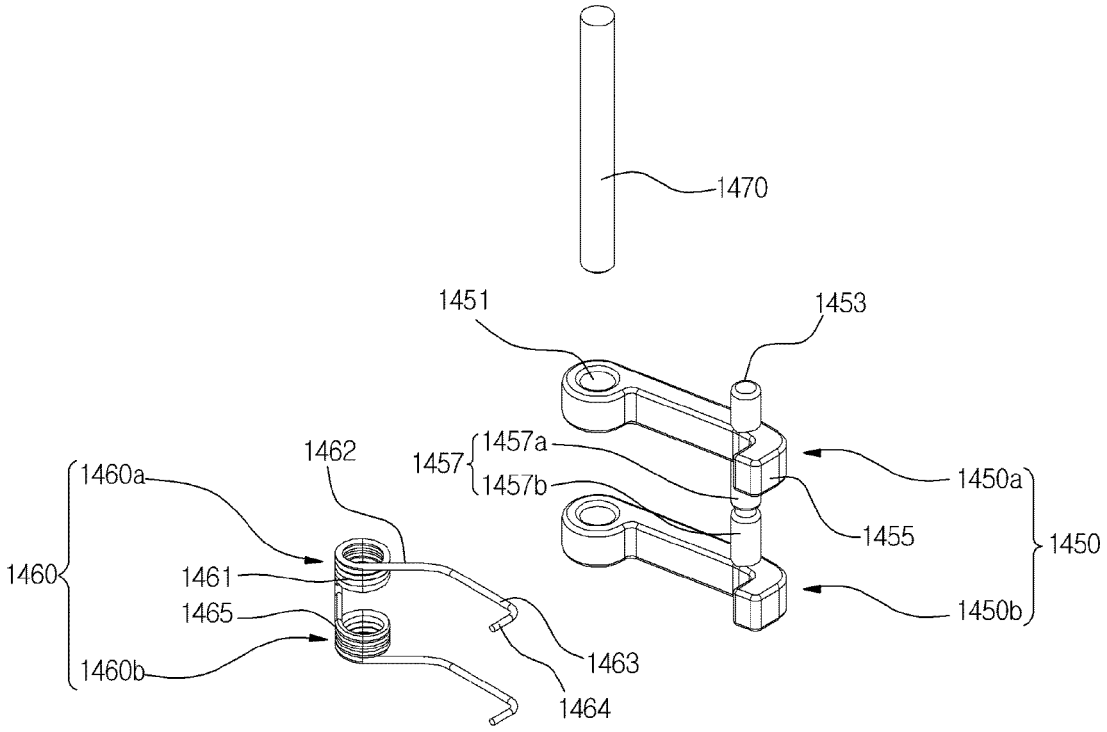
[Fig. 10]
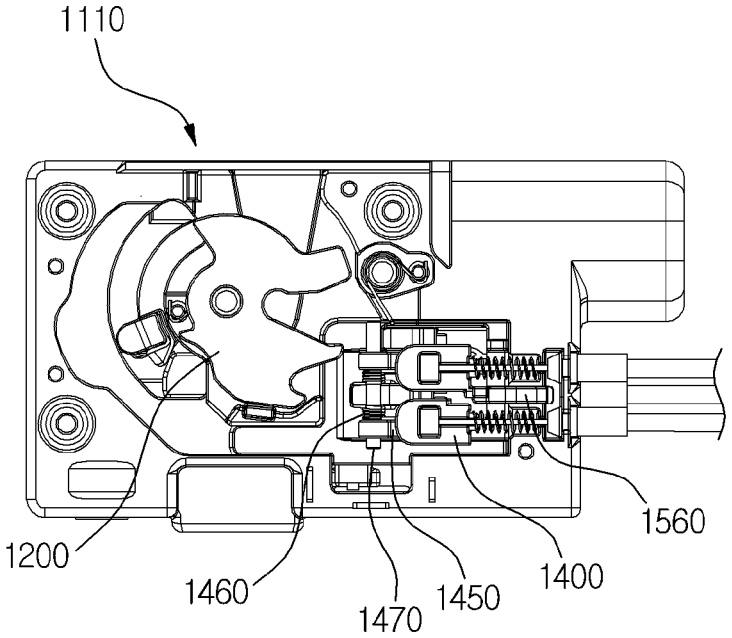

[Fig. 11]
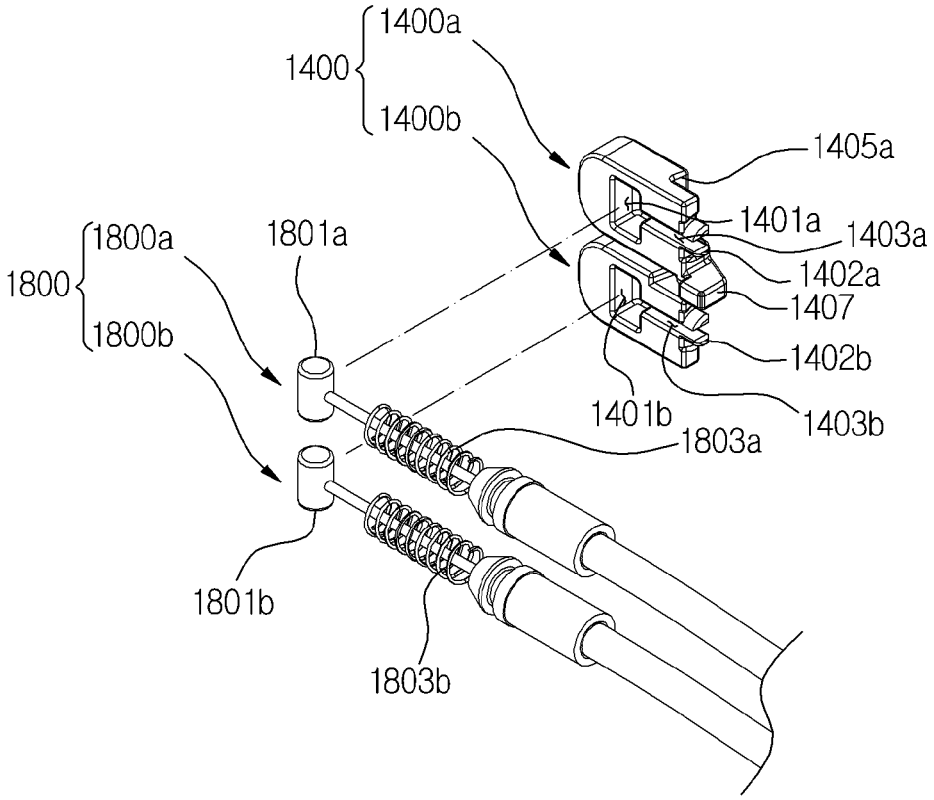
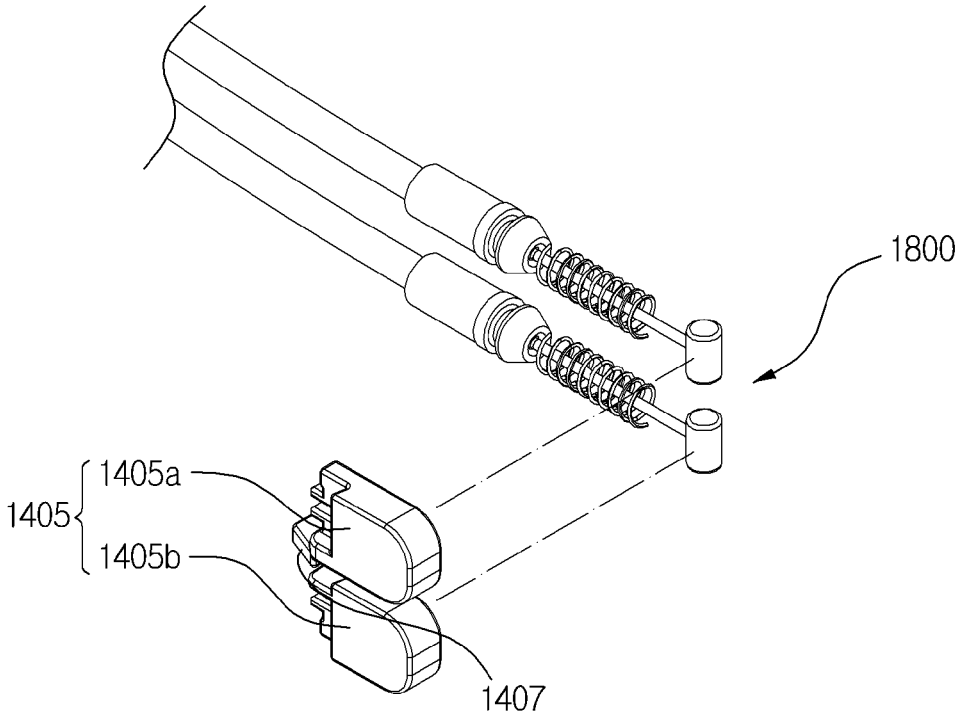

[Fig. 12]
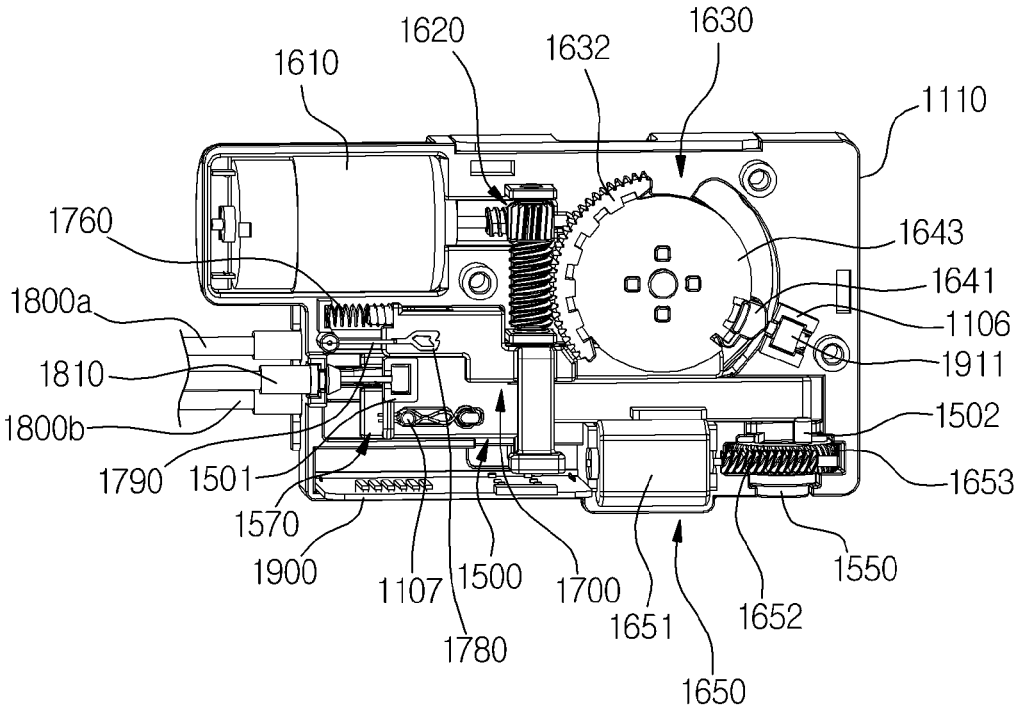

[Fig. 13]
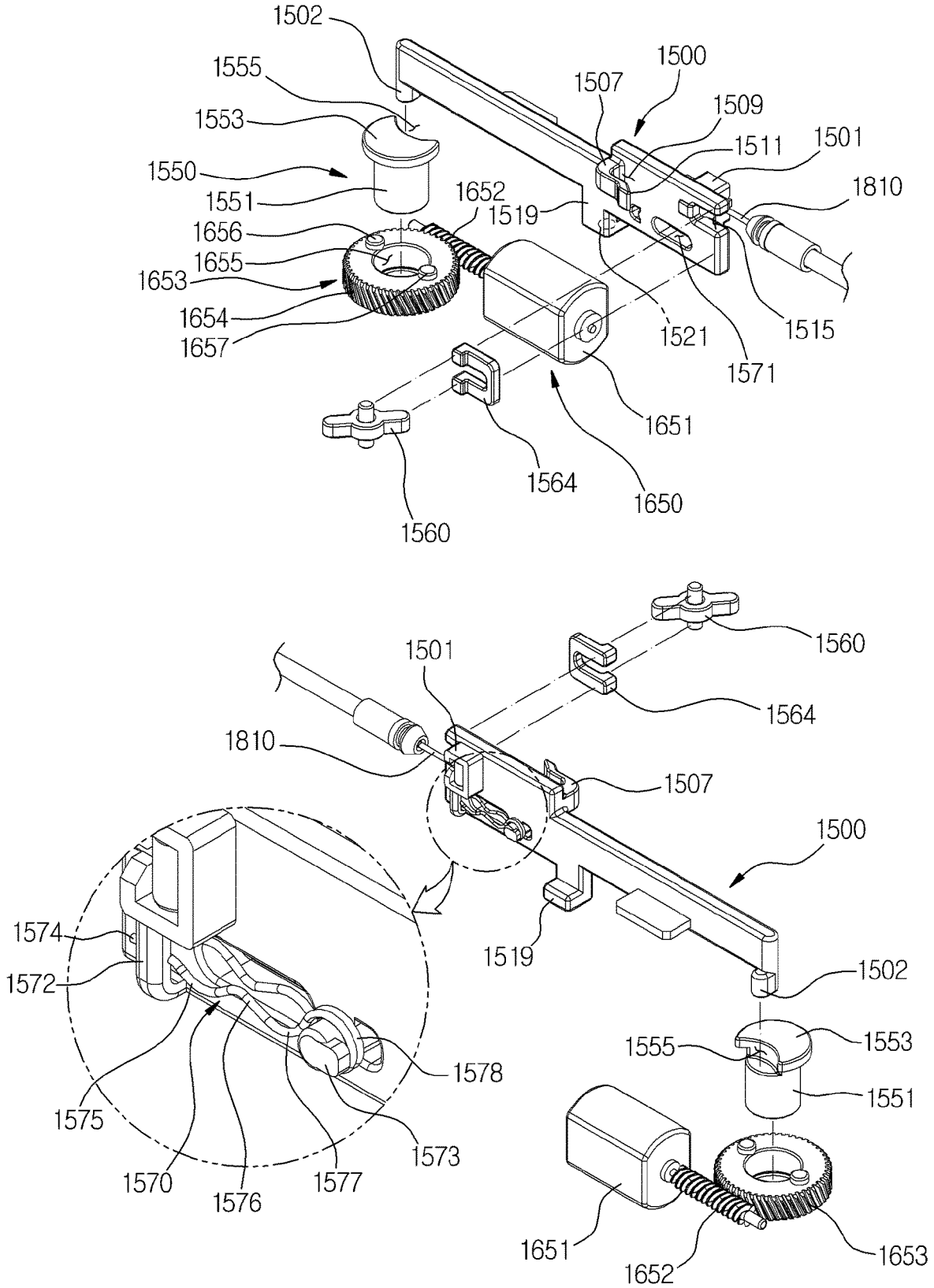

[Fig. 14]
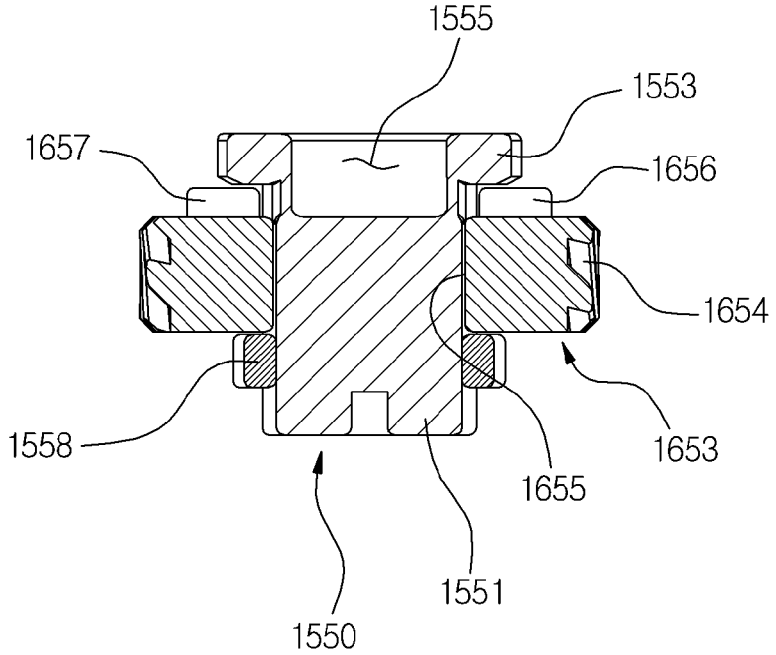
[Fig. 15]
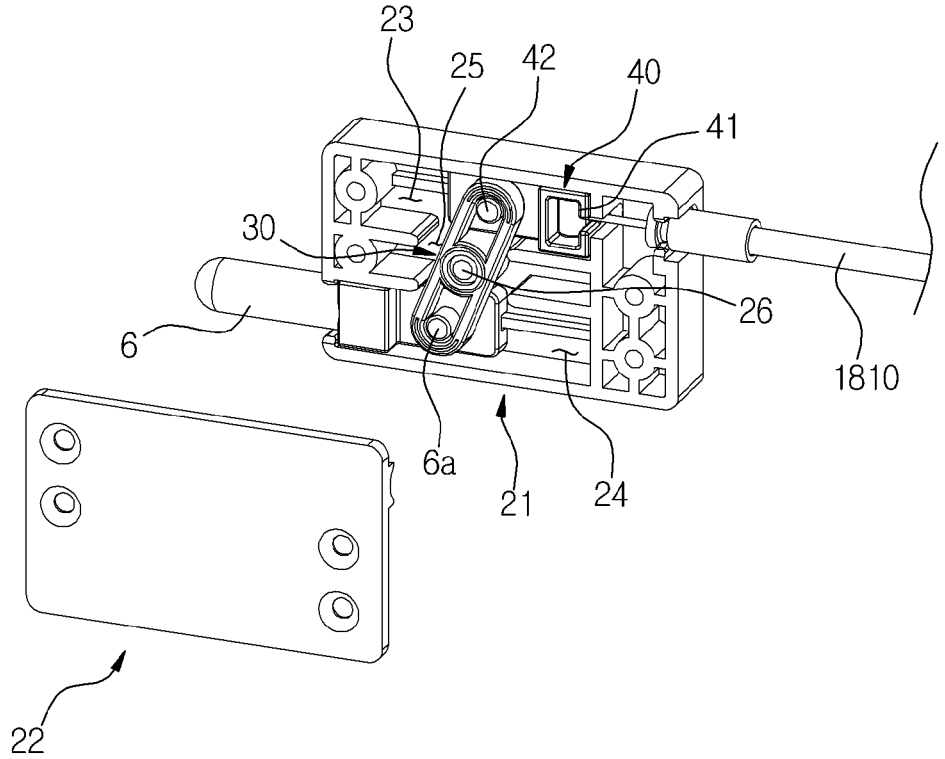

[Fig. 16]
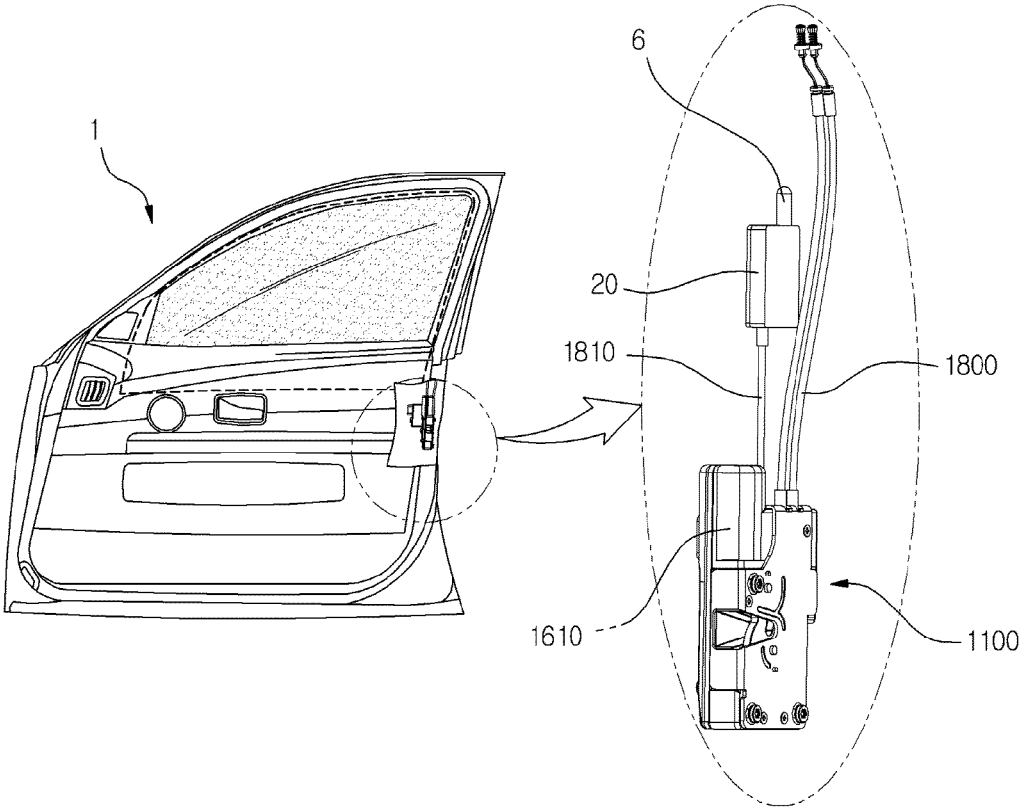
[Fig. 17]
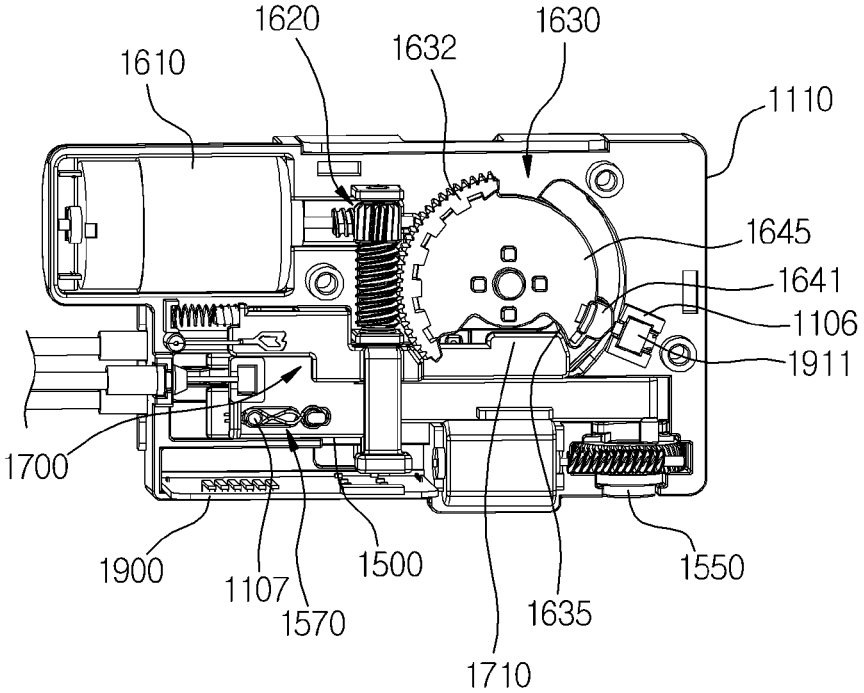

[Fig. 18]
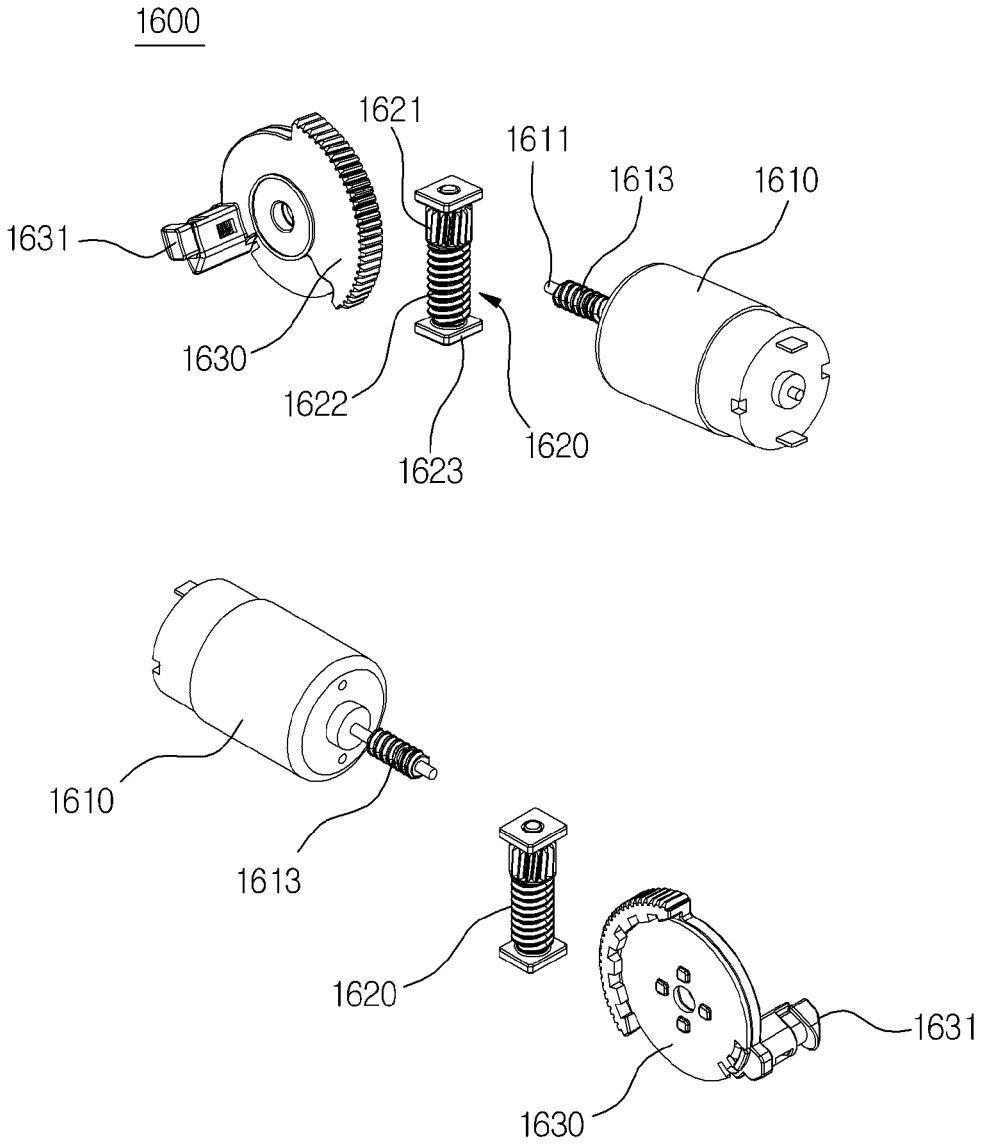

[Fig. 19]
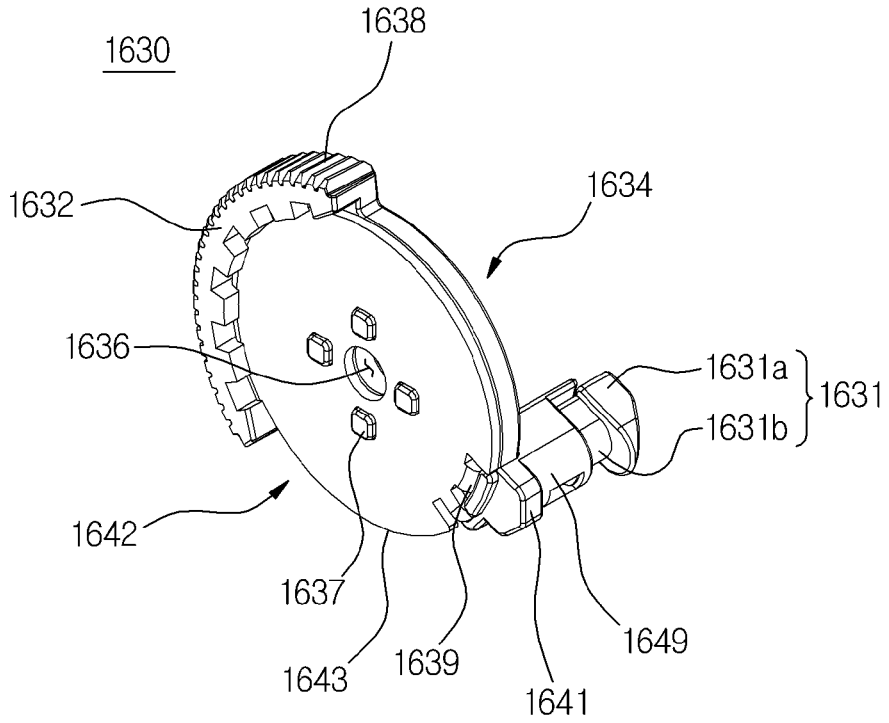
[Fig. 20]
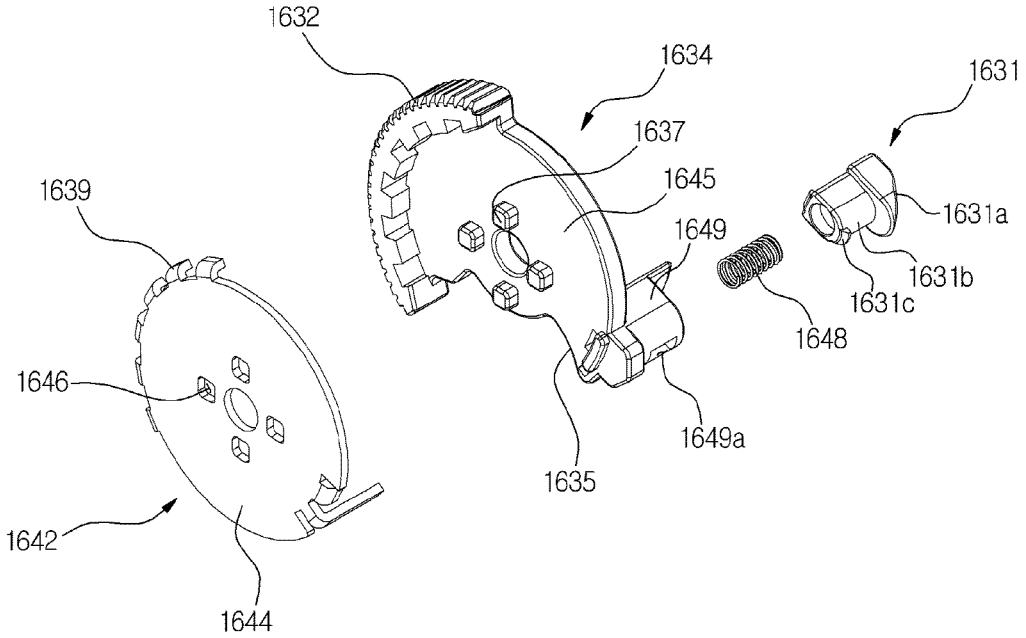

[Fig. 21]
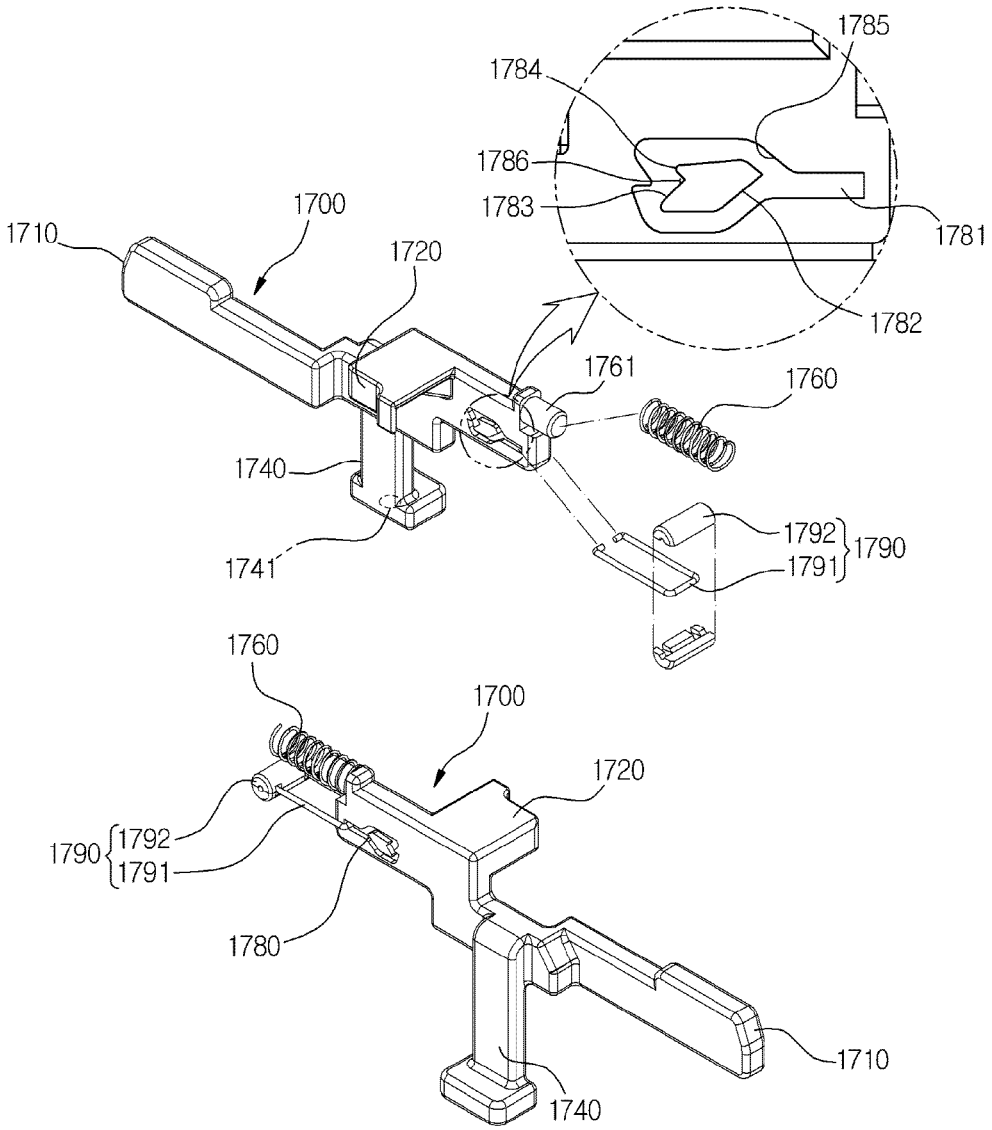

[Fig. 22]
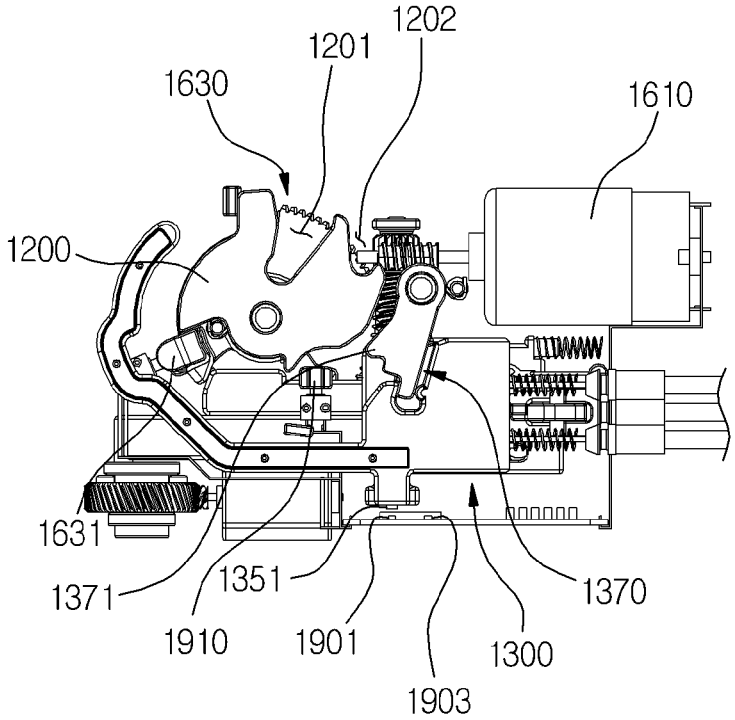
[Fig. 23]
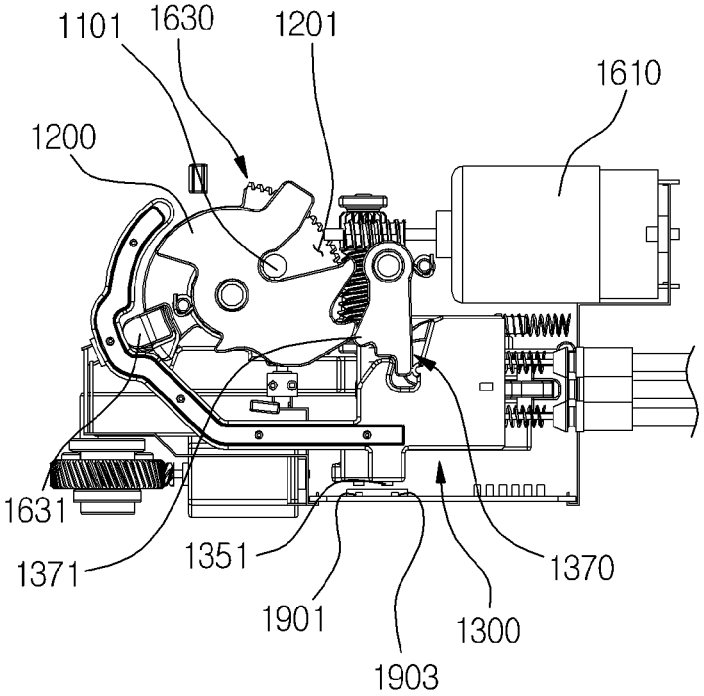

[Fig. 24]
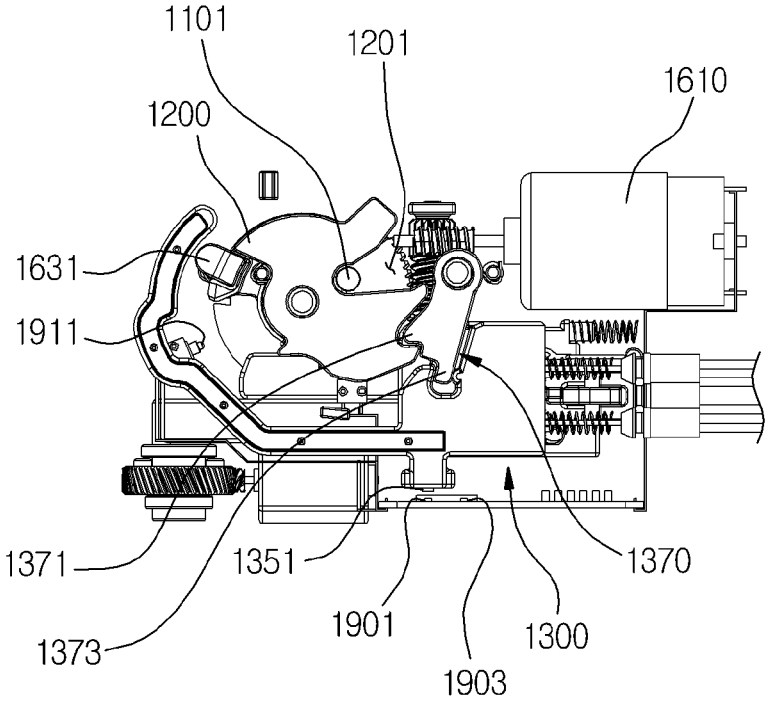
[Fig. 25]
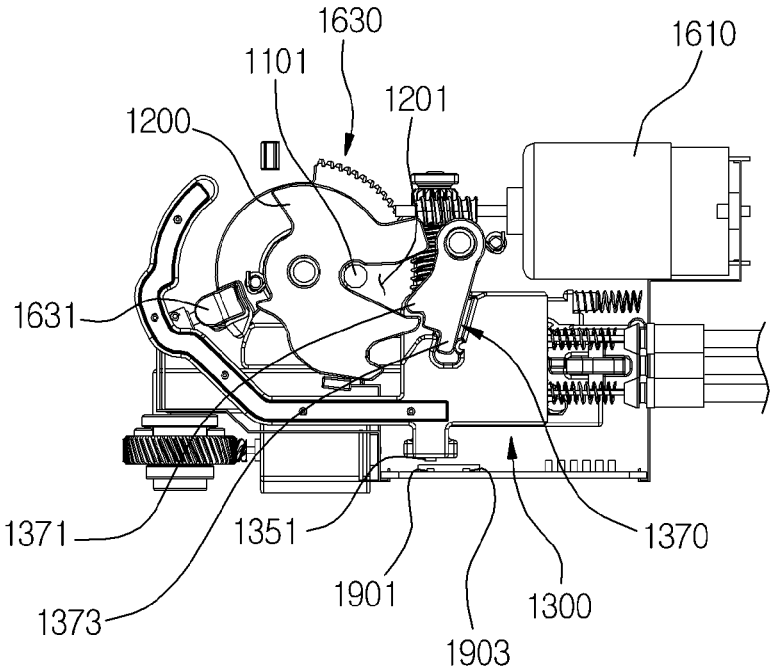

[Fig. 26]
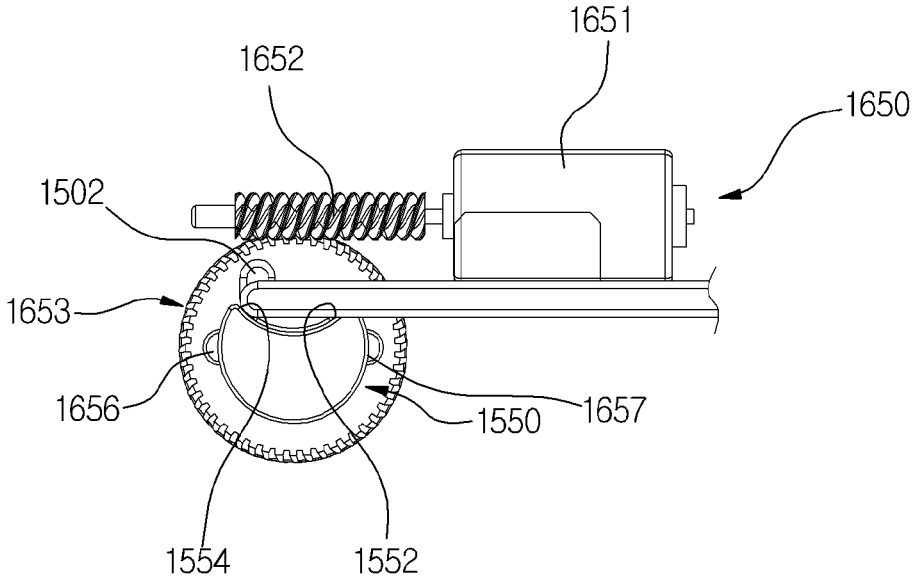
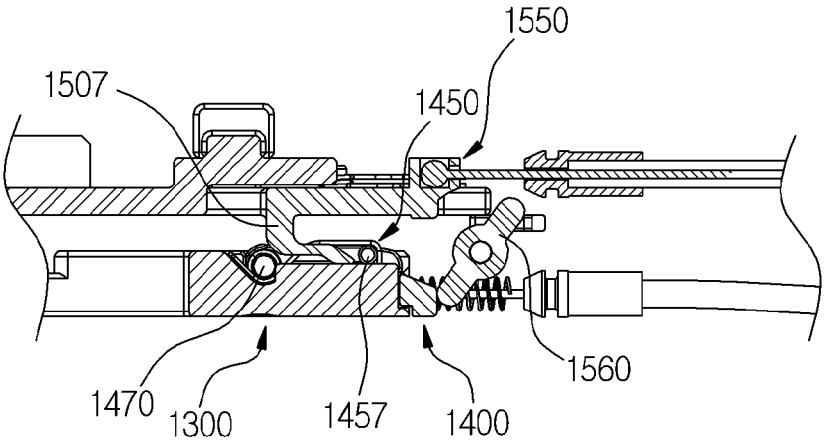

[Fig. 27]
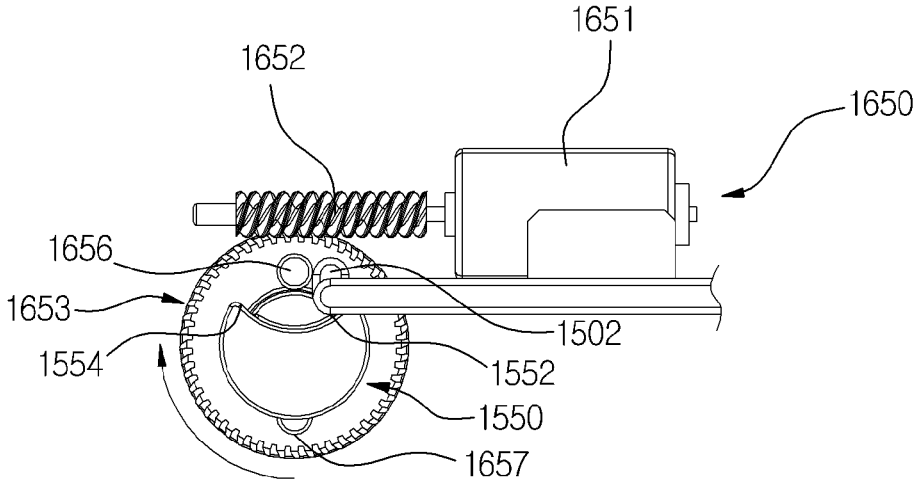
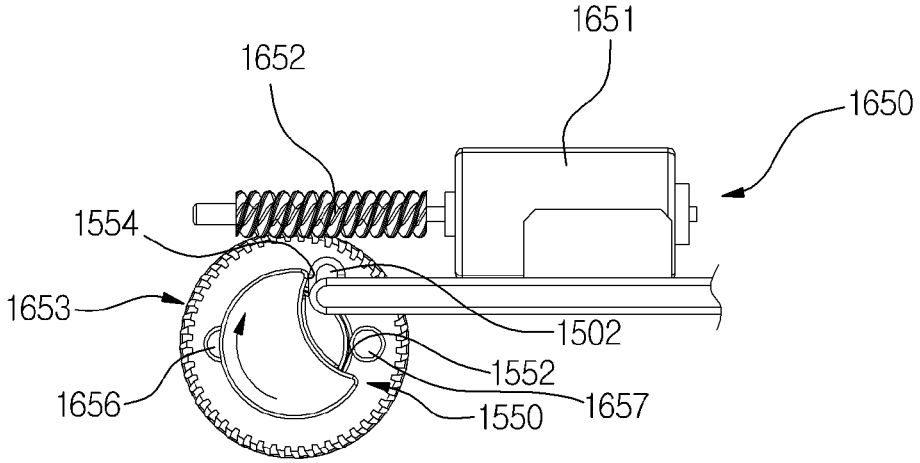
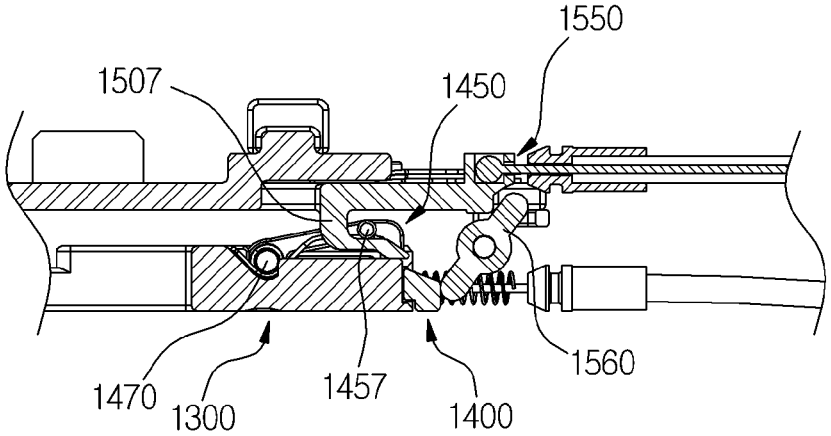

[Fig. 28]
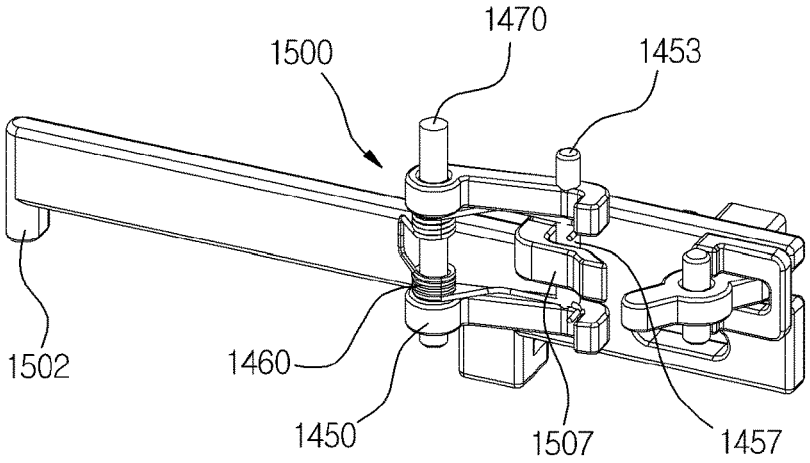
[Fig. 29]
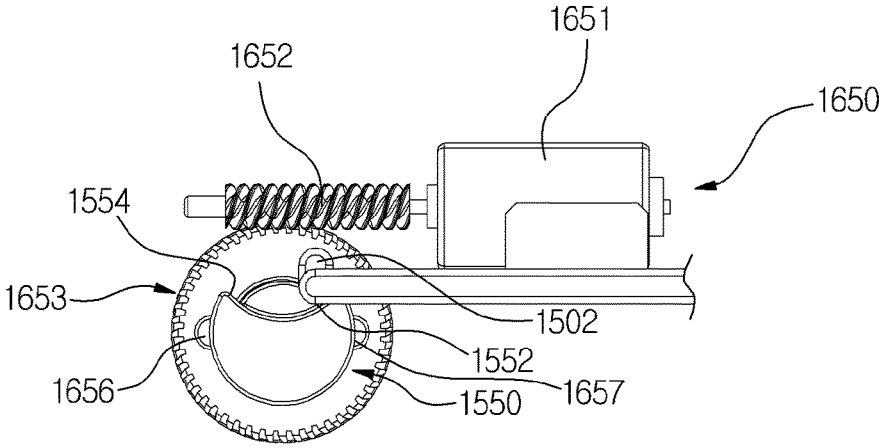
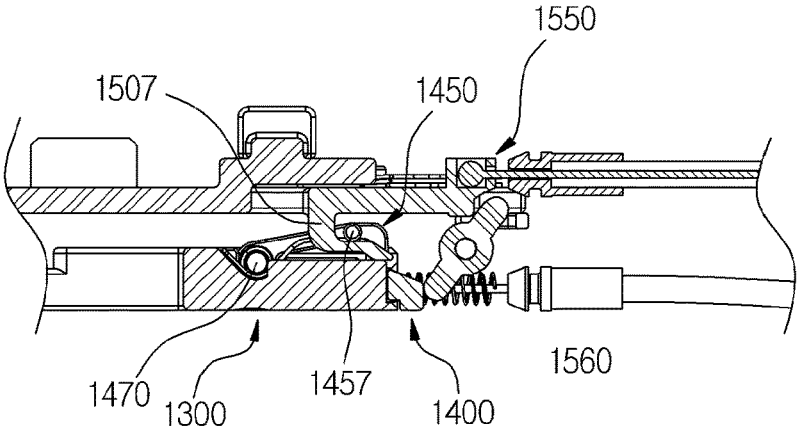

[Fig. 30]
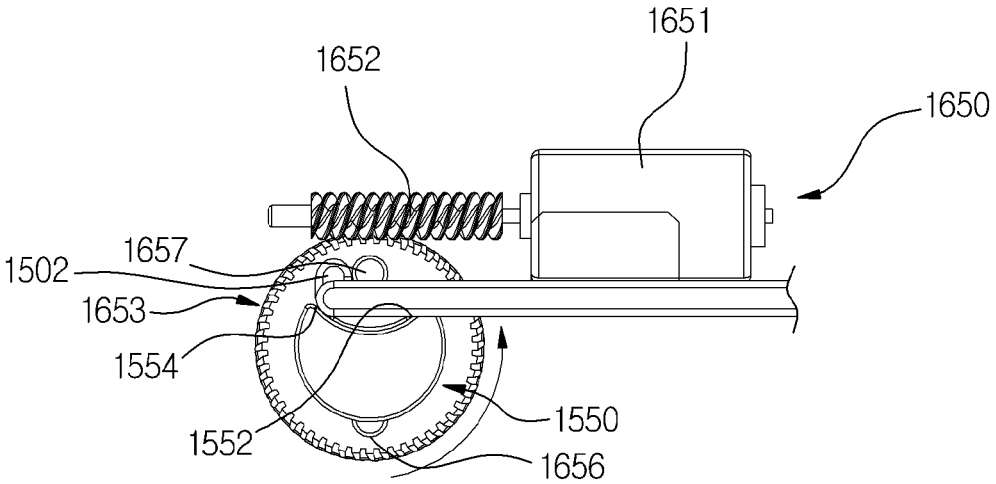
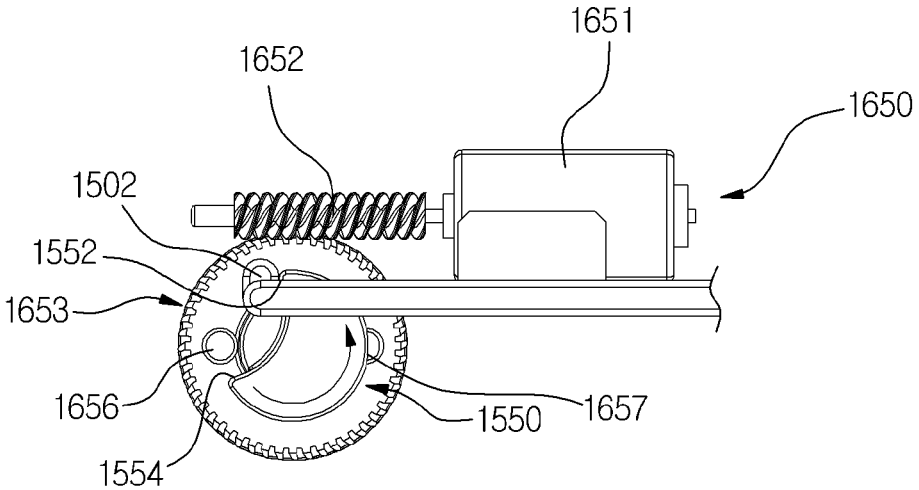
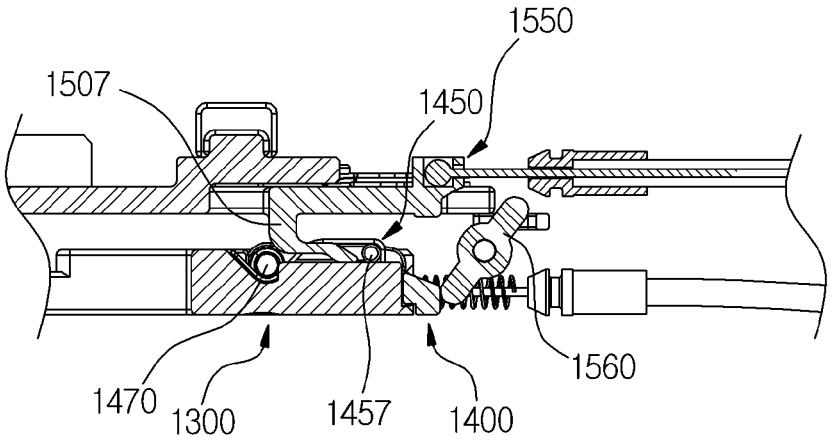

[Fig. 31]
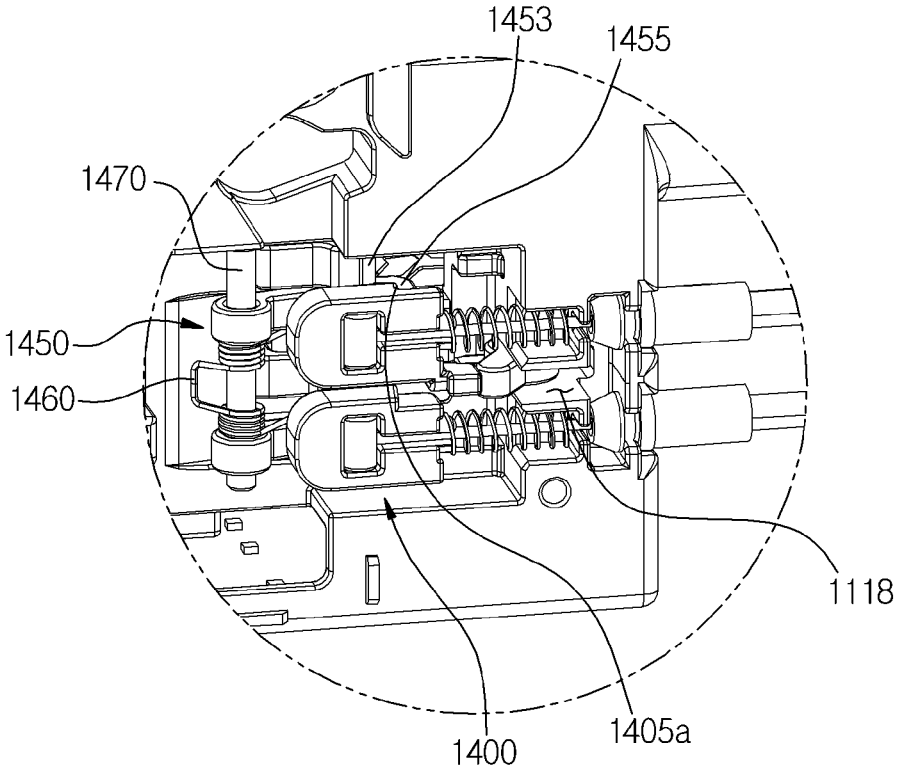
[Fig. 32]
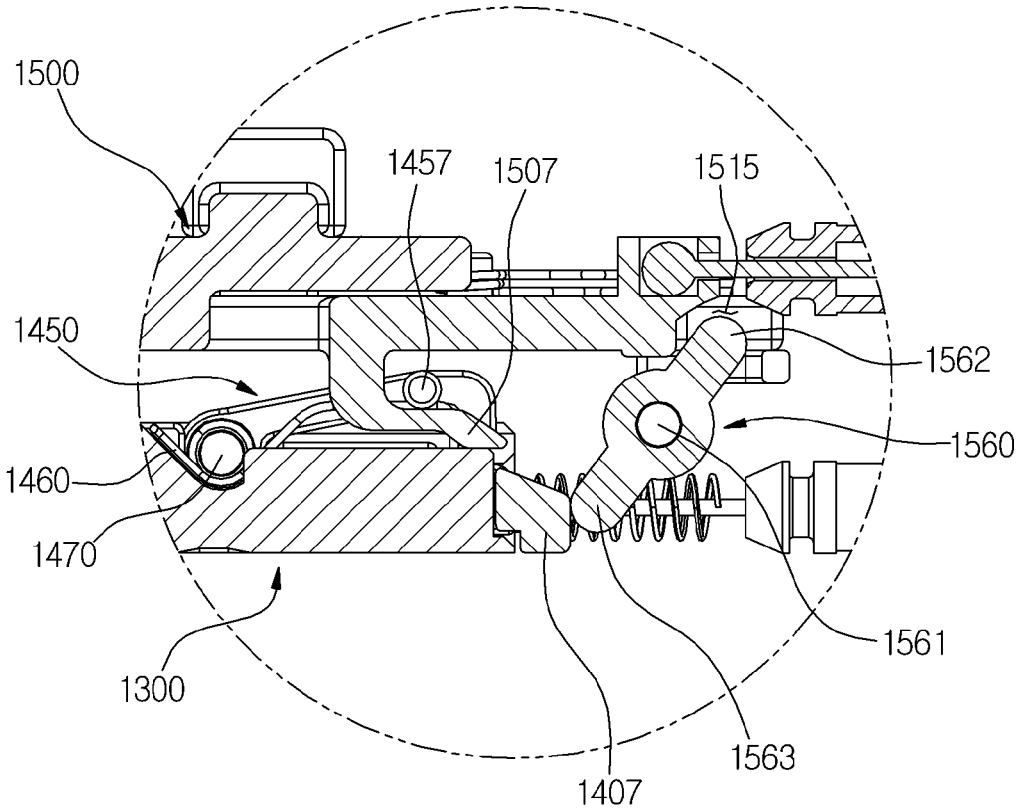

[Fig. 33]
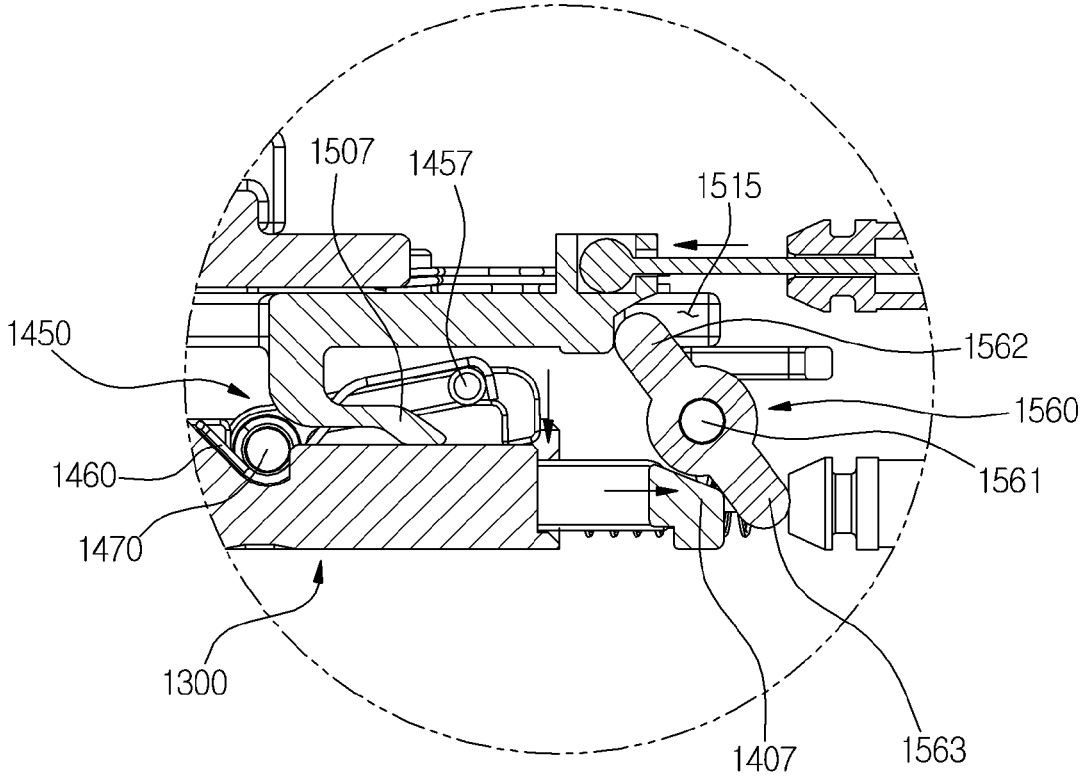
[Fig. 34]
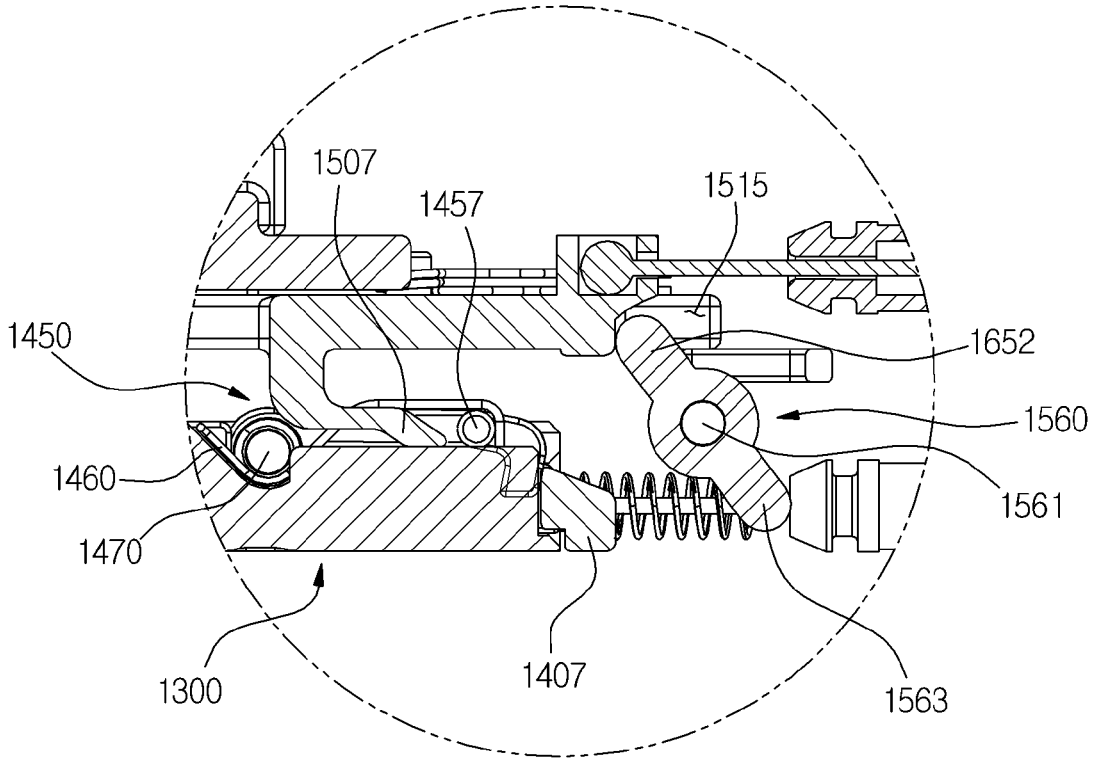

[Fig. 35]
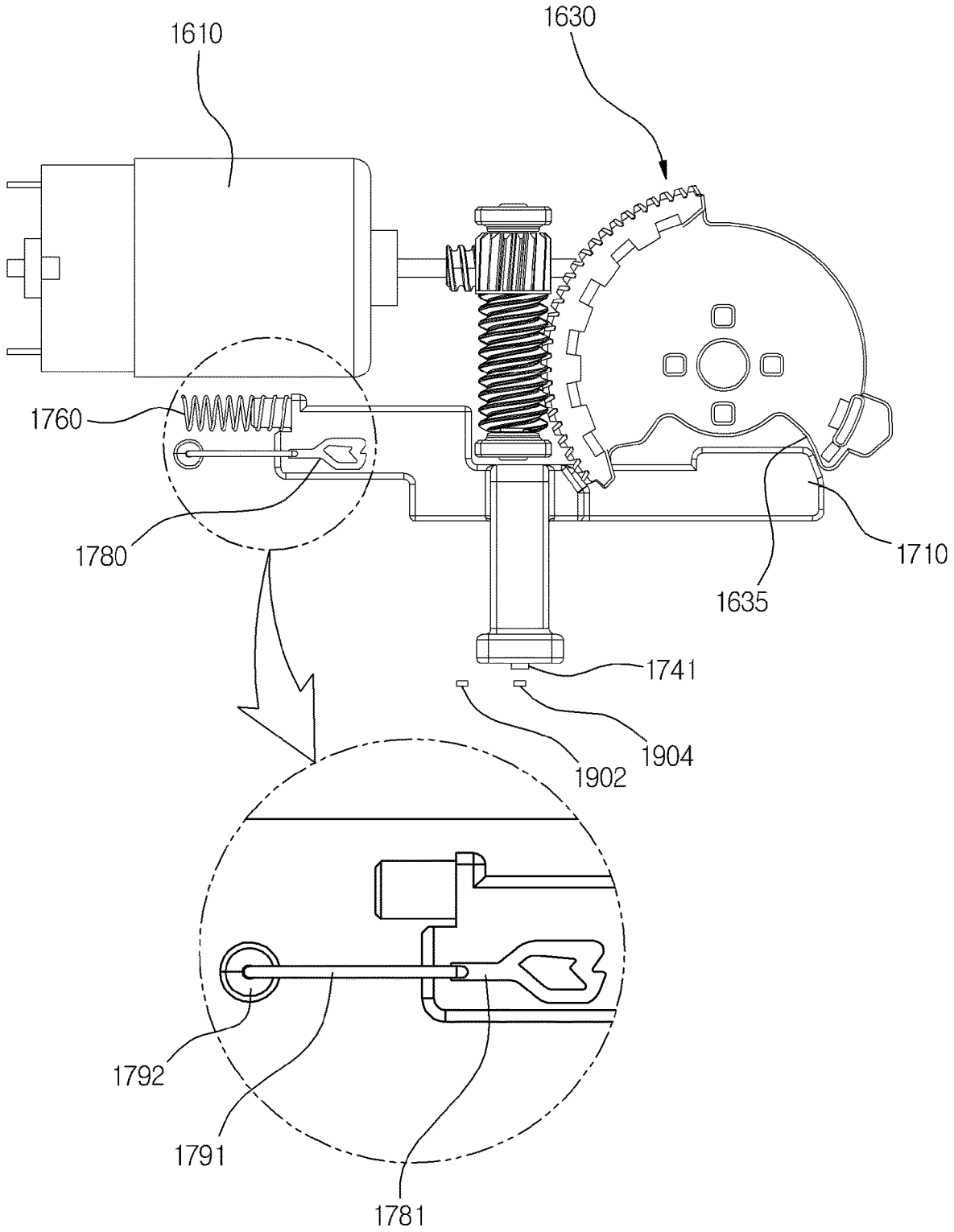

[Fig. 36]
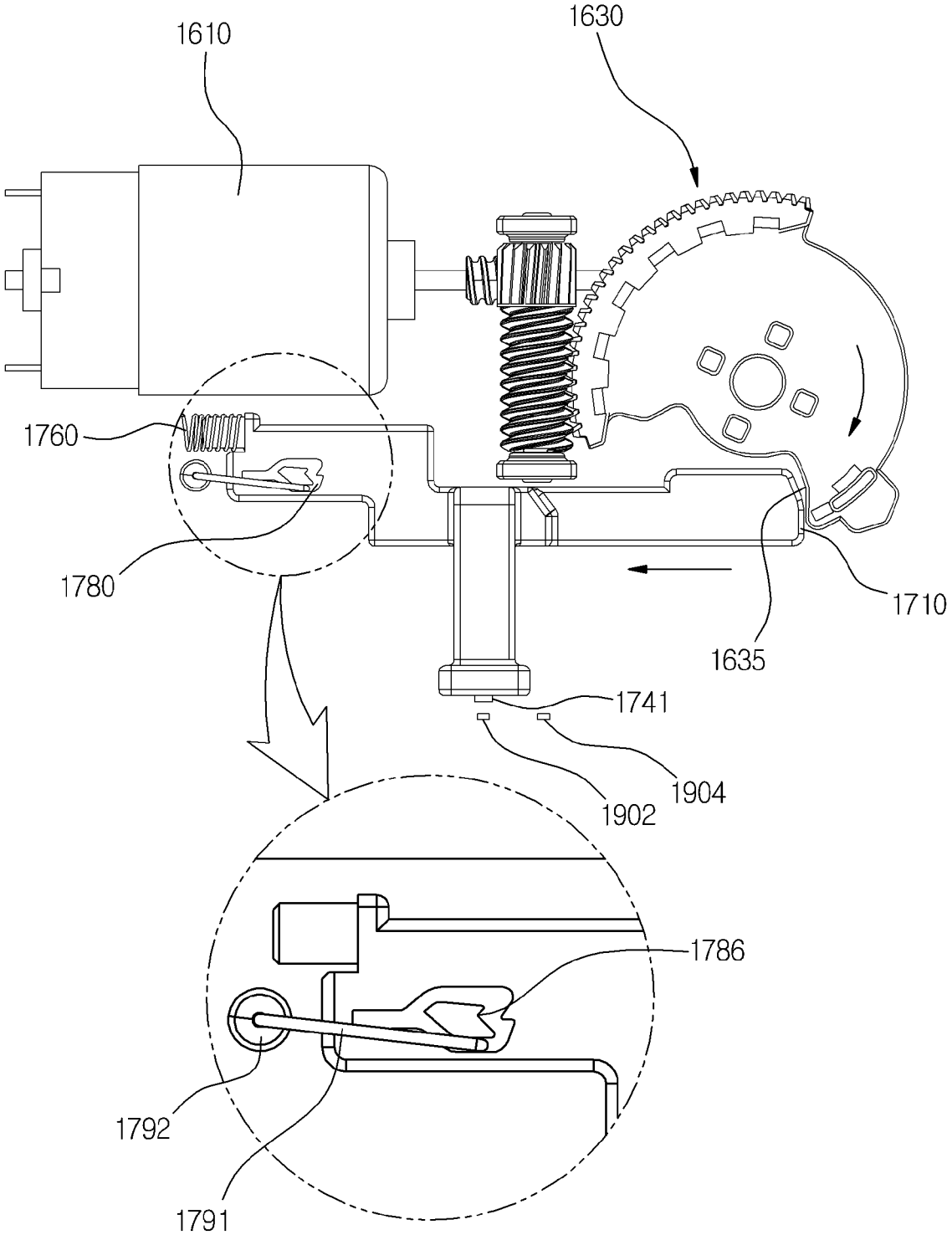

[Fig. 37]
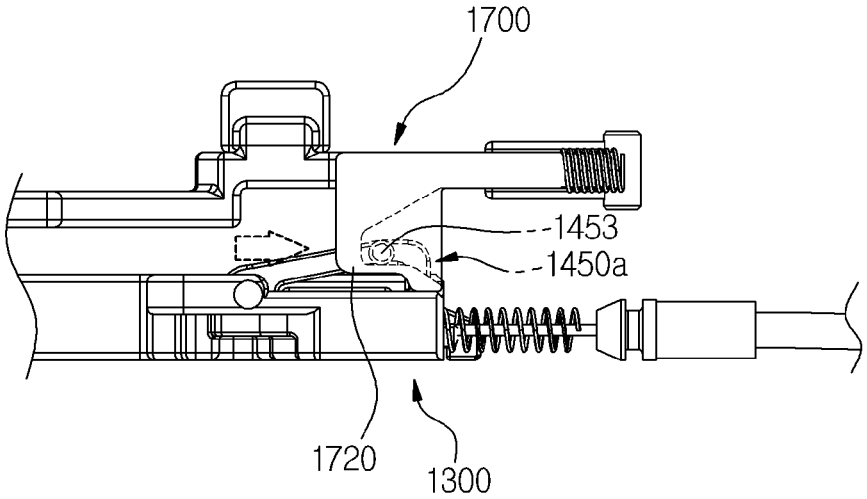

[Fig. 38]
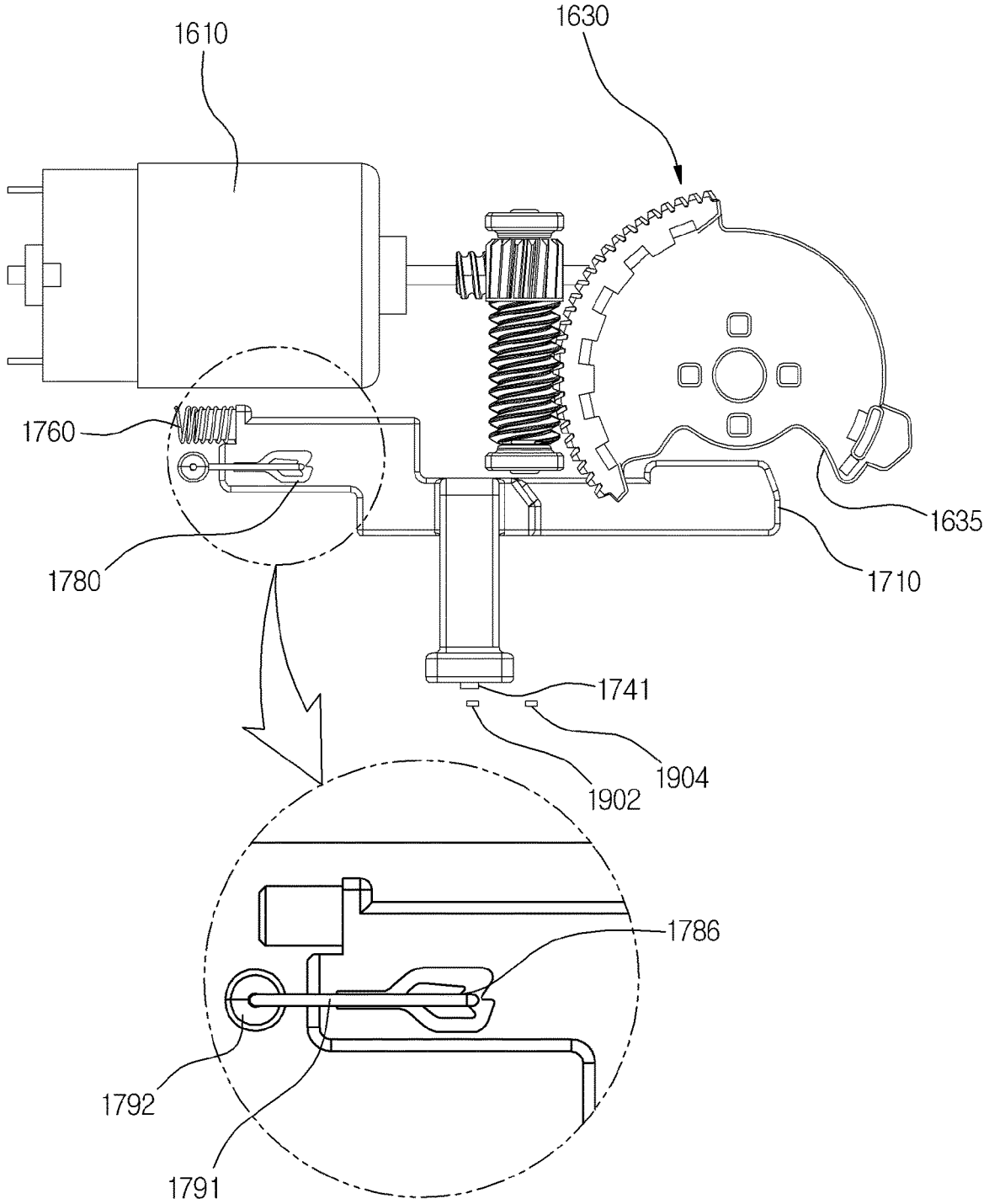

[Fig. 39]
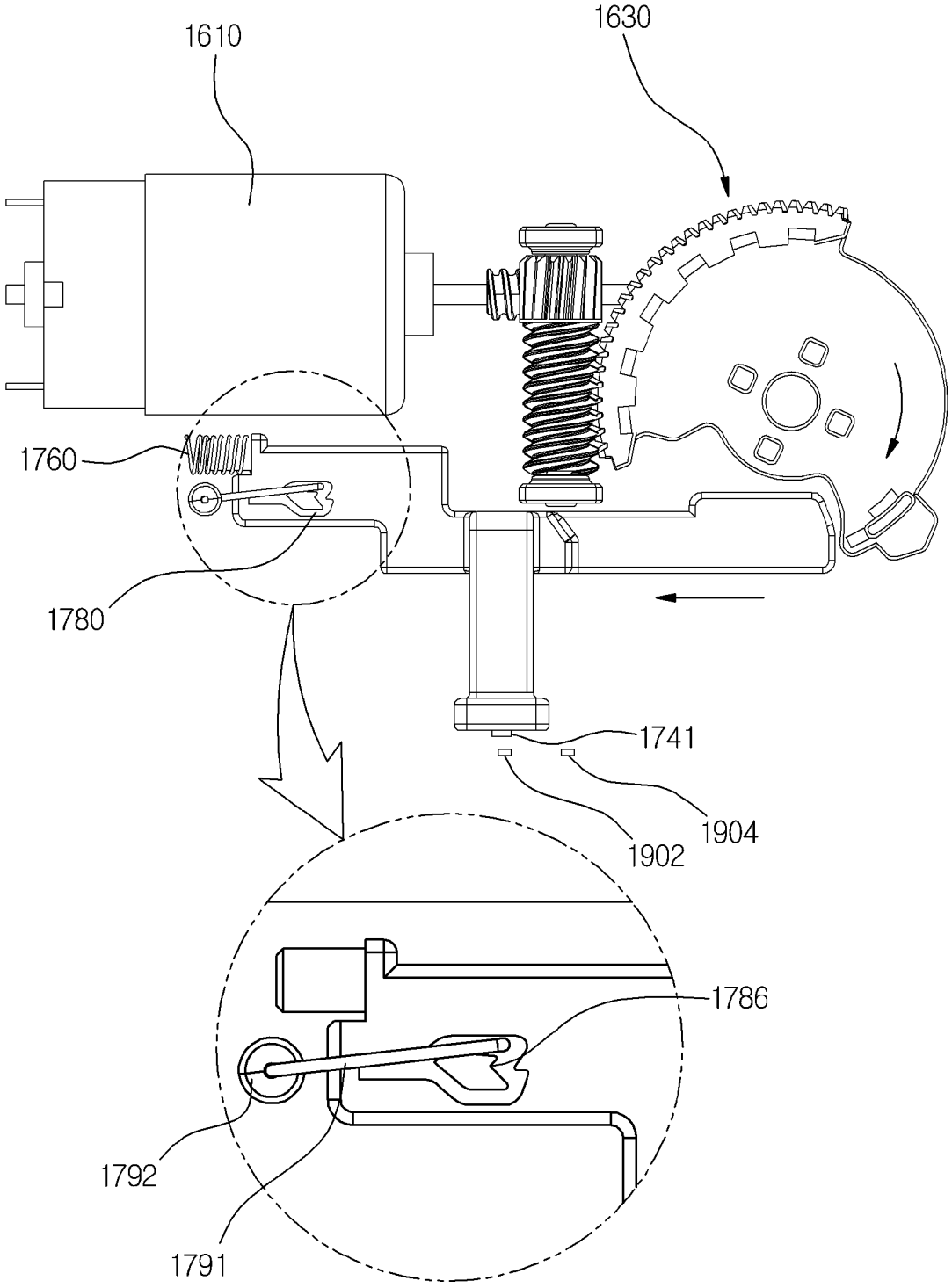

[Fig. 40]
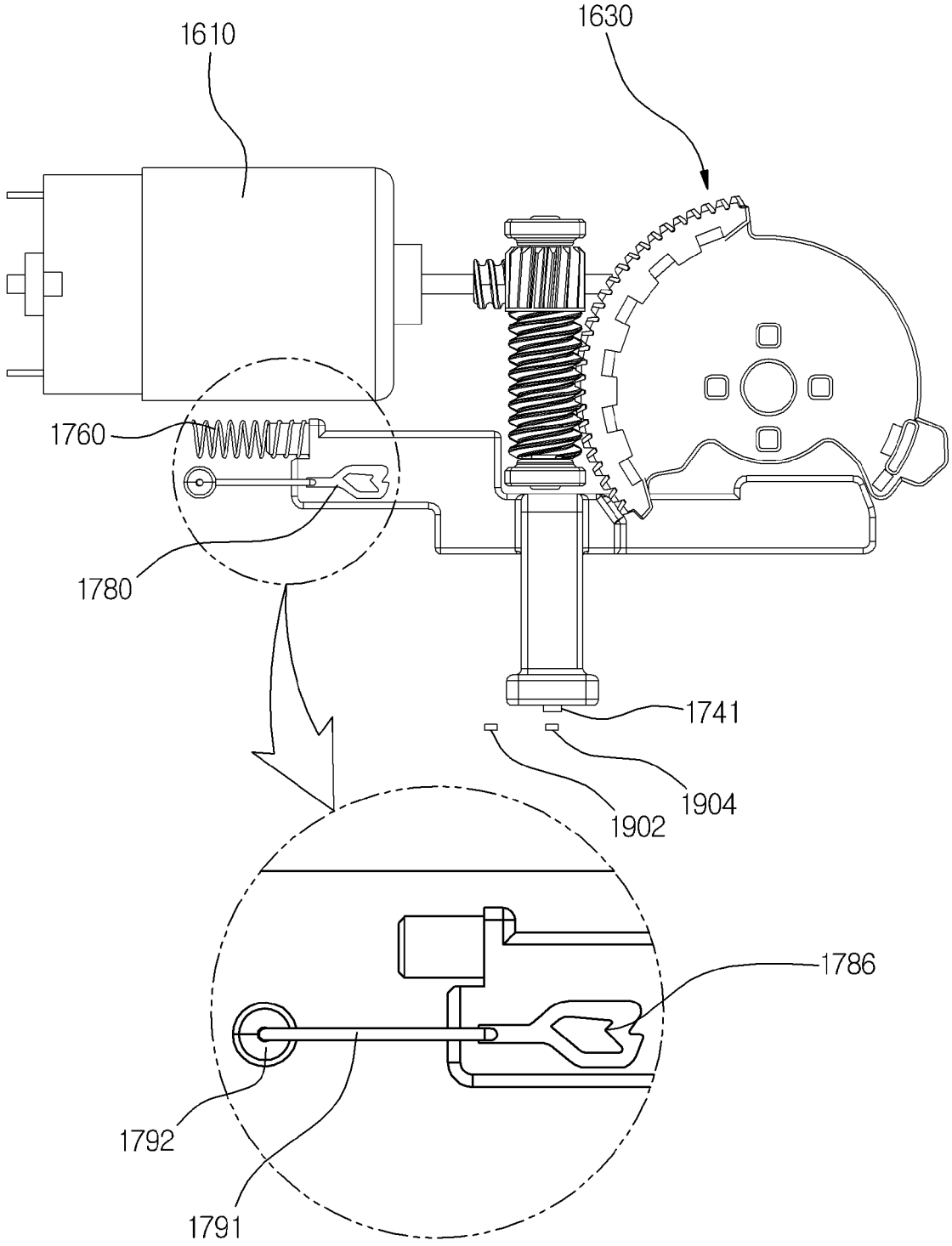

[Fig. 41]
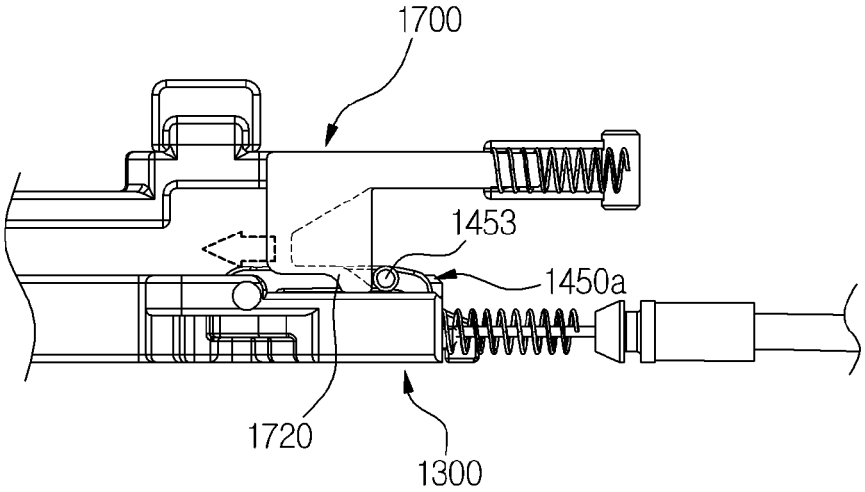

[Fig. 42]
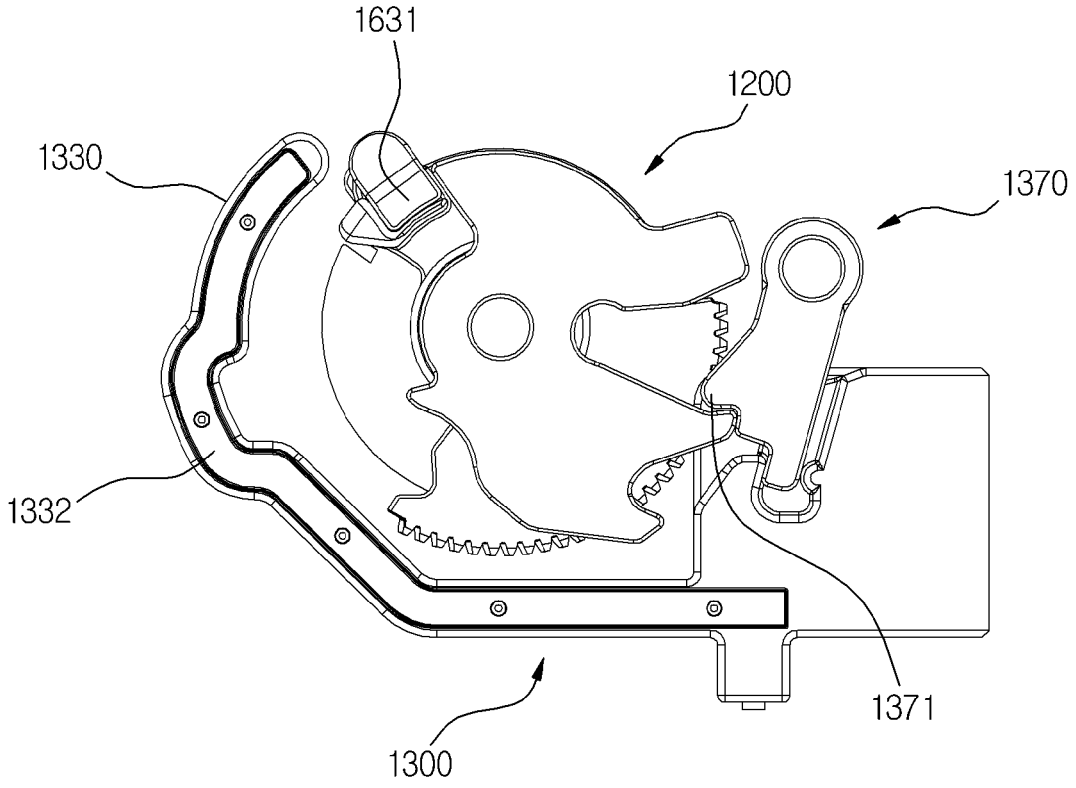
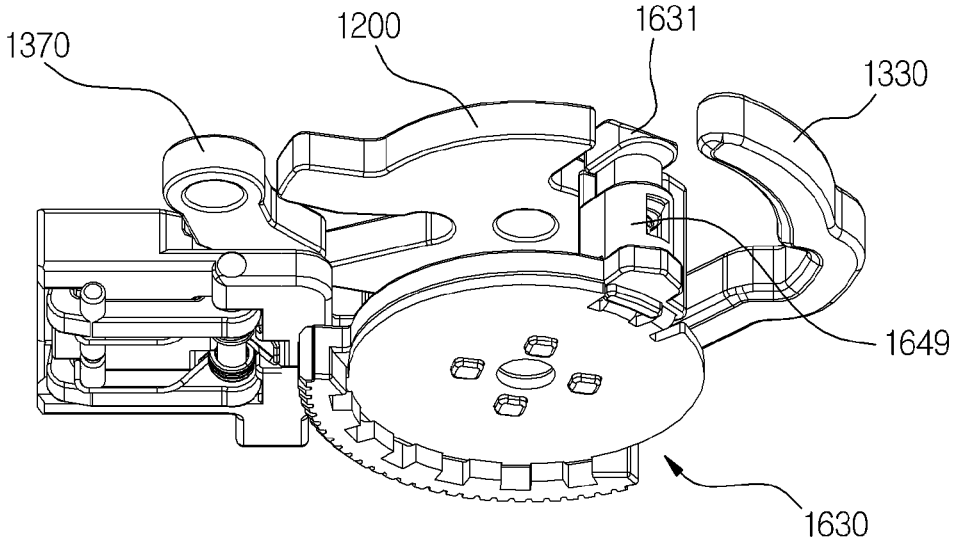

[Fig. 43]
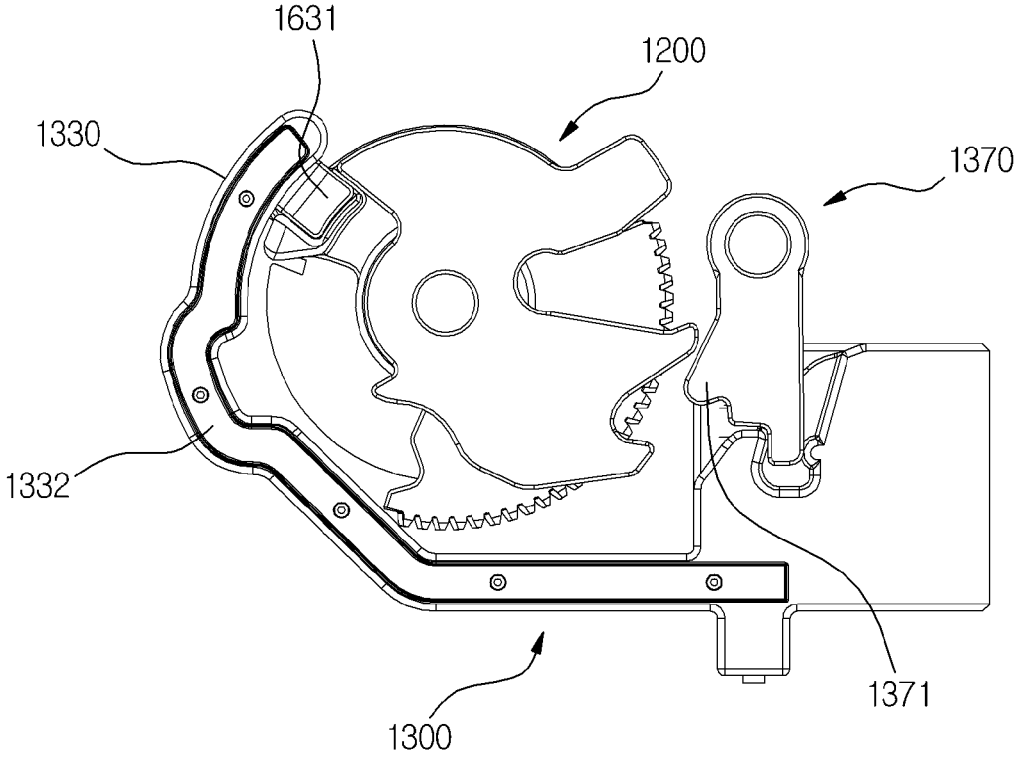
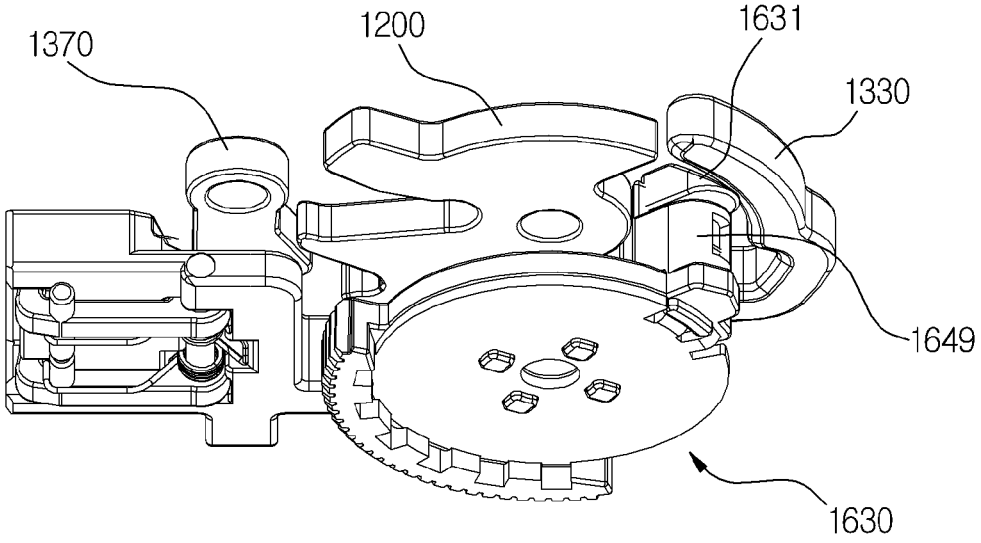

[Fig. 44]
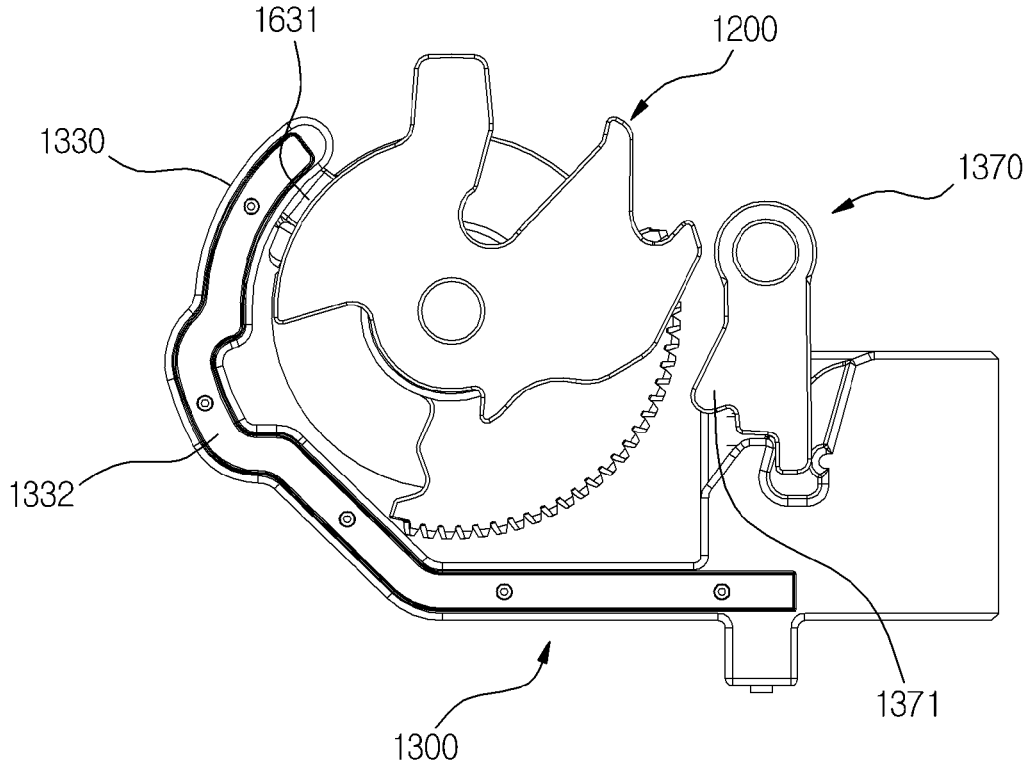
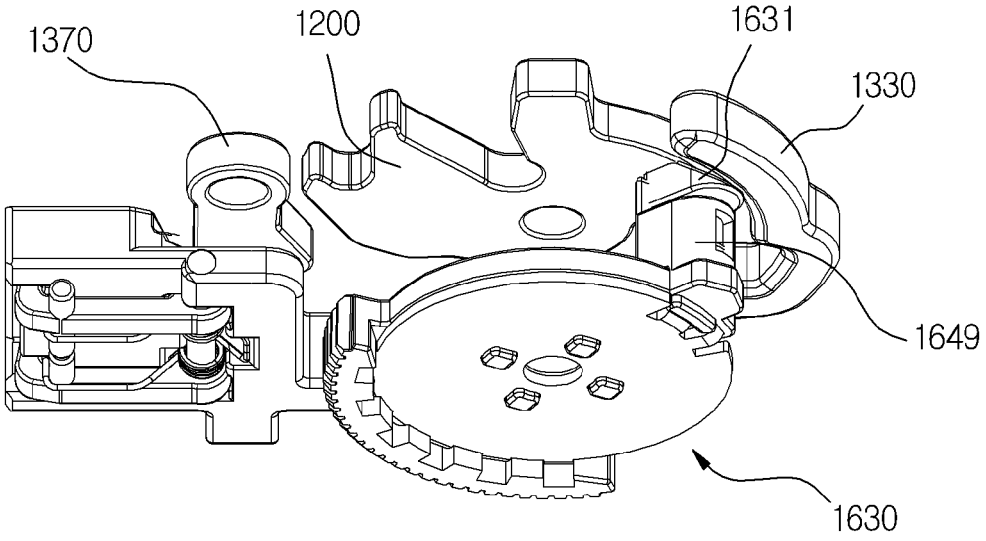

[Fig. 45]
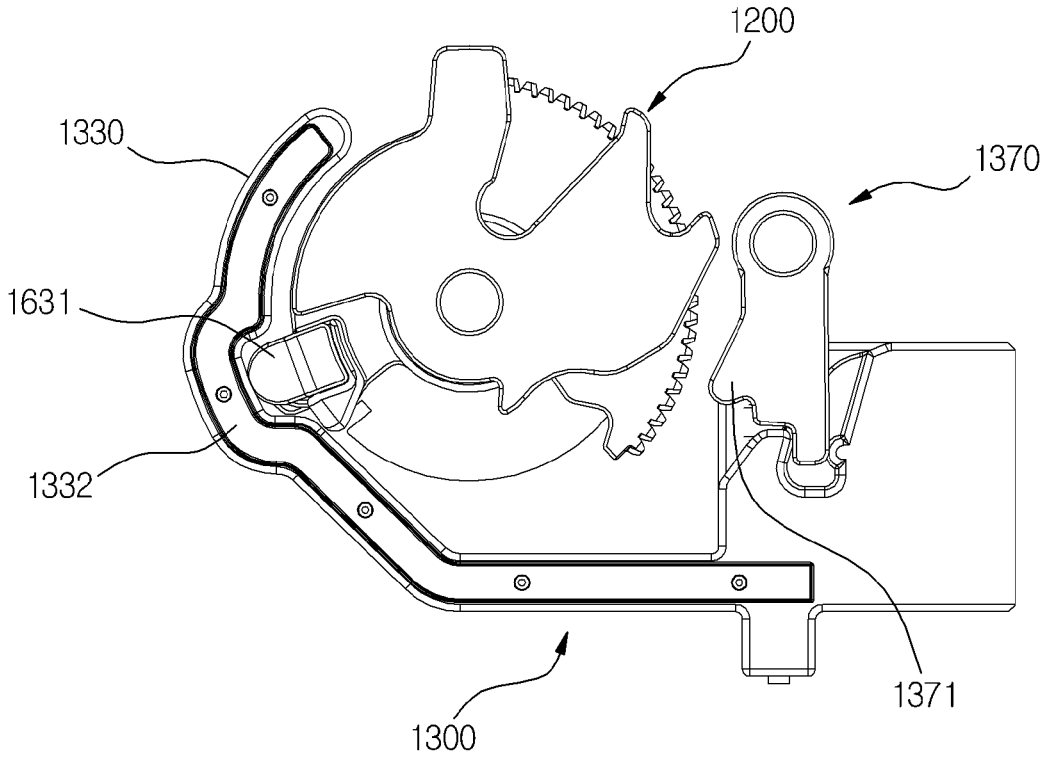
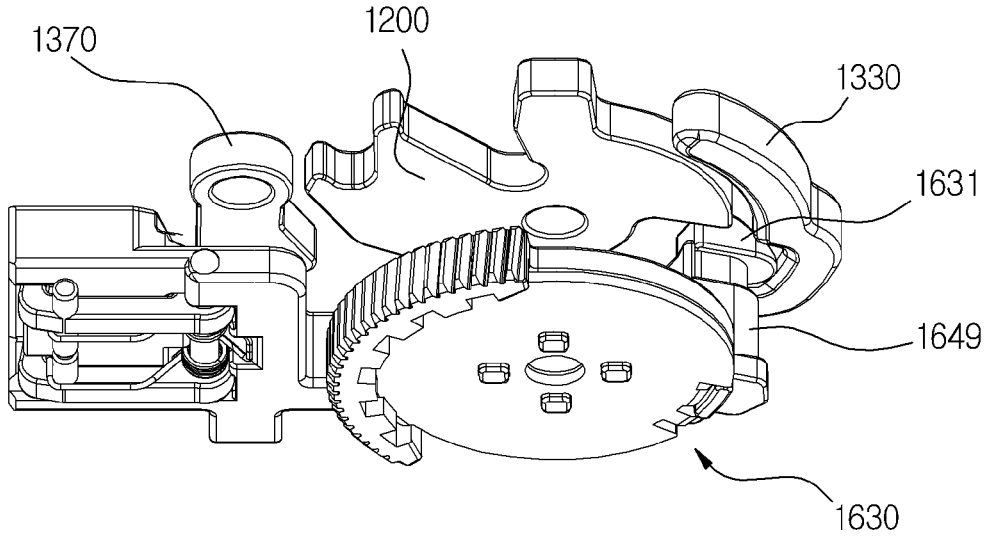

[Fig. 46]
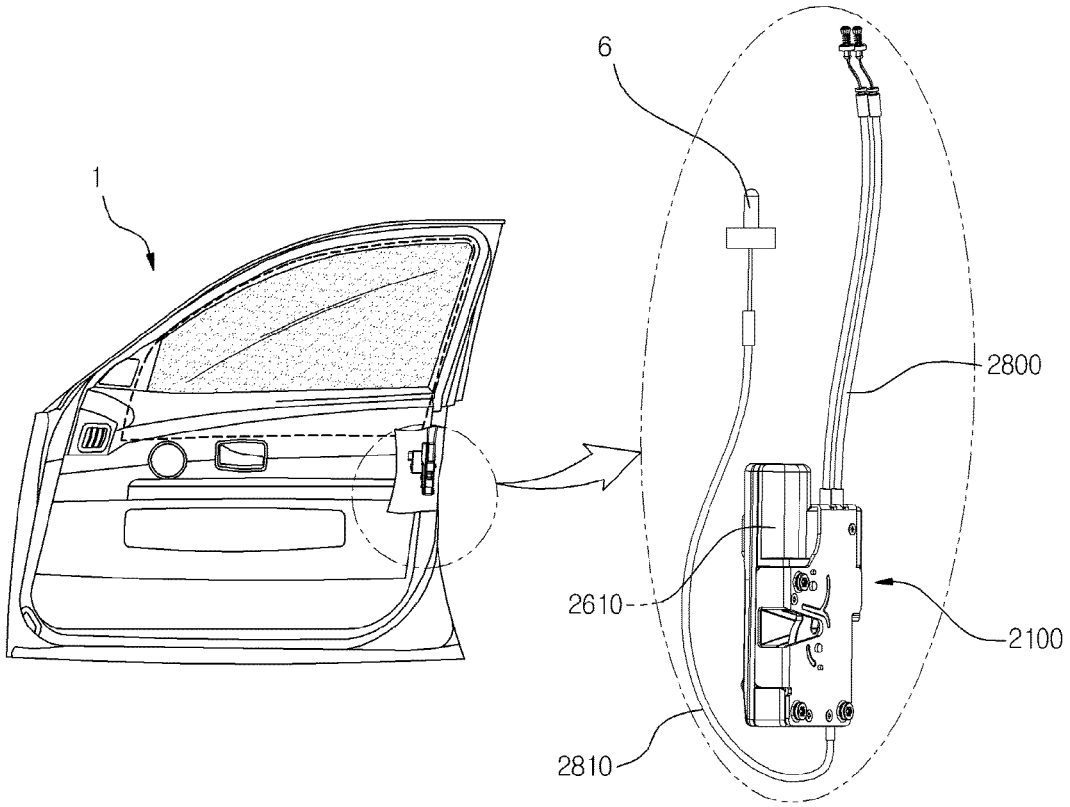
[Fig. 47]
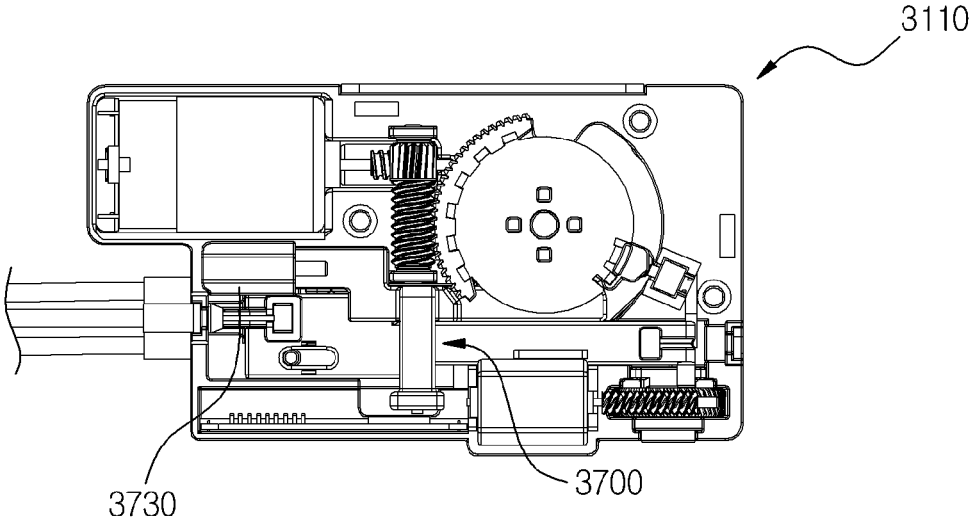

[Fig. 48]
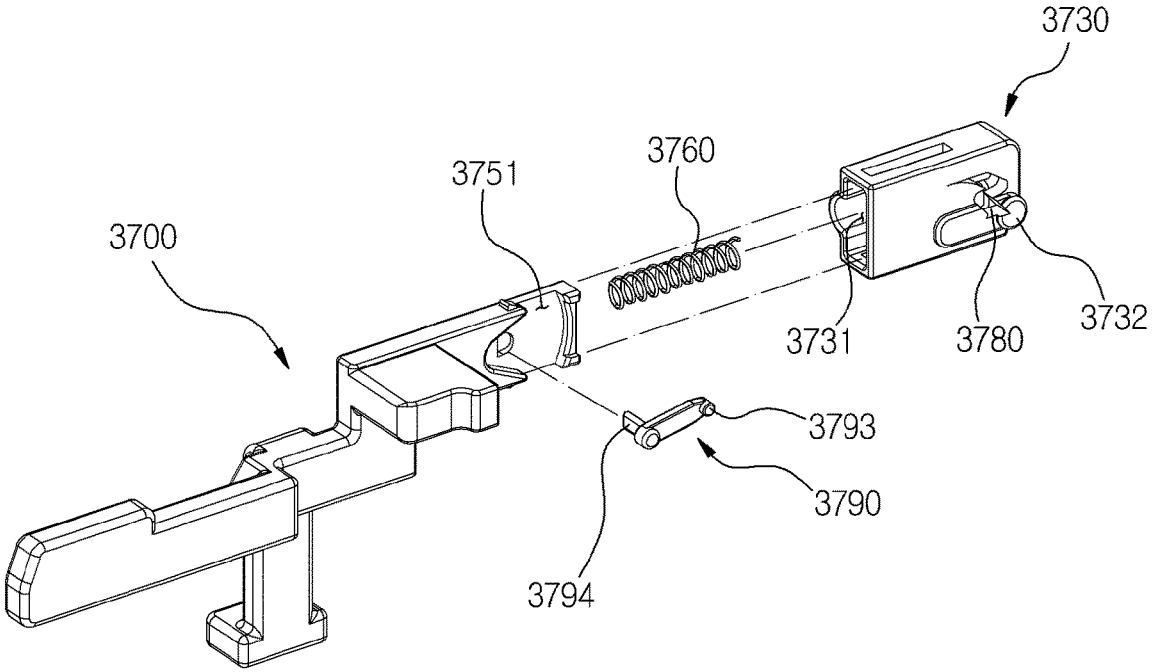
[Fig. 49]
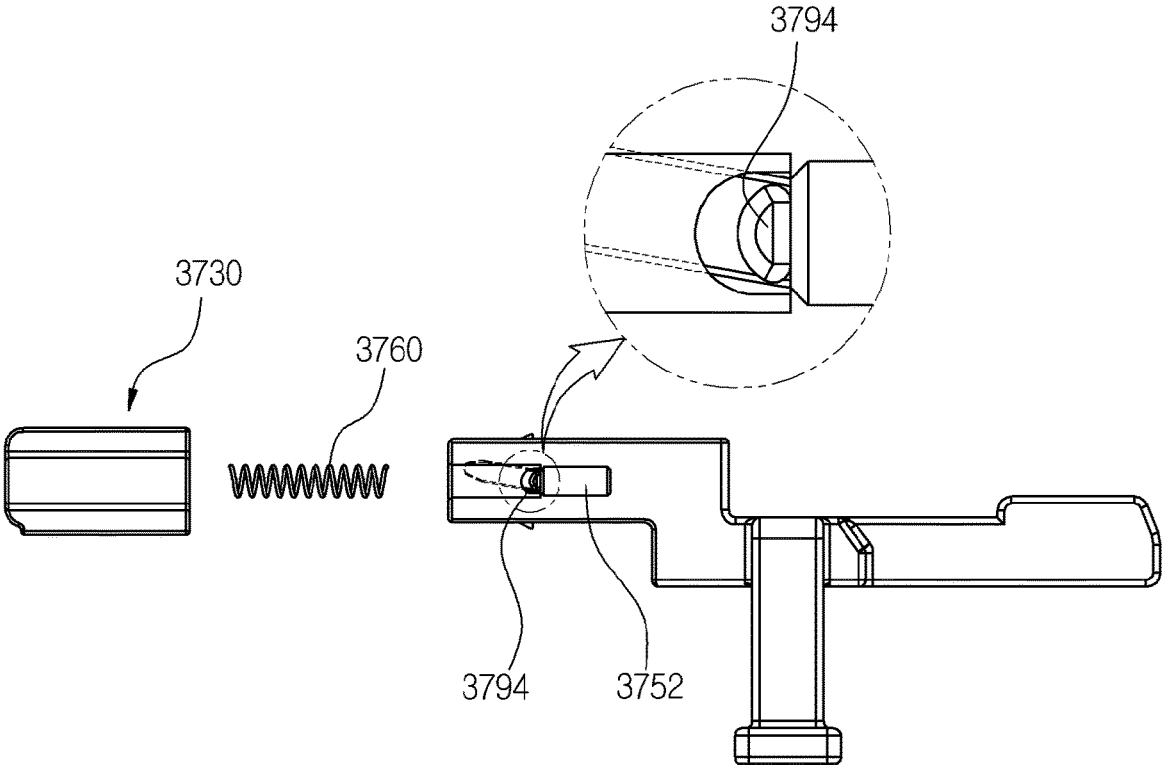

[Fig. 50]
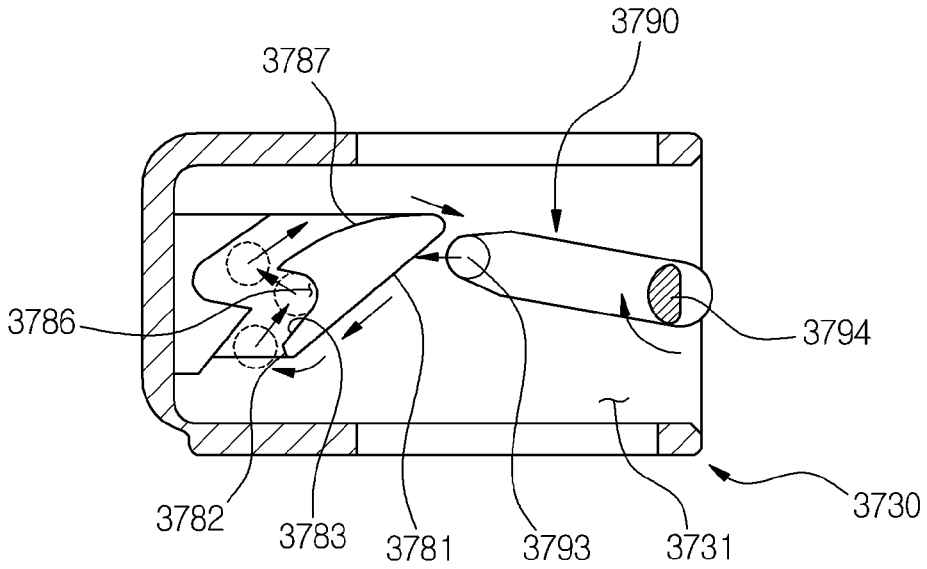
[Fig. 51]
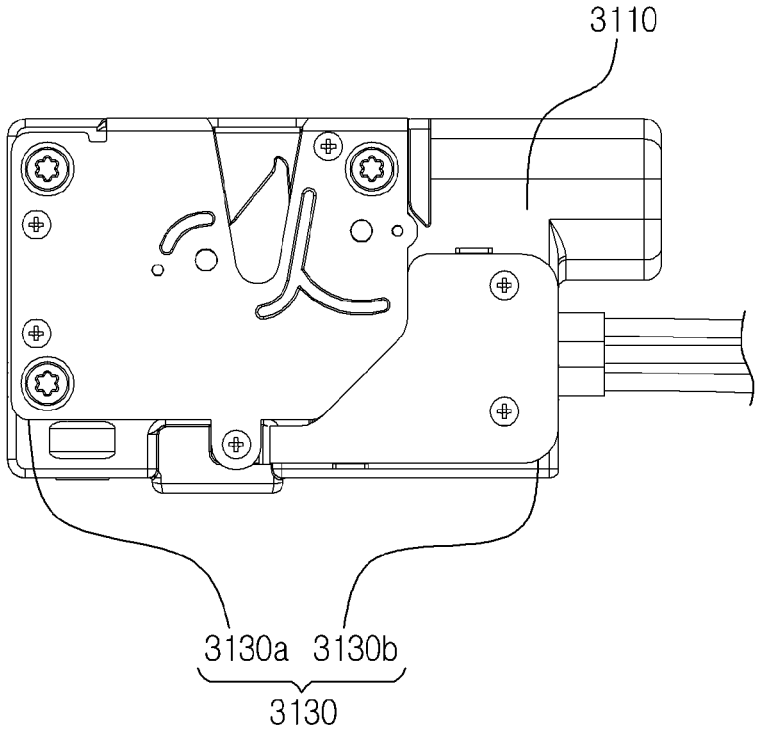

[Fig. 52]
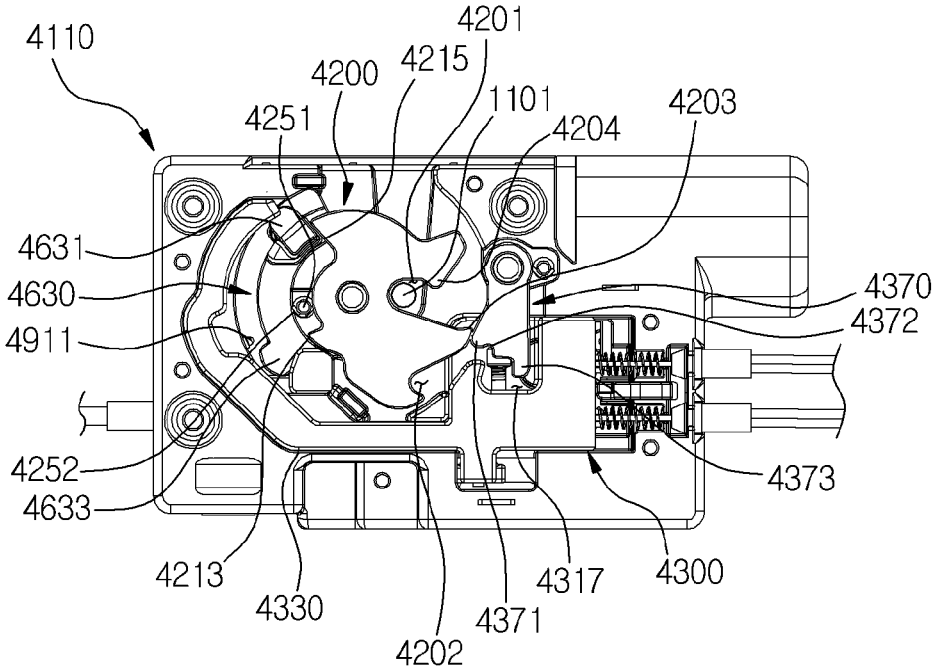
[Fig. 53]
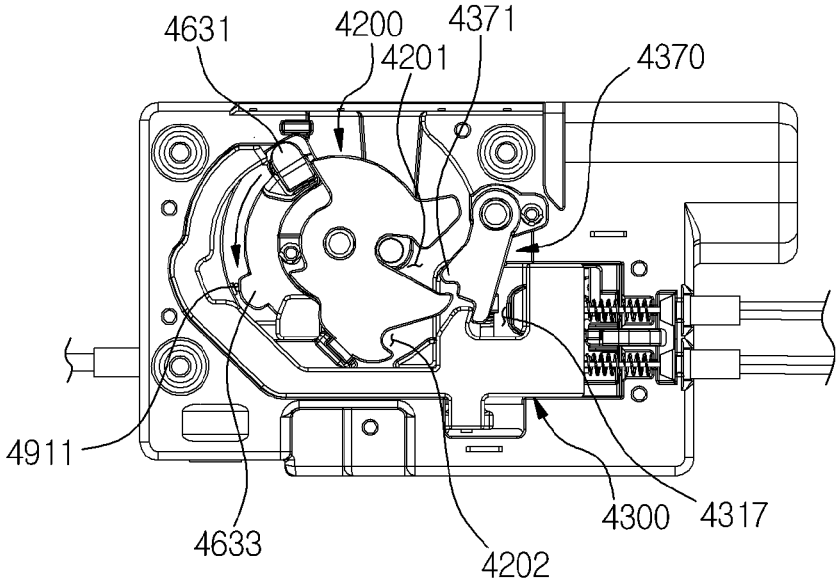

[Fig. 54]
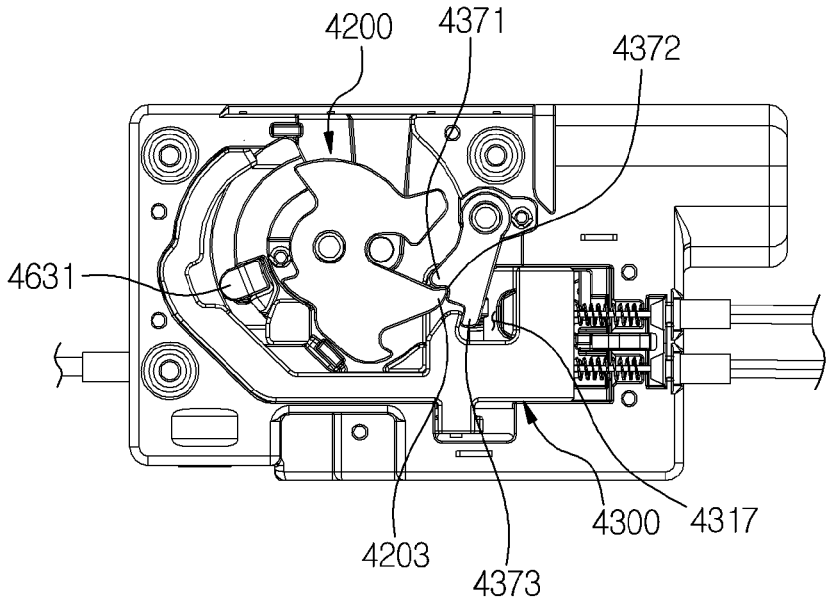

[Fig. 55]
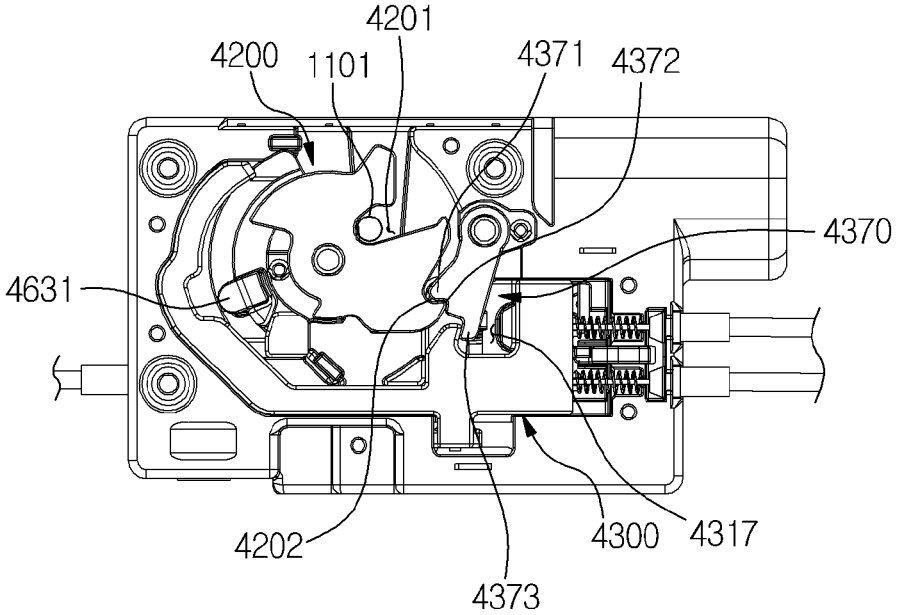
(a)
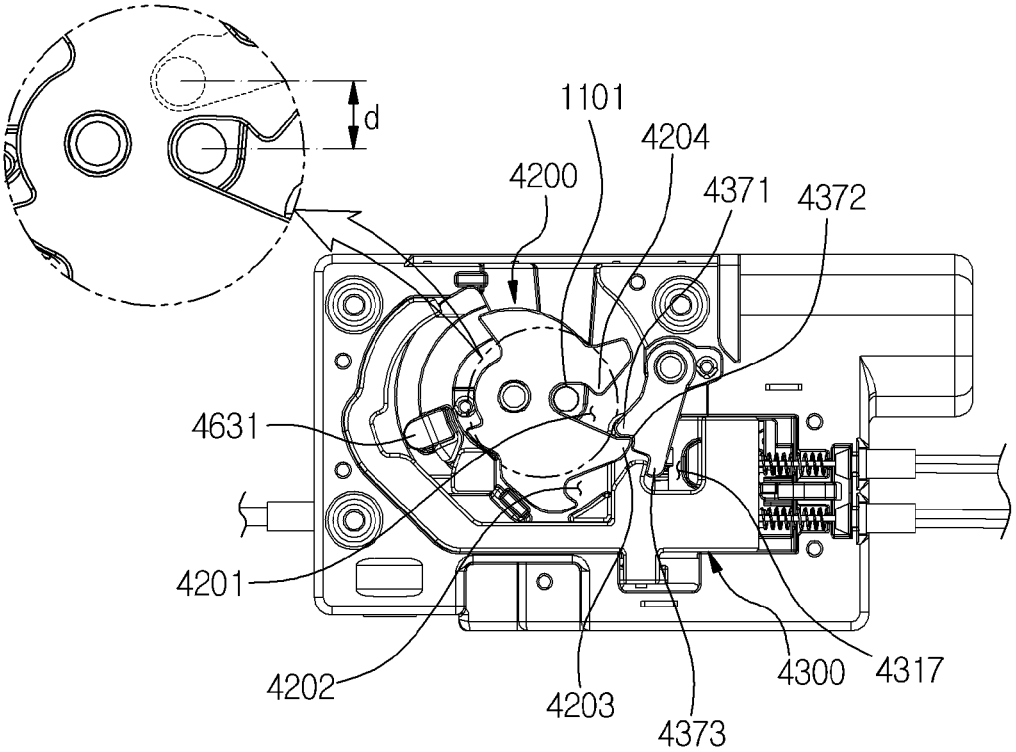
(b)

[Fig. 56]
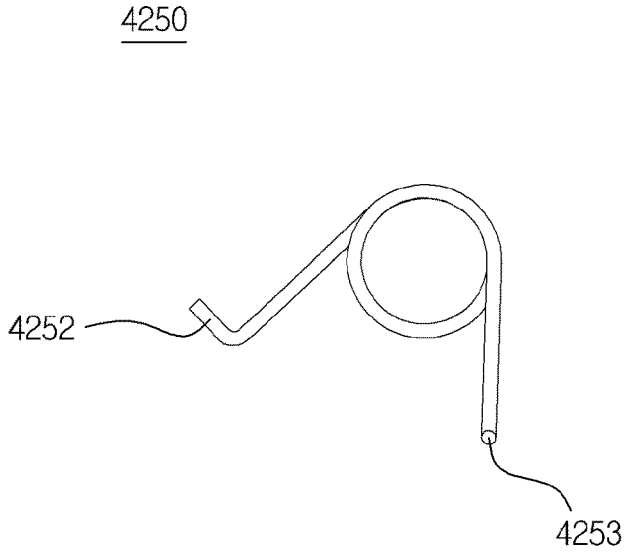
[Fig. 57]
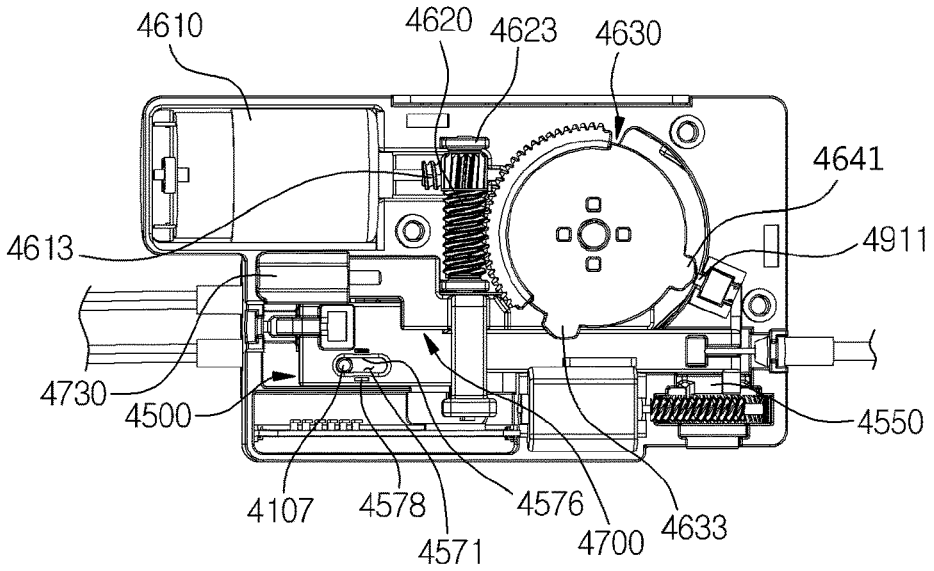
[Fig. 58]
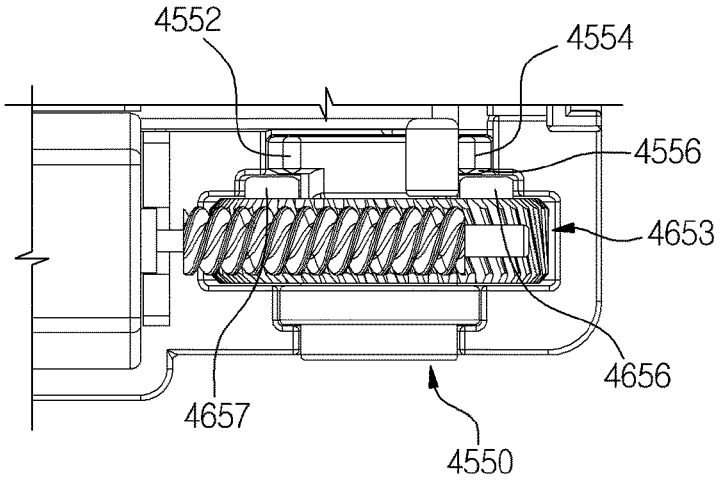

[Fig. 59]
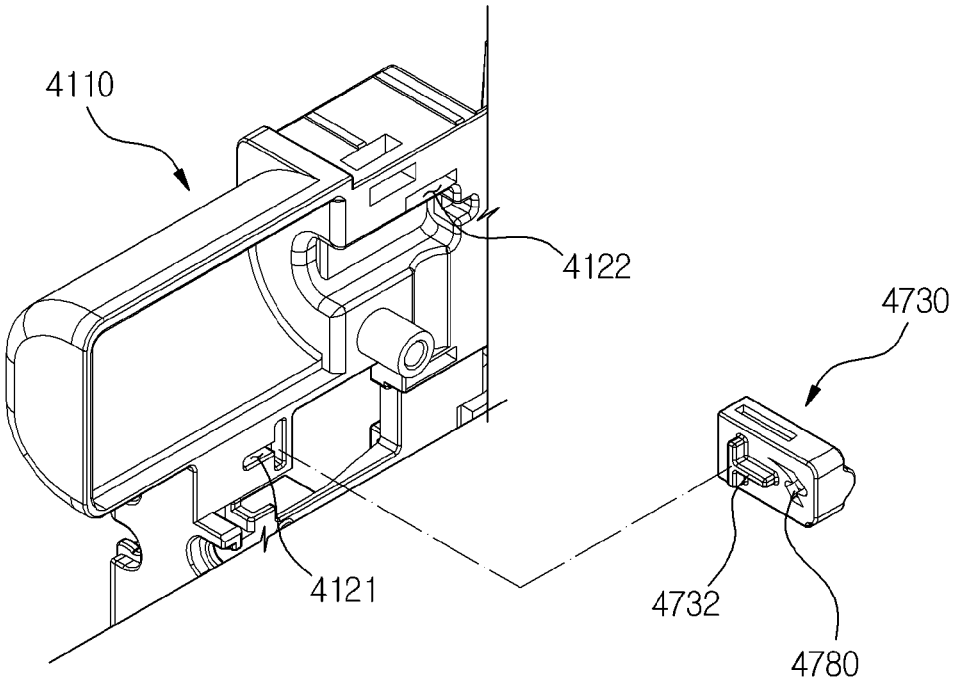
[Fig. 60]
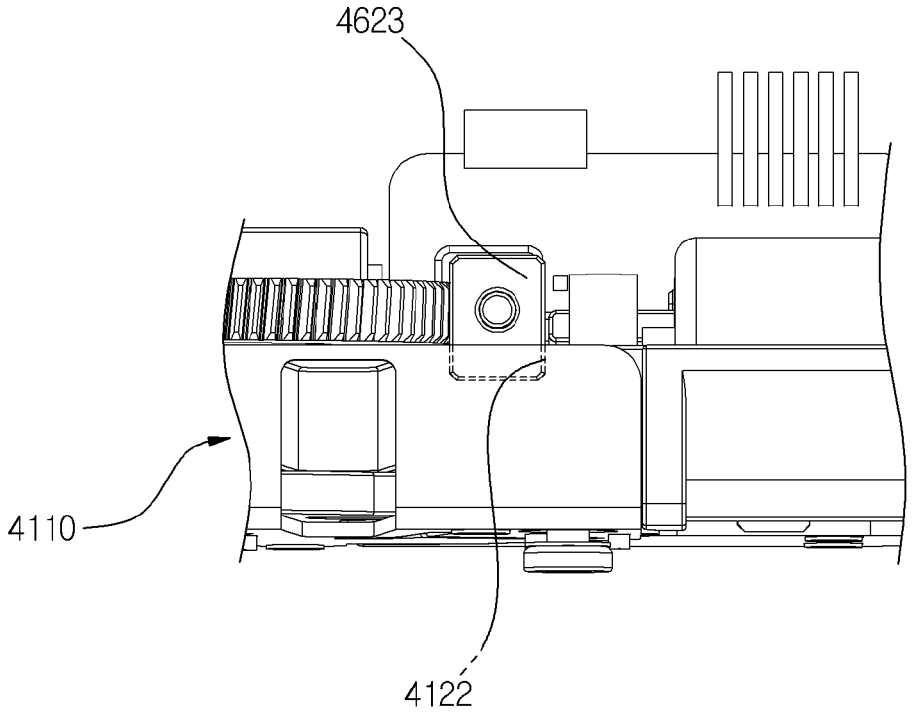

[Fig. 61]
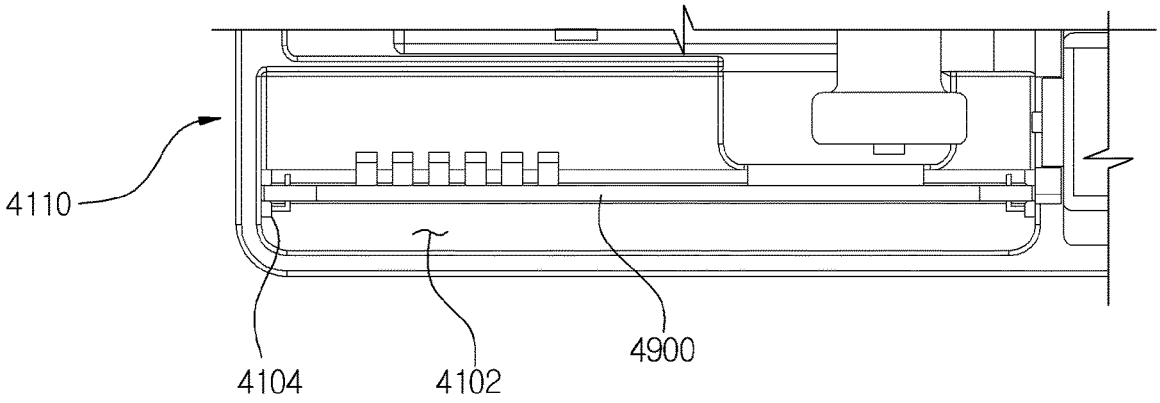

VEHICLE DOOR LATCH SYSTEM

This application is the national phase entry of international patent application no. PCT/KR2016/014408 filed Dec. 9, 2016 and claims the benefit of Korean patent application No. 10-2015-0187329, filed Dec. 28, 2015, the disclosures of which are incorporated herein by reference in their entirety.

TECHNICAL FIELD

The present invention relates to a vehicle door latch system, more particularly, relates to a vehicle door latch system whose locking driving unit comprises a motor, a first gear connected to the motor, and a second gear interlocked with the first gear, wherein a connect through hole wherein a key connect is penetrating through, and two of a rotating stopping portion wherein a locking stopping portion is caught by are formed spaced apart along the circumferential direction so that a locking member is moved as the motor operates, and two of a key stopping portion are formed spaced apart along the circumferential direction so that the locking member is moved as the key connect is rotated.

BACKGROUND ART

Generally, a vehicle door latch system is used for opening and closing the automobile's door or locking or lock-releasing thereof, as suggested in Korea Patent No. 0535053.

However, such vehicle door latch system of the prior art has a problem wherein an unnecessary force is applied to the various components such as a latch connected to the door lever and the like when the door lever is pulled while the door is being locked, therefore, damages in the various components of the vehicle door latch system may easily occur, consequently, there is a problem of an excessive maintenance cost.

Moreover, the structure of such vehicle door latch system of the prior art is complicated.

Since the manual lock-releasing structure and the automatic lock-releasing structure are separately provided, there is a problem in that the volume of the device becomes large. Moreover, when the components are frozen in winter or the motor fails, there is a problem in that locking or lock-releasing of the door is not easy.

DISCLOSURE OF INVENTION

Technical Problem

An objective of the present invention devised for solving the above mentioned problems, is to provide a vehicle door latch system wherein the device becomes compact and at the same time locking is easily released even when the device fails.

Solution to Problem

To achieve above described objective, the vehicle door latch system of the present invention is characterized in that and comprises: a housing; a latch rotatably installed in the housing; a door closing member installed in the housing and locking the latch; a locking member movably installed in the housing and locking the door; a key connect, rotatably installed in the housing, wherein a key insertion slot for inserting a key is formed in the one side thereof; and a locking driving unit moving the locking member; wherein a locking stopping portion is formed in the locking member; and wherein the locking driving unit comprises: a motor; a first gear connected to the motor; and a second gear interlocked with the first gear; and wherein a connect through hole wherein the key connect is penetrating through is formed in the second gear, and in the second gear, two of a rotating stopping portion wherein the locking stopping portion is caught by are formed spaced apart along the circumferential direction so that the locking member is moved as the motor operates, and wherein in the key connect, two of a key stopping portion wherein the locking stopping portion is caught by are formed spaced apart along the circumferential direction so that the locking member is moved as the key connect is rotated.

The locking member may be a locking plate.

The rotating stopping portion may be protrudedly formed in the upper surface of the second gear.

The key stopping portion may be formed by cutting off a part of the key connect.

The key stopping portion may be disposed in the upper side of the rotating stopping portion.

The second gear may be provided as a worm gear.

The door closing member comprises a sliding member slidingly installed in the housing, and the sliding member slidingly installed in the housing comprises a main locking member locking the latch, and a sub-locking member slidingly installed in the housing and disposed in one side of the main locking member; a connecting means further included for sliding both of the main locking member and the sub-locking member, or sliding only the sub-locking member; wherein the locking member is slidingly installed in the housing; and as the locking member is slided, the connecting means is moved so that the main locking member and the sub-locking member can be slided together, or only the sub-locking member can be slided, and wherein the connecting means is rotatably installed in either one of the main locking member and the sub-locking member and comprises: a stopping lever part formed with a stopping protrusion; and a stopping threshold formed in the other one of the main locking member and the sub-locking member wherein the stopping protrusion is being caught; and wherein a protrusion guide portion is formed in the locking member, and a protrusion is formed in the stopping lever portion, and thus the stopping lever part can be rotated as the protrusion guide portion guides the protrusion.

Advantageous Effects of Invention

As described above, according to a vehicle door latch system of the present invention, there are advantageous effects as follows.

A locking driving unit comprises: a motor; a first gear connected to the motor; and a second gear interlocked to the first gear, wherein in the second gear, a connecting through hole where a key connect is penetrating through is formed, and in the second gear, since two of a rotating stopping portion where a locking stopping portion is being caught are formed each spaced apart along the circumferential direction, and the locking member is slided as the motor is operated, and in the key connect, since two of a key stopping portion where the locking stopping portion is being caught are formed each spaced apart along the circumferential direction, and the locking member is slided as the key connect is rotated, so that the device can be miniaturized, and at the same time, when the key connect or the motor is out of order, or when the vehicle components are frozen in winter, since they can be operated separately, therefore the locking member can be moved smoothly.

The rotating stopping portion is protrudedly formed in the upper surface of the second gear so that the rotating stopping portion can be formed in a simple structure.

The key stopping portion is formed by cutting off a part of the key connect so that the durability of the key stopping portion is enhanced, and at the same time it can be formed in a simple structure.

The key stopping portion is disposed in the upper side of the rotating stopping portion and the second gear is provided as a worm gear so that the device can become more compact.

BRIEF DESCRIPTION OF DRAWINGS

FIG. 1 is a perspective view of a vehicle door latch system according to the first exemplary embodiment of the present invention.

FIG. 2 is an exploded perspective view of a vehicle door latch system according to the first exemplary embodiment of the present invention.

FIG. 3 is a front view illustrating the state wherein the second housing is removed from the vehicle door latch system according to the first exemplary embodiment of the present invention.

FIG. 4 is a front perspective view (shown above) and a rear perspective view (shown below) of the first housing of the vehicle door latch system according to the first exemplary embodiment of the present invention.

FIG. 5 is a front perspective view (shown above) and a rear perspective view (shown below) of the second housing of the vehicle door latch system according to the first exemplary embodiment of the present invention.

FIG. 6 is a front perspective view (shown above) and a rear perspective view (shown below) of the third housing of the vehicle door latch system according to the first exemplary embodiment of the present invention.

FIG. 7 is a perspective view of the latch of the vehicle door latch system according to the first exemplary embodiment of the present invention.

FIG. 8 is a front perspective view (shown above) and a rear perspective view (shown below) of the main locking member of the vehicle door latch system according to the first exemplary embodiment of the present invention.

FIG. 9 is a perspective view of the stopping lever unit of the vehicle door latch system according to the first exemplary embodiment of the present invention.

FIG. 10 is a front view of the vehicle door latch system according to the first exemplary embodiment of the present invention (main locking member is not shown).

FIG. 11 is a front perspective view (shown above) and a rear perspective view (shown below) of the sub-locking member of the vehicle door latch system according to the first exemplary embodiment of the present invention.

FIG. 12 is a front view illustrating the state wherein the third housing is removed from the vehicle door latch system according to the first exemplary embodiment of the present invention.

FIG. 13 is a front perspective view (shown above) and a rear perspective view (shown below) of the locking plate, the locking driving unit, and the key connect of the vehicle door latch system according to the first exemplary embodiment of the present invention.

FIG. 14 is the cross-sectional views of the key connect and the second gear of the vehicle door latch system according to the first exemplary embodiment of the present invention.

FIG. 15 is an exploded perspective view of the direction switching unit of the vehicle door latch system according to the first exemplary embodiment of the present invention.

FIG. 16 is a view illustrating the vehicle door latch system according to the first exemplary embodiment of the present invention installed in a vehicle door.

FIG. 17 is a rear view illustrating the state wherein the third housing is removed from the vehicle door latch system according to the first exemplary embodiment of the present invention (metal portion of the main gear is not shown).

FIG. 18 is a front perspective view (shown above) and a rear perspective view (shown below) of the driving unit of the vehicle door latch system according to the first exemplary embodiment of the present invention.

FIG. 19 is a rear perspective view of the main gear of the vehicle door latch system according to the first exemplary embodiment of the present invention.

FIG. 20 is an exploded perspective view of the main gear of the vehicle door latch system according to the first exemplary embodiment of the present invention.

FIG. 21 is a front perspective view (shown above) and a rear perspective view (shown below) of the child locking member of the vehicle door latch system according to the first exemplary embodiment of the present invention.

FIG. 22 is a front view illustrating the first step of the door closing operation of the vehicle door latch system according to the first exemplary embodiment of the present invention (housing is not shown).

FIG. 23 is a front view illustrating the second step of the door closing operation of the vehicle door latch system according to the first exemplary embodiment of the present invention (housing is not shown).

FIG. 24 is a front view illustrating the third step of the door closing operation of the vehicle door latch system according to the first exemplary embodiment of the present invention (housing is not shown).

FIG. 25 is a front view illustrating the fourth step of the door closing operation of the vehicle door latch system according to the first exemplary embodiment of the present invention (housing is not shown).

FIG. 26 is a partial plan view (shown above) and a partial cross-sectional view (shown below) when the door lock is released by the vehicle door latch system according to the first exemplary embodiment of the present invention.

FIG. 27 is a partial plan view (shown above) illustrating the door locking operation through the driving unit, and a partial plan view (shown middle) and a partial cross-sectional view (shown below) illustrating the door locking operation through the key connect of the vehicle door latch system according to the first exemplary embodiment of the present invention.

FIG. 28 is a partial perspective view illustrating the state wherein the stopping lever unit is moved to the rear direction by the lever guide portion during the door locking operation of the vehicle door latch system according to the first exemplary embodiment of the present invention.

FIG. 29 is a partial plan view (shown above) and a partial cross-sectional view (shown below) during the door locking of the vehicle door latch system according to the first exemplary embodiment of the present invention.

FIG. 30 is a partial plan view (shown above) illustrating the door lock-releasing operation, and a partial plan view (shown middle) and a partial cross-sectional view (shown below) illustrating the door lock-releasing operation through the key connect of the vehicle door latch system according to the first exemplary embodiment of the present invention.

FIG. 31 is a partial perspective view showing the state wherein the stopping lever unit is caught by the sub-locking member during the door lock-releasing operation of the vehicle door latch system according to the first exemplary embodiment of the present invention (main locking member is not shown).

FIG. 32 is a partial cross-sectional view illustrating the first step of the door lock-releasing operation using the door in lever of the vehicle door latch system according to the first exemplary embodiment of the present invention.

FIG. 33 is a partial cross-sectional view illustrating the second step of the door lock-releasing operation using the door in lever of the vehicle door latch system according to the first exemplary embodiment of the present invention.

FIG. 34 is a partial cross-sectional view illustrating the third step of the door lock-releasing operation using the door in lever of the vehicle door latch system according to the first exemplary embodiment of the present invention.

FIG. 35 is a rear view illustrating the released state of child locking of the vehicle door latch system according to the first exemplary embodiment of the present invention.

FIG. 36 is a rear view illustrating the process of child locking of the vehicle door latch system according to the first exemplary embodiment of the present invention.

FIG. 37 is a plan view illustrating the state of child locking of the vehicle door latch system according to the first exemplary embodiment of the present invention.

FIG. 38 is a rear view illustrating the state of child locking of the vehicle door latch system according to the first exemplary embodiment of the present invention.

FIG. 39 is a rear view illustrating the process of releasing the child locking of the vehicle door latch system according to the first exemplary embodiment of the present invention.

FIG. 40 is a rear view illustrating the released state of child locking of the vehicle door latch system according to the first exemplary embodiment of the present invention.

FIG. 41 is a plan view illustrating the released state of child locking of the vehicle door latch system according to the first exemplary embodiment of the present invention.

FIG. 42 is a partial front view (shown above) and a partial rear perspective view (shown below) illustrating the first step of door opening operation when the motor fails in the vehicle door latch system according to the first exemplary embodiment of the present invention.

FIG. 43 is a partial front view (shown above) and a partial rear perspective view (shown below) illustrating the second step of door opening operation when the motor fails in the vehicle door latch system according to the first exemplary embodiment of the present invention.

FIG. 44 is a partial front view (shown above) and a partial rear perspective view (shown below) illustrating the third step of door opening operation when the motor fails in the vehicle door latch system according to the first exemplary embodiment of the present invention.

FIG. 45 is a partial front view (shown above) and a partial rear perspective view (shown below) illustrating the state when the door lever is being pulled at normal times in the vehicle door latch system according to the first exemplary embodiment of the present invention.

FIG. 46 is a view illustrating the vehicle door latch system according to the second exemplary embodiment of the present invention installed in a vehicle door.

FIG. 47 is a rear view illustrating the state wherein the third housing is removed from the vehicle door latch system according to the third exemplary embodiment of the present invention.

FIG. 48 is an exploded perspective view of the child locking member of the vehicle door latch system according to the third exemplary embodiment of the present invention.

FIG. 49 is an exploded rear view of the child locking member of the vehicle door latch system according to the third exemplary embodiment of the present invention.

FIG. 50 is a partial cross-sectional rear view illustrating the movement path of the locking guide member of the vehicle door latch system according to the third exemplary embodiment of the present invention.

FIG. 51 is a front view of the vehicle door latch system according to the third exemplary embodiment of the present invention.

FIGS. 52 to 54 are the front views illustrating the process of door closing using the motor of the vehicle door latch system according to the fourth exemplary embodiment of the present invention (second housing is removed).

FIG. 55 is the front view illustrating the up-down travel distance of the striker during the process of door closing using the motor of the vehicle door latch system according to the fourth exemplary embodiment of the present invention (second housing is removed).

FIG. 56 is the front view of the first return spring of the vehicle door latch system according to the fourth exemplary embodiment of the present invention.

FIG. 57 is a rear view of the vehicle door latch system according to the fourth exemplary embodiment of the present invention (third housing is removed).

FIG. 58 is an enlarged rear view of the installation region of the key connector of the vehicle door latch system according to the fourth exemplary embodiment of the present invention.

FIG. 59 is a perspective view illustrating the state wherein the cam cover is separated from the first housing of the vehicle door latch system according to the fourth exemplary embodiment of the present invention.

FIG. 60 is a plan view of the installation region of the reduction gear shaft supporting plate of the vehicle door latch system according to the fourth exemplary embodiment of the present invention (third housing is removed).

FIG. 61 is a rear view of the installation region of the PCB of the vehicle door latch system according to the fourth exemplary embodiment of the present invention (third housing is removed).

MODE FOR THE INVENTION

Hereinafter, a preferred exemplary embodiment of the present invention will be described in detail with reference to the accompanying drawings as follows.

For reference, for the components of the present invention which will be described hereinafter and identical to those of the prior art, separate detailed descriptions will be omitted, but instead will be referred the prior art described above.

Embodiment 1

As illustrated in FIGS. 1 to 45, a vehicle door latch system according to the first exemplary embodiment is characterized in that and comprises: a housing 1100; a latch 1200 rotatably installed in the housing 1100; a door closing member installed in the housing and locking the latch.

The door closing member comprises a sliding member slidingly installed in the housing 1100.

The sliding member comprises: a main locking member 1300 locking the latch 1200; and a sub-locking member 1400 disposed in one side of the main locking member 1300;

As illustrated in FIG. 1, in the housing 1100, the front means the direction towards the second housing 1130, and the rear side means direction towards the third housing 1150. In addition, the left side and the right side described hereinafter mean the left side and the right side viewing from the front. The left side and the right side, used when describing the members formed in the rear side surface, also mean the left side and the right side viewing from the front of the members.

As illustrated in FIG. 2, the housing 1100 includes: a first housing 1110, a second housing 1130 disposed in front of the first housing 1110, and a third housing 1150 disposed in the rear side of the first housing 1110.

As illustrated in FIGS. 1 and 4, a striker insertion slot 1105 is formed in the upper front of the housing 1100 for inserting a striker 1101 connected to the vehicle body.

Therefore, the striker insertion slot 1105 is formed in the first housing 1110 and the second housing 1130.

As illustrated in FIG. 4, the first housing 1110 is formed in the shape of a block, wherein a latch receiving slot 1111 for receiving the latch 1200, which will be described hereinafter, and a locking member receiving slot 1112 for receiving the main locking member 1300 and the sub-locking member 1400, which will be described later, are formed in the front. The locking member receiving slot 1112 plays the role of a guide for a smooth sliding of the main locking member 1300 and the sub-locking member 1400 in the left-to-right direction.

The first housing 1110 is made of plastic material and can be formed by injection molding. The second housing 1130 may be made of a high strength material such as a steel plate. Thus, while the strength of the vehicle door latch system is maintained strong, manufacturing thereof can be facilitated.

The front and the upper portion of the latch receiving slot 1111 are formed to be open so that assembling of the components becomes easy. The front of the latch receiving slot 1111 is covered by the second housing 1130 when assembling.

The upper portion of the latch receiving slot 1111 is communicating with the striker insertion slot 1105.

Further, a spring insertion slot 1113 is formed in the front side of the first housing 1110.

The spring insertion slot 1113 is disposed in the rear side of the latch receiving slot 1111 and communicating with the latch receiving slot 1111. The spring insertion slot 1113 is formed to be the shape of an arc, and a first return spring 1250, which will be described later, is inserted in the spring insertion slot 1113, and thus the other end of the first return spring 1250 can be rotated with the latch 1200.

A sixth sensor insertion hole 1129 is formed in the first housing 1110 penetrating through the front-to-rear direction wherein a sixth sensor 1910, which will be described later, is inserted so as to communicate with the latch receiving slot 1111. The sixth sensor insertion hole 1129 is disposed in the lower portion of the striker insertion slot 1105.

A stopping unit guiding slot 1115 is formed in the left side of the first housing 1110 penetrating through the front-to-rear direction so as to communicate with the spring insertion slot 1113 and the latch receiving slot 1111.

The stopping unit guiding slot 1115 is formed in the shape of an arc.

The locking member receiving slot 1112 is formed along the left-to-right direction so as to communicate with the latch receiving slot 1111.

The locking member receiving slot 1112 is formed deeper towards the rear side direction than the latch receiving slot 1111.

The locking member reception slot 1112 is formed along the left-to-right direction so that the main locking member 1300 and the sub-locking member 1400 can be slided along the left and right direction.

In the first housing 1110, the rear side of the locking member receiving slot 1112 for receiving the sub-locking member 1400 is formed to be open so that a locking protrusion guide portion 1507, which will be described later, is inserted therein.

A rod guide slot 1116 is formed along the left-to-right direction in front of the first housing 1110 so as to communicate with the locking member receiving slot 1112.

The rod guide slot 1116 is disposed in the lower portion of the latch receiving slot 1111.

A first sensing member insertion slot 1128 is formed along the left-to-right direction in front of the first housing 1110 so as to communicate with the locking member receiving slot 1112 and the rod guide slot 1116.

The first sensing member insertion slot 1128 is disposed in the lower left portion of the locking member receiving slot 1112.

The first sensing member insertion slot 1128 formed such that the lower and the rear sides thereof are open.

A first spring receiving slot 1117 and a second spring receiving slot 1119 are formed in the front right side of the first housing 1110. The first spring receiving slot 1117 and the second spring receiving slot 1119 are disposed in the right side of the locking member receiving slot 1112, and communicate with the locking member receiving slot 1112. The withdrawing holes, through which the wires connected with the door in lever and the door out lever are being withdrawn, are communicating with the right side of the first spring receiving slot 1117 and the second spring receiving slot 1119.

A manual locking member insertion hole 1118 wherein the manual locking member 1560 is inserted is penetratingly formed along front-to-rear direction between the first spring receiving slot 1117 and the second spring receiving slot 1119. The manual locking member insertion hole 1118 is communicating with the locking member receiving slot 1112.

A bumper member insertion slots 1123, wherein the bumper members 1360 are inserted respectively, are formed in the lower and the upper portions of the first housing 1110 so as to communicate with the latch receiving slot 1111.

The height of the bumper member insertion slot 1123 disposed in the lower portion is formed to be lower than that of the bumper member 1360 and communicating with the latch receiving slot 1111.

The upper side and the front side of the bumper member insertion slot 1123 disposed in the upper portion are open, and the right side portion is communicating with the latch receiving slot 1111.

The diameter of the rear side of the bumper member insertion slot 1123 disposed in the lower portion is formed to be larger than that of the front side thereof. The bumper member 1360 disposed in the upper side is formed to have a shape corresponding to the shape of the bumper member insertion slot 1123 disposed in the upper portion. Thus, when the bumper member 1360 is inserted from the above into the bumper member insertion slot 1123 disposed in the upper side, it will not be separated along the front-to-rear direction after the insertion thereof. In addition, after the completion of the assembly, the top of the bumper member insertion slot 1123 disposed in the upper side is closed by the second housing 1130 which will be described later. In this way, the assembling becomes easy since the bumper member insertion slot 1123 disposed in the upper portion is formed.

The bumper member 1360 disposed in the lower portion supports the latch 1200 so as to prevent the occurrence of any gap when the latch 1200 is in a locking state by a rotating member 1370 and the main locking member 1300; and the bumper member 1360 disposed in the upper portion supports the latch 1200 so that the latch 1200 is being rotated within a predetermined angle when the latch 1200 is rotating counterclockwise due to the elastic force of the first return spring 1250 after the locking with the main locking member 1300 is released, and thus they prevent gap, noise and vibration from occurring.

In the front surface of the first housing 1110, a plurality of supporting protrusions 1103 which supports the horizontal portion or the vertical portion of the lower portion of the second housing 1130 is formed in length. Due to these supporting protrusions 1103, the pre-assembly of the first housing 1110 and the second housing 1130 is facilitated. Therefore, the assembling process becomes easy.

A concave portion 1124 is formed in the upper side surface of the first housing 1110.

A manual locking member receiving slot 1125 is formed in the lower right side of the back side surface of the first housing 1110. The manual locking member receiving slot 1125 is communicating with the manual locking member insertion hole 1118.

A manual locking member shaft 1561, which will be described later, is inserted into the manual locking member receiving slot 1125.

A locking hook stopping portion 1126 for coupling with the third housing 1150 is formed in rear side of the upper surface and the side surface of the first housing 1110.

A first key connect mounting portion 1127 is formed in the lower portion of left rear surface of the first housing 1110 in a way that the upper, lower, and rear sides thereof are open.

In the lower left side of the back surface of the first housing, a main gear shaft 1114 being inserted into an insertion hole 1636 of the main gear 1630, which will be described later, is protrudedly formed towards the rear side direction.

In the lower side of the rear surface of the first housing 1110, a locking plate receiving slot, for receiving the locking plate 1500, which will be described later, is formed long in length along the left-to-right direction. The locking plate receiving slot is formed so as to communicate with the locking member receiving slot 1112. The locking member receiving slot 1112 is formed in a way that the rear side thereof is open.

The child locking member receiving slot is formed in the rear surface of the first housing 1110, and the child locking member receiving slot is formed so as to communicate with the locking member receiving slot 1112. The left side of the child locking member receiving slot is communicating with the stopping unit guiding slot 1115. In addition, the child locking member receiving slot is disposed in the upper side of the locking plate receiving slot. The child locking member receiving slot is formed in a way that the rear side thereof is open.

In the rear side surface of the first housing 1110, a reduction gear receiving slot, for receiving a reduction gear, which will be described later, is formed.

In the rear side surface of the first housing 1110, a first motor receiving slot, for receiving the front side of the motor 1610, is formed at the right side of the reduction gear receiving slot. The first motor receiving slot is formed so as to communicate with the reduction gear receiving slot.

In the right rear side surface of the first housing 1110, a first PCB insertion slot, wherein the front side of a PCB 1900 which will be described later is inserted, is formed in the lower portion of the locking plate receiving slot. A first PCB insertion slot is formed so as to communicate with the first sensing member insertion slot 1128.

A motor receiving slot is formed in the lower portion of the left rear surface of the first housing 1110. The motor receiving slot is disposed in the lower side of the locking plate receiving slot.

Meanwhile, a fifth sensor receiving slot 1106, wherein the fifth sensor 1911 is being received, is formed in the rear side surface of the first housing 1110. Due to the fifth sensor receiving slot 1106, damages in the fifth sensor 1911 are prevented during assembly.

The fifth sensor receiving slot 1106 is disposed in the outer side of the stopping unit guide slot 1115.

Further, in the first housing 1110, wires for connecting the PCB 1900 and the sensors (fifth sensor 1911 and sixth sensor 1910) and a driving unit (motor 1610) which will be described later, are insertingly installed. In this way, the lengths of the wires can be reduced.

The wires are installed in a way that the portions being connected to the driving unit and the PCB 1900 are formed protruded outside of the first housing 1110. Thus, the sensors, the driving unit, or the PCB 1900 can be connected to the wires only if the sensor and the driving unit are inserted into the corresponding receiving slot of each member formed in the first housing 1110. Thus, assembling becomes more simplified.

As illustrated in FIG. 5, the second housing 1130 comprises a vertical member 1131 having the shape of a vertical plate, and a horizontal member 1132 which is backwardly bended from the upper end of the vertical member 1131.

A shaft insertion hole wherein a latch rotating shaft 1230 provided in the form of rivet is inserted is penetratingly formed in the vertical member 1131 along the front-to-rear direction.

In the vertical member 1131, a first protruded portion 1135 and a second protruded portion 1136, being recessed (from the front side) towards the rear side direction, are formed in the peripheral area of the shaft insertion hole. The first protruded portion 1135 and the second protruded portion 1136 are more backwardly protruded than the other portions of the rear side surface of the vertical member 1131.

The first protruded portion 1135 is in contact with the front surface of the latch 1200 and the rotating member 1370. Thus, the latch 1200 and the rotating member 1370 are not floating along the front-to-rear direction and at the same time the friction between the latch 1200 and the rotating member 1370 and the second housing 1130 when assembling thereof can be minimized. That is, since a backwardly protruded portion is formed in the rear side surface of the second housing 1130, the friction with the rotating member with respect to the second housing 1130 can be minimized. The first protruded portion 1135 is formed to have a shape similar to letter "l". The first protruded portion 1135 is curvedly formed along the direction of rotation of the latch 1200 and the rotating member 1370.

The second protruded portion 1136 is formed in the shape of an arc in the peripheral area of the shaft insertion hole, and contacted to the front surface of the latch 1200.

In addition, a forwardly protruded portion is formed in the front surface of the third housing 1150, the friction with the rotating member (main gear) with respect to the third housing 1150 can be minimized.

A plurality of mounting holes are formed in the first housing 1110 and the second housing 1130 for bolt tightening with the door 1. The mounting holes are disposed in the upper and the lower portions of the left side of the first housing 1110 and the second housing 1130, and in the right side of the striker insertion slot 1105 respectively. The vehicle door latch system 5 of the exemplary embodiment of the present invention can be easily and durably installed due to such mounting holes.

Further, in the second housing 1130, a first return spring holding shaft 1251, which are provided in the form of a rivet, a rotating shaft 1380, and a rivet insertion hole wherein a rotating spring stopping shaft 1391 are penetratingly formed along the front-to-rear direction. One end of the first return spring 1250 is held in the first return spring holding shaft 1251.

In the right side of the second housing 1130, a vertical member 1138, which surrounds and supports the right side of the first housing 1110 from where the door lever connecting unit 1800 is being pulled out (drawn), is protrudedly formed towards the rear side direction. Due to such vertical member 1138, the strength of the portion supporting the door lever connecting unit 1800 is reinforced. In the vertical member 1138, the withdrawing holes from which the door lever connecting unit 1800 is withdrawn are formed respectively. Due to such vertical member 1138, the first housing 1110 is prevented from the damage when an impact is applied thereto.

The vertical member 1131 is installed in the front surface of the first housing 1110 using a plurality of bolts 1133 and the like, and the horizontal member 1132 is disposed in the concave portion 1124 formed in the upper surface of the first housing 1110. The plurality of bolts 1133 are disposed in both sides of the striker insertion slot 1105 and in both sides of the lower portion of the second housing 1130 and the first housing 1110 respectively.

The striker insertion slot 1105 is formed across the vertical member 1131 and the horizontal member 1132.

As illustrated in FIG. 6, the third housing 1150 has a box-like shape formed with a space therein. The third housing 1150 is formed to have an open front.

Inside the third housing 1150, a second PCB insertion slot 1154 wherein the rear side of the PCB 1900 is inserted is formed. A second motor receiving slot 1151 for receiving the rear side of the motor 1610 is formed inside the third housing 1150.

The locking hooks 1153 are formed in the upper portion and both sides of the third housing 1150.

Each of the locking hooks 1153 is coupled to the corresponding locking hook stopping portion 1126 formed in the first housing 1110 respectively. Thus, the first housing 1110 and the third housing 1150 are coupled thereby. Additionally, the first housing 1110 and the third housing 1150 are rigidly coupled using bolts and the like.

A second key connect mount 1152 is formed in the lower portion of the third housing 1150.

A key connect 1550, which will be described later, is installed in the first key connect mount 1127 and the second key connect mount 1152 of the first housing 1110.

A recessed portion 1155 recessed along the left-to-right direction is formed at the left side of the rear side surface of the third housing 1150.

The PCB 1900 is inserted between the first PCB insertion slot and the second PCB insertion slot 1154, and installed in the housing 1100. The PCB 1900 is horizontally disposed in the lower portion inside the housing 1100.

A first sensor 1901, a second sensor 1903, a third sensor 1905, and a fourth sensor 1907 are installed in the PCB 1900. The first sensor 1901, the second sensor 1903, the third sensor 1905, and the fourth sensor 1907 are provided with sensors capable of detecting magnets.

The first sensor 1901 and the second sensor 1903 are disposed on a same line along the left-to-right direction, and the third sensor 1905 and the fourth sensor 1907 are disposed on a same line along the left-to-right direction. When viewing from the front side, the first sensor 1901 is disposed in the left side of the second sensor 1903. When viewing from the front side, the third sensor 1905 is disposed in the left side of the fourth sensor 1907.

The first sensor 1901 and the second sensor 1903 are associated with the opening and the closing operations of the door 1 by detecting the movement of the first sensing unit 1351 formed in the main locking member 1300.

The third sensor 1905 and the fourth sensor 1907 are associated with the locking and the lock-releasing operations of the door 1 by detecting the movement of the second sensing unit 1521 formed in the locking plate 1500.

In addition, a fifth sensor 1911 and the sixth sensor 1910 are connected to the PCB 1900. Limit switches may be provided as the fifth sensor 1911 and the sixth sensor 1910.

The fifth sensor 1911 is disposed between the first housing 1110 and the third housing 1150. More specifically, the fifth sensor 1911 is disposed close to the stopping portion guiding slot 1115.

The fifth sensor 1911 checks whether the main gear 1630 has returned to the original position (basic position) thereof.

The sixth sensor 1910 detects whether the latch 1200 is being rotated while being pressed by the striker 1101.

The sixth sensor 1910 may further comprise a sensor pressing member.

The sensor pressing member is inserted into the sixth sensor insertion hole 1129 and slided along the front-to-rear direction.

The sixth sensor 1910 is installed in the rear surface of the first housing 1110.

The sensor pressing member is pushed towards the rear side by the latch 1200 and presses the sixth sensor 1910.

The front surface of the sensor pressing member contacted with the rear surface of the latch 1200 is slantly formed to be protruded further frontward as it travels towards the downward direction, therefore, the sensor pressing member can be smoothly slided towards the rear direction when the latch 1200 is rotated.

As illustrated in FIG. 7, the latch 1200 is installed in the first housing 1110 so as to be disposed inside the latch receiving slot 1111.

The latch 1200 is rotatably installed in the first housing 1110 through the latch rotating shaft 1230 which is installed in the second housing 1130.

The latch 1200 is formed in the shape of a plate.

A locking slot 1201 is formed in the outer circumferential surface of the latch 1200.

The width of the locking slot 1201 is getting wider as travelling from the inside towards the outside thereof.

The locking slot 1201 is surrounded by a first surface 1203 which is formed to be flat, a second surface 1205 formed to have a slope and extended from the left end of the first surface 1203, a third surface 1207 being extended from the left end of the second surface 1205, forming an arc, and surrounding the striker 1101, a fourth surface 1209 being extended from the upper right end of the third surface 1207, and a fifth surface 1211 formed to have a slope and extended from the right end of the fourth surface 1209.

The locking slot 1201 is formed to be penetrating along the front-to-rear direction, and the outer end portion thereof is open.

In the latch 1200, an auxiliary locking slot 1202 is formed in the lower portion of the locking slot 1201.

The auxiliary locking slot 1202 is formed in the shape similar to the locking slot 1201, but the depth thereof is shallower than the locking slot 1201.

A spring insertion slot 1213 is formed in the outer circumferential surface of the latch 1200.

The spring insertion slot 1213 is formed to have the shape of a slot or a hole. In this exemplary embodiment, the spring insertion slot 1213 is formed to have the shape of a slot.

A protrusion 1215 is formed outwardly protruded in the left side of outer circumferential surface of the latch 1200.

The protrusion 1215 is disposed in front of the stopping portion guide slot 1115.

The locking slot 1201, the auxiliary locking slot 1202, the spring insertion slot 1213, and the protrusion 1215 are sequentially disposed along the rotating (clockwise) direction of the latch 1200 when closing door.

A first return spring 1250 is provided so that the latch 1200 can be returned automatically when the locking is released.

One end of the first return spring 1250 is held by the first return spring stopping shaft 1251 of the second housing 1130, and middle portion is wound around the latch rotating shaft 1230, and the other end thereof is inserted into the spring insertion slot 1213.

Thus, the other end of the first return spring 1250 can be rotated with the latch 1200 when the latch 1200 is being rotated.

The main locking member 1300 is slidingly installed inside the locking member receiving slot 1112 formed in the first housing 1110.

As illustrated in FIG. 8, the main locking member 1300 comprises a body 1310, a horizontal bar 1340, a stopping unit pressing part 1330, and a first sensing member 1350. The main locking member 1300 is integrally formed of the body 1310, the horizontal bar 1340, the stopping unit pressing part 1330, and the first sensing member 1350.

Further, the main locking member 1300 further includes a rotating member 1370 being rotated by the latch 1200, thereby sliding the main locking member 1300.

The body 1310 comprises a first portion 1311, and a second portion 1313 formed to have a step in the first portion 1311 in a way that the front surface thereof is disposed in front of the front surface of the first portion 1311.

The first portion 1311 constitutes the upper left portion of the body 1310, and the second portion 1313 constitutes the remaining portion of the body 1310.

A rotating member insertion slot 1317 is formed in the upper portion of the second portion 1313 wherein a portion of the rotating member 1370, which will be described later, is inserted.

The front and the upper portion of the rotating member insertion slot 1317 are open.

The front of the rotating member insertion slot 1317 is closed by installing the second housing 1130.

The left and the right side surfaces forming the rotating member insertion slot 1317 have the slopes inclining as they travel from the left side towards the right.

Further, a rotating member stopping protrusion having the shape of an arc is formed in the right side surface forming the rotating member insertion slot 1317. Due to such rotating member stopping protrusion, the rotating member 1370 and the main locking member 1300 are not easily separated, the rotating member 1370 and the main locking member 1300 are smoothly interlocked.

The length of the inclined slope of the left side surface constituting the rotating member insertion slot 1317 is shorter than that of the right side surface constituting the rotating member insertion slot 1317.

The lower side surface forming the rotating member insertion slot 1317 has a slope declining as it travels from the left side towards the right.

The left side of the body 1310 is curvedly or slantly formed so as not to interfere with the rotating latch 1200.

The lower portion of the rotating member 1370 is disposed in front of the first portion 1311 of the main locking member 1300. Thus, at least a portion of the rotating member 1370 is disposed in front of the main locking member 1300.

The rotating member 1370 is disposed in the front of the first housing 1110, and rotatably installed in the second housing 1130 through the rotating shaft 1380 disposed along the front-to-rear direction.

The rotating shaft 1380 is installed penetrating through the upper portion of the rotating member 1370.

The rotating shaft 1380 is provided in the form of a rivet and riveted into the second housing 1130.

The rotating member 1370 can be rotated around the center of the rotating shaft 1380 in the clockwise or counterclockwise direction.

In addition, a return spring 1390 which returns the rotating member 1370 may be provided.

One end of the rotating spring 1390 is supported and fixed by the rotating spring stopping shaft 1391 which is riveted in the second housing 1130, and the other end is caught by the right side of the rotating member 1370 and being connected thereby. The center portion of the rotating spring 1390 is inserted into the rotating shaft 1380.

The rotating spring 1390 performs a function of returning the rotating member 1370 to its original position by granting an elastic force capable of rotating the rotating member 1370 in clockwise direction when the rotating member 1370 is forcibly pushed towards the counterclockwise direction and then released.

The rotating member 1370 comprises a locking portion 1371 and an inserting protrusion 1373.

The left lower portion of the locking portion 1371 is protruded towards the left.

The locking portion 1371 restricts (locks) the position of the latch 1200.

In the lower side of the locking portion 1371, a latch insertion slot, wherein a portion of the end (first surface 1203) of the latch 1200 is inserted when closing the door, is formed. The latch insertion slot is formed to have an open lower portion.

An inserting protrusion 1373 which is downwardly protruded is formed in the right side of the lower surface of the locking portion 1371.

The inserting protrusion 1373 is located inside the rotating member insertion slot 1317.

The reason for this is to prevent the separation of the inserting protrusion 1373 of the rotating member 1370 from the inside of the rotating member insertion slot 1317 when the main locking member 1300 is being slided by the rotating member 1370 due to the rotation of the latch 1200.

The inserting protrusion 1373 slides the main locking member 1300 along the left-to-right direction according to the rotation of the rotating member 1370.

Preferably, the width along the left-to-right direction of the inserting protrusion 1373 is formed to be narrower than the width along the left-to-right direction of the rotating member insertion slot 1317.

The main locking member 1300 is installed in the first housing 1110 and locks the latch 1200 through the rotating member 1370.

A stopping lever receiving slot 1314 wherein a stopping lever unit 1450, which will be described later, is to be received is formed in the left side of the back surface of the body 1310. The stopping lever receiving slot 1314 is formed to have an open rear side. The stopping lever receiving slot 1314 is formed in the upper and lower sides respectively.

In addition, a stopping lever shaft hole 1316, wherein the stopping lever shaft 1470 is inserted along the up-down direction, is formed in the left lower side of the body 1310 along the up-down direction. The stopping lever shaft hole 1316 is formed to have an open upper portion and a closed lower portion, the stopping lever shaft 1470 is inserted from the above into the stopping lever shaft hole 1316 when being assembled. The stopping lever shaft hole 1316 is formed to be communicating with the stopping lever receiving slot 1314 which is formed in the upper and lower portion thereof.

A second return spring receiving slot 1318, wherein the second return spring 1460 is received, is formed in the left side of the rear side surface of the body 1310. The second return spring receiving slot 1318 is formed to have an open rear side. The second return spring receiving slot 1318 is disposed between the stopping lever receiving slots 1314 disposed in the upper and the lower portions thereof.

A spacing protrusion 1312 is formed in the middle of the left side of the rear side surface of the body 1310.

The spacing protrusion 1312 is disposed in the middle of the second return spring receiving slot 1318, and provides a gap between the first spring portion 1460*a* and the second spring portion 1460*b* of the second return spring 1460.

A sub-locking member insertion slot 1315 wherein the sub-locking member 1400 is inserted is formed in the rear side surface in the right side of the body 1310. The sub-locking member insertion slot 1315 is formed along the left-to-right direction, and its right side is formed to be open. Due to such sub-locking member insertion slot 1315 the sub-locking member 1400 can be guided when moving along the left-to-right direction.

In addition, a stopping protrusion insertion hole 1319 wherein the stopping protrusion 1455 is inserted is formed in the rear side surface of the right side of the body 1310. The stopping protrusion insertion hole 1319 is communicating with the sub-locking member insertion slot 1315.

The body 1310 is formed in this way, and the sub-locking member 1400 is disposed in the rear side of the main locking member 1300. Thus, the strength of the vehicle door latch system 5 can be enhanced, and at the same time, size thereof becomes compact as well, therefore it can be applied to the door 1 of the various designs.

The stopping lever unit 1450 is rotatably installed in the rear side surface of the body 1310. Unlike the previous description, the stopping lever unit 1450 may be formed in the sub-locking member.

The connecting means is rotatably installed in either one of the main locking member 1300 and the sub-locking member 1400, and comprises: a stopping lever unit 1450 wherein a stopping protrusion 1455 is formed; and a stopping threshold 1405 formed in the other one of the main locking member 1300 and the sub-locking member 1400, wherein the stopping lever unit 1450 is being caught.

Protrusion guide portions are formed in the locking members such as the locking plate 1500 or the child locking member 1700, and a protrusion is formed in the stopping lever unit 1450, and the rotation of the stopping lever unit 1450 is accomplished as the protrusion guide portion guides the protrusion.

The protrusion comprises a locking protrusion 1457 and a child protrusion 1453, and the protrusion guide portion comprises a locking protrusion guide portion 1507 and a child protrusion guide portion 1720.

As illustrated in FIG. 9, the stopping lever unit 1450 includes: a first stopping lever part 1450*a* and a second stopping lever part 1450*b* which is disposed in the lower side of the first stopping lever part 1450*a*.

Such as the first stopping lever part 1450*a* and the second stopping lever part 1450*b* are the connecting means installed for sliding both of the main locking member 1300 and the sub-locking member 1400, which will be described later, or sliding only the sub-locking member 1400 in a selective manner.

The first stopping lever part 1450*a* and the second stopping lever part 1450*b* are formed to be the shape of a bar, and a stopping protrusions 1455, which are forwardly protruded, are formed at the ends of the right sides thereof respectively.

Holes 1451, through which the stopping lever shaft 1470 is penetrating, are respectively formed along the up-down direction in the left ends of the first stopping lever part 1450*a* and the second stopping lever part 1450*b*.

The first stopping lever part 1450*a* and the second stopping lever part 1450*b* are rotatably installed in the body 1310 through the stopping lever shaft 1470 installed along the up-down direction in the body 1310.

A locking protrusion 1457 is formed in the right side of the first stopping lever part 1450*a* and the second stopping lever part 1450*b*.

The locking protrusion 1457 comprises a first locking protrusion 1457*a* and a second locking protrusion 1457*b*.

The first locking protrusion 1457*a* formed in the first stopping lever part 1450*a* is downwardly protruded, and a second locking protrusion 1457*b* formed in the second stopping lever part 1450*b* is upwardly protruded.

The first locking protrusion 1457*a* and the second locking protrusion 1457*b* enable the first stopping lever part 1450*a* and the second stopping lever part 1450*b* to be rotated individually guided by the inclined surface 1511 formed in the locking plate 1500 which will be described later.

The child protrusion 1453 is formed upwardly protruded in the upper right side of the first stopping lever part 1450*a*. The child protrusion 1453 is formed in the shape of a cylinder. The child protrusion 1453 is disposed on the same line with the locking protrusion 1457.

The child protrusion 1453 is formed for interlocking between the child locking member 1700 and the first stopping lever part 1450*a*, which will be described later.

The second return spring 1460 is installed in the first stopping lever part 1450*a* and the second stopping lever part 1450*b* for returning of the first stopping lever part 1450*a* and the second stopping lever part 1450*b* to their original positions.

The second return spring 1460 includes a first spring portion 1460*a*, a second spring portion 1460*b*, and a spring connecting portion 1465 for connecting the first spring portion 1460*a* and the second spring portion 1460*b*.

The first spring portion 1460*a* is disposed in the upper side of the second spring portion 1460*b*.

The first spring portion 1460*a* and the second spring portion 1460*b* include coil portions 1461 having the shape of a coil and free end portions having the shape of a straight line respectively.

The coil portions 1461 are inserted into the stopping lever shaft 1470 and being fixed thereby. The coil portions 1461 are disposed in the lower side of the first stopping lever part 1450*a* and the upper side of the second stopping lever part 1450*b*, respectively.

The coil portions 1461 and the spring connecting portion 1465 are received in the second return spring receiving slot 1318.

The free ends of the first spring portion 1460*a* and the second spring portion 1460*b* comprise a first bended portions 1462 bent backward, a second bended portions 1463 disposed along the left-to-right direction, and a third bended portions 1464 bent forward, respectively.

The third bended portion 1464 is being held by the first locking protrusion 1457*a* and the second locking protrusion 1457*b* respectively, so that the first spring portion 1460*a* and the second spring portion 1460*b* are connected to the first stopping lever part 1450*a* and the upper side of the second stopping lever part 1450*b*, respectively.

The spring connecting portion 1465 is formed to have the shape of Korean alphabet letter 'ㄷ' (a rectangle without one side).

The spring connecting portion 1465 is connected to the end of the opposite side of the free end portion in the coil portion 1461.

The spring connecting portion 1465 is received in the second return spring receiving slot 1318 and supported at the main locking member 1300.

In this way, one ends of the first spring portion 1460*a* and the second spring portion 1460*b* are held by the first stopping lever part 1450*a* and the second stopping lever part 1450*b* respectively, and the other ends thereof are supported by the main locking member 1300.

Accordingly, the first stopping lever part 1450*a* and the second stopping lever part 1450*b* are rotated by the force applied thereto, then the stopping protrusion 1455 is being moved to the back side, and the force being applied to the first stopping lever part 1450*a* and the second stopping lever part 1450*b* is removed, then the first stopping lever part 1450*a* and the second stopping lever part 1450*b* are reversely rotated by the elastic restoring force of the second return spring 1460, then the stopping protrusion 1455 is returned to its original state (move forward).

That is, the elastic restoring force of the second return spring 1460 is exerting towards the front direction.

The horizontal bar 1340 is formed long in length towards the left direction in the left lower side of the body 1310.

The horizontal bar 1340 is being slided inside the rod guide slot 1116 so that the sliding of the main locking member 1300 can be performed more stably.

The stopping unit pressing part 1330 is integrally formed to the horizontal bar 1340, and formed by being bended upwardly from the left end of the horizontal bar 1340.

The stopping unit pressing part 1330 is formed to be the shape of a bar curved like an arc.

The stopping unit pressing part 1330 is disposed in the outer side of the latch 1200; therefore, they are not interfered with each other when the latch 1200 is rotated.

Further, a stopping unit reinforcement member 1331 which has a larger strength than the stopping unit pressing part 1330 is inserted into the stopping unit pressing part 1330. The stopping unit reinforcement member 1331 may be disposed in the front surface of the main locking member 1330. Due to such stopping unit reinforcement member 1331 the strength of the main locking member 1300 can be more enhanced.

The stopping unit reinforcement member 1331 is provided as a strip-like iron plate, many of injection molding material pathways (holes) wherein injection molding materials can pass through are disposed spaced apart along the lengthwise direction. The stopping unit reinforcement member 1331 is formed with a curvature corresponding to the shape of the stopping unit pressing part 1330.

The stopping unit reinforcement member 1331 is disposed from the upper side of the stopping unit pressing part 1330 up to the upper side of the first sensing member 1350.

Also, in the stopping unit pressing part 1330, a bend region 1332 is formed so that a stopping unit 1631, which will be described later, is not pressed by the stopping unit pressing part 1330 when the stopping unit 1631 is in a basic position.

The basic position of the stopping unit 1631 is a position wherein the protrusion 1215 of the latch 1200 is not interfered with the stopping unit 1631 when the latch 1200 is rotated for the opening of the door 1.

The basic position of the stopping unit 1631 corresponds to the position of the fifth sensor 1911.

The bend region 1332 is curvedly formed more outwardly protruded than the other portions so that the stopping unit 1631 is not pressed by the stopping unit pressing part 1330 when the door lever is pulled by a user to open the door 1 at normal times not in a state of emergency. And thus, the stopping unit 1631 is not pressed by the stopping unit pressing part 1330 when there is no need to press the stopping unit 1631 is not pressed by the stopping unit pressing part 1330 at normal times, therefore, the increase in the operational force for moving the main locking member 1300 at normal times is prevented.

A first sensing member 1350 is formed downwardly protruded in the lower side of the right end of the horizontal bar 1340.

A first sensing unit 1351 such as a magnet is installed in the lower surface of the first sensing member 1350.

The first sensing unit 1351 is detected by the first sensor 1901 or the second sensor 1903 which is disposed in a position corresponding to the first sensing unit 1351 on the PCB 1900. The control unit (not shown) receives such detected signal and controls the motor 1610.

The sub-locking member 1400 is disposed in the right rear side of the main locking member 1300.

The sub-locking member 1400 is inserted into the sub-locking member insertion slot 1315 of the main locking member 1300. Thus, the sub-locking member 1400 is installed in the main locking member 1300 so that it can be slided along the left-to-right direction.

The sub-locking member 1400 is slidingly installed inside the locking member receiving slot 1112 formed in the first housing 1110 same as the main locking member 1300.

As illustrated in FIG. 11, a door lever connecting unit 1800 is connected to the sub-locking member 1400.

The sub-locking member 1400 includes a first sub-locking member 1400*a* and a second sub-locking member 1400*b* having the shape of a block. The corners of the upper and lower sides of the left side of first sub-locking member 1400*a* and a second sub-locking member 1400*b* are rounded so as to be slided smoothly along the left-to-right direction with respect to the main locking member 1300.

The door lever connecting unit 1800 includes a door in lever connecting part 1800*a* connected to the door in lever (not shown) and a door out lever connecting part 1800*b* connected to the door out lever (not shown). The door in lever connecting part 1800*a* and the door out lever connecting part 1800*b* are provided with wires.

The first sub-locking member 1400*a* is disposed in the upper portion of the second sub-locking member 1400*b*.

The door in lever connecting unit 1800*a* is connected to the first sub-locking member 1400*a*.

The first sub-locking member 1400*a* includes a first stopping member receiving slot 1401*a*, a first spring insertion protrusion 1402*a*, a first stopping threshold 1405*a*, and a manual locking member pressing portion 1407.

The second sub-locking member 1400*b* includes a second stopping member receiving slot 1401*b*, a second spring insertion protrusion 1402*b*, and a second stopping threshold 1405*b*.

The front sides of the first stopping member receiving slot 1401*a* and the second stopping member receiving slot 1401*b* are open.

The first stopping member receiving slot 1401*a* and the second stopping member receiving slot 1401*b* are formed to be corresponding to the shapes of the first stopping member 1801*a* and the second stopping member 1801*b*. Accordingly, the separation of the first stopping member 1801*a* and the second stopping member 1801*b* from the sub-locking member 1400 is prevented even when the door in lever or the door out lever is being pulled.

The first stopping member 1801*a* formed in the end of the door in lever 1800*a* is received in the first stopping member receiving slot 1401*a*.

The first stopping member 1801*a* of the door in lever connecting unit 1800*a* located inside the first stopping member receiving slot 1401*a* will not be separated towards the front side due to the body 1310 of the main locking member 1300.

The second stopping member 1801*b* formed in the end of the door out lever connecting unit 1800*b* is being received inside the second stopping member receiving slot 1401*b*.

The second stopping member 1801*b* of the door in lever connecting unit 1800*b* located inside the second stopping member receiving slot 1401*b* will not be separated towards the front side due to the body 1310 of the main locking member 1300.

A first withdrawing hole 1403*a*, from which the door in lever connecting unit 1800*a* is being pulled, is communicatingly formed in the right end of first stopping member receiving slot 1401*a* in a way that the first withdrawing hole 1403*a* is formed to have a smaller diameter than that of the first stopping member 1801*a*, so that the first stopping member 1801*a* cannot be pulled out through the first withdrawing hole 1403*a* even when the door in lever connecting unit 1800*a* is being pulled out to the right side.

Thus, the first sub-locking member 1400*a* is being slided towards the right when the door in lever connecting unit 1800*a* is being pulled towards the right.

A second withdrawing hole 1403*b*, from which the door out lever connecting unit 1800*b* is being pulled, is communicatingly formed in the right end of second stopping member receiving slot 1401*b* in a way that the second withdrawing hole 1403*b* is formed to have a smaller diameter than that of the second stopping member 1801*b*, so that the second stopping member 1801*b* cannot be pulled out through the second withdrawing hole 1403*b* even when the door out lever connecting unit 1800*b* is being pulled out to the right side.

Thus, the second sub-locking member 1400*b* is being slided towards the right when the door out lever connecting unit 1800*b* is being pulled towards the right.

A first spring 1803*a* is inserted into the door in lever connecting unit 1800*a* close to the first stopping member 1801*a*.

A first spring insertion protrusion 1402*a* and a second spring insertion protrusion 1402*b* are protrudedly formed towards the right in the right side ends of the first sub-locking member 1400*a* and the second sub-locking member 1400*b*, and in the upper and lower sides of the first outlet hole 1403*a* and the second outlet hole 1403*b*. The left side ends of the first spring 1803*a* and the second spring 1803*b* are inserted into the first spring insertion protrusion 1402*a* and the second spring insertion protrusion 1402*b* respectively.

The first spring 1803*a* is disposed between the right side end of the first sub-locking member 1400*a* and the first spring receiving slot 1117 of the first housing 1110. The first spring 1803*a* returns the first sub-locking member 1400*a* which had been slided towards the right by an external force to its original position by sliding it towards the left using the elastic restoring force of the first spring 1803*a* when the external force is removed.

The second spring 1803*b* is inserted into the door out lever connecting unit 1800*b*.

The second spring 1803*b* is disposed between the right side end of the second sub-locking member 1400*b* and the second spring receiving slot 1119 of the first housing 1110. The second spring 1803*b* returns the second sub-locking member 1400*b* which had been slided towards the right by an external force to its original position by sliding it towards the left using the elastic restoring force of the second spring 1803*b* when the external force is removed.

A stopping threshold 1405, where the stopping protrusion 1455 of the stopping lever unit 1450 is being held (caught), is formed in the sub-locking member 1400. The stopping threshold 1405 includes a first stopping threshold 1405*a* and a second stopping threshold 1405*b*.

The first stopping threshold 1405*a* is formed in the rear side of the first sub-locking member 1400*a*, and the second stopping threshold 1405*b* is formed in the rear side of the second sub-locking member 1400*b*.

The first stopping threshold 1405*a* and the second stopping threshold 1405*b* are formed in a way that the left sides of the rear sides of the first sub-locking member 1400*a* and the second sub-locking member 1400*b* are more protruded backward than the right sides thereof.

The right side surfaces of the first stopping threshold 1405*a* and the second stopping threshold 1405*b* are inclinedly formed so that the stopping protrusion 1455 is not easily separated once it is being held (caught).

The stopping protrusion 1455 of the first stopping lever part 1450*a* can be caught by or separated from the first stopping threshold 1405*a*, and the protrusion 1455 of the second stopping lever part 1450*b* can be caught by or separated from the second stopping threshold 1405*b*.

The first stopping lever part 1450*a*, the second stopping lever part 1450*b*, the first stopping threshold 1405*a*, and the second stopping threshold 1405*b* are connecting means for sliding both of the main locking member 1300 and the sub-locking member 1400, or sliding only the sub-locking member 1400.

While the first stopping lever part 1450*a* is caught by the first stopping threshold 1405*a*, and the second stopping lever part 1450*b* is caught by the second stopping threshold 1405*b*, and if the door in lever (not shown) or the door out lever (not shown) is being pulled, then the main locking member 1300 and the sub-locking member 1400 are being slided together towards the left.

That is, this is a lock released state of the door 1.

On the contrary, while the first stopping lever part 1450*a* is separated from the first stopping threshold 1405*a*, and the second stopping lever part 1450*b* is separated from the second stopping threshold 1405*b*, and if the door in lever (not shown) or the door out lever (not shown) is being pulled, then the main locking member 1300 is staying as it is, and only the sub-locking member 1400 is being slided towards the right.

That is, this is a locked state of the door 1.

The first sub-locking member 1400*a* is provided with a manual locking member pressing portion 1407 extending from the lower portion of the right side surface towards the right which is an outward direction.

The manual locking member pressing portion 1407 is provided with a horizontal plate, the front surface thereof is more protruded than the front surface of the first sub-locking member 1400*a*.

The manual locking member pressing portion 1407 is located between the first spring receiving slot 1117 of the first housing 1110 and the second spring receiving slot 1119, and being slided simultaneously with the first sub-locking member 1400*a* along the left-to-right direction.

The manual locking member pressing portion 1407 is in contact with the first stopping portion 1563 of the manual locking member 1560 which will be described later.

As illustrated in FIG. 13, the locking plate 1500 is formed in the shape of a plate and long in length along the left-to-right direction.

The locking plate 1500 is slidingly installed in the lower rear side surface of the first housing 1110. The locking plate 1500 rotates the stopping lever unit 1450.

In the locking plate 1500, a locking stopping portion 1502, a second sensing member 1519, a locking protrusion guide portion 1507, a lock-releasing cable connecting portion 1501, and a manual locking guide elongated hole 1515 are sequentially formed from the left side to the right side.

In the left lower end of the locking plate 1500, the locking stopping portion 1502 is downwardly and protrudedly formed. The shape of the horizontal cross-section of the locking stopping portion 1502 is a long ellipse along the front-to-rear direction. The locking stopping portion 1502 is formed in the shape of a cylindrical protrusion protruded downward.

The present exemplary embodiment further comprises a locking driving unit 1650 for sliding the locking plate 1500 automatically. That is, a driving unit 1600 for driving the latch 1200 and a locking driving unit 1650 for driving the locking plate 1500 are separately provided in this exemplary embodiment.

The locking driving unit 1650 is installed in the lower side of the left rear surface of the first housing 1110.

The locking driving unit 1650 is disposed in the left lower side of the locking plate 1500.

The locking driving unit 1650 comprises a motor 1651, a first gear 1652, and a second gear 1653 interlocked to the first gear 1652.

The shaft of the motor 1651 is disposed along the left-to-right direction so that the interference with other members of the door 1 can be minimized.

The motor 1651 of the locking driving unit 1650 is smaller than the motor 1610 of the driving unit 1600. Due to this, the reverse rotation of the first gear 1652 and the second gear 1653 is possible even the motor 1651 of the locking driving unit 1650 fails. Thus, when the motor 1651 fails or the vehicle is out of electrical power, a user can manually move the locking plate 1500 through a lock-releasing cable 1810 and the like, thereby enhancing the safety.

The motor 1651 is received in a locking motor receiving slot formed in the lower portion of the left rear side of the first housing 1110 and installed thereby. The locking motor receiving slot is formed along the front-to-rear direction so that the rear side is to be open.

The motor 1651 is disposed at the right side of the first gear 1652 and the second gear 1653. Thus, even when the water is flowed in the housing 1100, the flooding of the motor 1651 can be minimized.

The first gear 1652 is provided as a worm, and the second gear 1653 is provided as a worm gear.

Thus, the locking driving unit 1650 and the locking plate 1500 are connected via the worm and the worm gear. Owing to this, the vehicle door latch system can maintain its simple structure and reduce the reduction ratio simultaneously.

The first gear 1652 is disposed along the left-to-right direction.

The first gear 1652 is connected to the shaft of the motor 1651.

The second gear 1653 is disposed along the up-down direction.

The second gear 1653 is formed to have the shape of a disk, and gear teeth 1654 are formed in the circumferential surface.

The second gear 1653 is engaged with the first gear 1652.

The second gear 1653 is installed in a first key connect installation portion 1127.

In the center of the second gear 1653 a connect through hole 1655 wherein the key connect 1550 is penetrating is formed along the up-down direction.

In the upper surface of the second gear 1653, two rotating stopping portions are formed spaced apart along the circumferential direction. The rotating stopping portions comprise a first rotating stopping portion 1656 and a second stopping portion 1657. The first rotating stopping portion 1656 and a second stopping portion 1657 having the shape of a cylinder whose horizontal cross-section is a circle are formed upwardly protruded. The angle between the first rotating stopping portion 1656 and a second stopping portion 1657 is set to be 180° or can be adjusted depending on the circumstances.

Due to this, the locking plate 1500 is slided towards left or right as the motor 1651 of the locking driving unit 1650 operates.

The vehicle door latch system of this exemplary embodiment is rotatably installed in the first housing 1110 and the third housing 1150 of the housing 1100, and further comprises a key connect 1550 wherein a key insertion slot for inserting a key is formed in one side thereof.

The key connect 1550 comprises: a head 1551 wherein a cross-shaped slot is formed; a wing 1553 having a key connect cut-off portion 1555 wherein a portion of a disk having a larger diameter than that of the head 1551 has been cut-off.

The key connect 1550 is formed in the shape of a cylinder.

The key connect 1550 is inserted into a connect through hole 1655 and rotatably installed in the second gear 1653. A water protection ring 1558 is inserted in the lower circumferential surface of the key connect 1550 so that the assembly state of the key connect 1550 and the second gear 1653 can be maintained. The water protection ring 1558 is disposed in the lower side of the second gear 1653 and prevents infiltration of moisture into the motor 1651.

The head 1551 is formed in the lower side of the key connect 1550.

The wing 1553 is formed in the upper side of the key connect 1550, and integrally formed into the head 1551.

The outer diameter of the wing 1553 is formed to be larger than the diameter of the connect through hole 1655 but smaller than the outer diameter of the second gear 1653.

The wing 1553 is disposed in the upper portion of the rotating stopping portion.

The surface of the cut-off portion from the wing 1553 is formed in the shape of an arc.

The center angle of the key connect cut-off portion 1555 is smaller than 180°.

The depth of the key connect cut-off portion 1555 is formed to be deeper than the up-down height of the wing 1553.

The locking stopping portion 1502 is positioned within the key connect cut-off portion 1555.

Thus, in the wing 1553, two key stopping portions wherein the locking stopping portion 1502 is being caught (held) are formed spaced apart along the circumferential direction at both sides of the wing 1553.

The key stopping portion comprises a first key stopping portion 1554 and a second key stopping portion 1552.

Due to such key stopping portions, the locking plate 1500 is slided towards the left or right as the key connect 1550 is being rotated.

In this way, when the head 1551 of the key connect 1550 is rotated interlocked with the key module mounted in the vehicle, the wing 1553 is also rotated, therefore the locking plate 1500 can be slided in the left-to-right direction without operating the locking driving unit 1650.

That is, the locking plate 1500 performs linear movement by the rotational movement of the key connect 1550.

Thus, the door 1 can be manually locked or lock-released by using the key connect 1550.

In addition, the key connect 1550 is disposed within the second gear 1653 so that the vehicle door latch system can be compactized, and at the same time, the locking plate 1500 can be smoothly moved when the key connect 1550 or the motor 1651 fails or the vehicle parts are frozen in winter since they can be operated separately.

In the locking plate 1500, a horizontal guide is formed rearwardly protruded in the right lower portion of the locking stopping portion 1502, and disposed in the upper side of the motor 1651.

In the locking plate 1500, a second sensing member 1519 is formed downwardly protruded in the right lower side of the horizontal guide. More specifically, the lower portion of the second sensing member 1519 is formed rearwardly protruded.

In the lower surface of the bended portion of the second sensing member 1519, a second sensing unit 1521 such as a magnet is installed.

The second sensing unit 1521 is detected by the third sensor 1905 and the fourth sensor 1907 which are installed in a position corresponding to the second sensing unit 1521 on the PCB 1900. Such signal detected by the third sensor 1905 and the fourth sensor 1907 is transferred to the information device of the vehicle, thus the driver recognize the locking and lock-releasing states of the door 1.

In the locking plate 1500, a locking protrusion guide portion 1507 is formed at the right side of the second sensing member 1519.

The locking protrusion guide portion 1507 is protrudedly formed in the right front surface of the locking plate 1500 towards the front side (towards the stopping lever unit 1450).

The locking protrusion guide portion 1507 is formed in the shape of a strip, and formed in a way that first, it is protruded and then bended towards the right and then the end is bended again towards the front side. Thus, an insertion space 1509, wherein the locking protrusion 1457 is inserted, is formed between the locking protrusion guide portion 1507 and the front surface of the locking plate 1500. The insertion space 1509 is formed in a way that the upper, lower, and right sides thereof are open.

An inclined surface 1511 is formed in the inner side surface (surface being contacted with the locking protrusion 1457) of the locking protrusion guide portion 1507, and thus, the front-to-rear gap of the insertion space 1509 is formed to be getting narrower as it travels towards the left. Due to this, the locking protrusion guide portion 1507 can smoothly guide the locking protrusion 1457 towards the rear direction.

The upper portion of the locking protrusion guide portion 1507 guides the first locking protrusion 1457*a* of the first stopping lever part 1450*a*, and the lower portion of locking protrusion guide portion 1507 guides the second locking protrusion 1457*b* of the second stopping lever part 1450*b*.

The rotation of the stopping lever unit 1450 is occurring as the locking protrusion guide portion 1507 guides the locking protrusion 1457 towards either the front direction or the rear direction; if the stopping lever unit 1450 is caught by the stopping threshold 1405 due to the sliding of the locking plate 1500, then both of the main locking member 1300 and the sub-locking member 1400 are sliding together (door lock is released); and if the stopping lever unit 1450 is separated from the stopping threshold 1405 due to the sliding of the locking plate 1500, then only the sub-locking member 1400 is sliding (door is locked).

More specifically, when the first locking protrusion 1457*a* and the second locking protrusion 1457*b* are disposed in the insertion space 1509 by the locking protrusion guide portion 1507, the first stopping lever part 1450*a* and the second stopping lever part 1450*b* are being separated from the first stopping threshold 1405*a* of the first sub-locking member 1400*a* and the second stopping threshold 1405*b* of the second sub-locking member 1400*b* respectively, and thus this is the state wherein the door 1 is locked.

When the first locking protrusion 1457*a* and the second locking protrusion 1457*b* are separated from the insertion space 1509, the first stopping lever part 1450*a* and the second stopping lever part 1450*b* are being caught by the first stopping threshold 1405*a* of the first sub-locking member 1400*a* and the second stopping threshold 1405*b* of the second sub-locking member 1400*b* respectively, and thus this is the state wherein the locking of the door 1 is released.

In this way, the locking protrusion guide portion 1507 plays the role of locking the door 1 or releasing the locking of the door 1 by rotating the first stopping lever part 1450*a* and the second stopping lever part 1450*b* according to the sliding of the locking plate 1500 along the left-to-right direction.

A first stopper protrusion 1107 is protrudedly formed in one of the locking plate 1500 and the housing 1100, and in the remaining one thereof, a first stop spring 1570 elastically deformed by the first stopper protrusion 1107 is formed.

In this exemplary embodiment, the first stopper protrusion 1107 is formed backwardly protruded in the rear side surface of the first housing 1110, and the first stop spring 1570 is installed at the right rear side surface of the locking plate 1500.

A stopper elongated hole 1571 where the first stopper protrusion 1107 is penetrating through is formed along the left-to-right direction at the right lower portion of the locking plate 1500.

The stopper elongated hole 1571 is disposed in the right lower portion of the locking protrusion guide portion 1507.

A first link 1573, wherein the one end of the first stop spring 1570 is inserted, is formed rearwardly protruded at the left side of the stopper elongated hole 1571 in the rear side surface of the locking plate 1500.

A second link 1572, wherein the other end of the first stop spring 1570 is inserted, is formed rearwardly protruded at the right side of the stopper elongated hole 1571 in the rear side surface of the locking plate 1500.

The first stop spring 1570 is formed by bending the middle portion of a metallic wire. Thus, the first stop spring 1570 is formed to have the shape of a pin ('⊃') in general. In this way, a wire form spring is provided as the first stop spring 1570.

A first insertion portion 1578 which is inserted into the first link 1573 is formed in the one side of the first stop spring 1570. The first insertion portion 1578 is formed to be the shape of a circle.

A first stop portion 1577, whose top and lower portions are formed to be the shape of an arc so as to correspond to the shape of the first stopper protrusion 1107, is formed at the right side of first insertion portion 1578 of the first stop spring 1570. The first stopper protrusion 1107 is received on the first stop portion 1577 when the locking plate 1500 is in the door lock position.

A second stop portion 1575, whose top and lower portions are formed to be the shape of an arc so as to correspond to the shape of the first stopper protrusion 1107, is formed at the right side of first stop portion 1577 of the first stop spring 1570. The first stopper protrusion 1107 is received on the second stop portion 1575 when the locking plate 1500 is in the door lock released position.

In the first stop spring 1570, an elastic deforming portion 1576, whose vertical width is smaller than those of the first stop portion 1577 and the second stop portion 1575, is formed between the first stop portion 1577 and the second stop portion 1575. That is, the vertical width of the elastic deforming portion 1576 is formed smaller that the up-down width of the first stopper protrusion 1107. The upper portion of the elastic deforming portion 1576 is curvedly formed to be downwardly concave, and the lower portion thereof is curvedly formed to be upwardly convex.

In the right end of the first stop spring 1570, a spring end portion 1574 is formed. The vertical width of the spring end portion 1574 is formed to be smaller than that of the second stop portion 1575. The spring end portion 1734 is horizontally disposed along the left-to-right direction in the shape of a straight line.

The shape of the cross-section of the first stopper protrusion 1107 is formed in the shape of a cylinder.

Thus, in order to move the locking plate 1500 from the connected position to the disconnected position (or towards the opposite direction), the vertical gap of the elastic deforming portion 1576 must be widened through the elastic deformation thereof. That is, in order to move the locking plate 1500 from the connected position to the disconnected position, or in order to move the locking plate 1500 from the disconnected position to the connected position, the locking plate 1500 must be slided by a force which is strong enough to elastically deform the elastic deforming portion 1576 of the first stop spring 1570.

Moreover, when sliding the locking plate 1500, a friction force is generated due to the contact between the elastic deforming portion 1576 of the first stop spring 1570 and the first stopper protrusion 1107.

Thus, the separation of the locking plate 1500 from the connected position or the disconnected position is prevented even when the external impact is applied thereto when the locking plate 1500 is in the connected position or in the disconnected position. That is, the erroneous operation of the locking plate 1500 due to the external impact is prevented.

The lock-releasing cable connecting portion 1501 is disposed near the right end of the locking plate 1500. A lock-releasing cable 1810 is installed in the lock-releasing cable connecting portion 1501, and the lock-releasing cable 1810 is being pulled towards the left or right side when a knob 6 is operated, thus, the locking plate 1500 is moved towards the left or right side.

Due to this, the lock-releasing cable 1810 is withdrawn to the right side of the first housing 1110 together with the door lever connecting portion 1800, as described hereinafter.

The lock-releasing cable connecting portion 1501 is formed in the rear surface of the locking plate 1500.

Therefore, assembling of the lock-releasing cable 1810 to the locking plate 1500 becomes more facilitated.

A direction switching unit 20 is installed between the lock-releasing cable 1810 and the knob 6.

A lock-releasing cable 1810 is connected to the left end of the lock-releasing cable connecting portion 1501 so that when the knob 6 and the like is operated, the locking plate 1500 is moved towards the left or right as the lock-releasing cable 1810 is being pulled towards the left or right.

A first stopping member receiving slot, wherein the first stopping member of the lock-releasing cable 1810 is received is formed in the rear side of the lock-releasing cable connecting portion 1501. Therefore, the assembling of the lock-releasing cable 1810 to the locking plate 1500 becomes easier.

The first stopping member of the lock-releasing cable 1810 is formed in the shape of a long cylinder along the up-down direction.

The direction switching unit 20 comprises a direction switching housing and a switching lever 30 which is rotatably installed in the direction switching housing.

As illustrated in FIG. 15, the direction switch housing comprises a first direction switching housing 21, and a second direction switching housing 22 covering the rear side of the first direction switching housing 21.

A receiving slot is formed in the rear side surface of the first direction switching housing 21 for receiving individual elements respectively. The receiving slot is formed to have an open rear side.

A first guide slot 24 for guiding the knob 6 and a second guide slot 23 for guiding a cable block 40 connected to the lock-releasing cable 1810 are formed in the first direction switching housing 21.

A second stopping member receiving slot 41 wherein the second stopping member of the lock-releasing cable 1810 is received is formed in the rear side surface of the cable block 40. Therefore, the lock-releasing cable 1810 is connected to the cable block 40.

The first guide slot 24 and the second guide slot 23 are formed along the left-to-right direction. The withdrawing holes, through which the knob 6 or the lock-releasing cable

1810 is withdrawn, are communicatingly formed in the right and the left sides of the first guide slot 24 and the second guide slot 23 respectively.

The first guide slot 24 is disposed in the lower side of the second guide slot 23.

Sliding protrusions, which are inserted into the sliding slots formed in the front surfaces of the knob 6 and the cable block 40 respectively, are formed in the first guide slot 24 and the second guide slot 23. Owing to the sliding slots and the sliding protrusions the knob 6 and the cable block 40 can be smoothly slided.

An elongated hole 25, wherein the switching lever 30 can be moved, is formed in the first direction switch housing 21 for communicating with the first and the second guide slots 24 and 23. The elongated hole 25 is disposed between the first and the second guide slots 24 and 23.

The elongated hole 25 is formed long in length along the left-to-right direction. A switching lever 30 is inserted in the elongated hole 25.

A rotating shaft 26 of the switching lever 30 is formed in the first direction switching housing 21 so that it is disposed inside the elongated hole 25. The rotating shaft 26 is disposed between the first and the second guide slots 24 and 23.

A first connecting protrusion 6*a* is formed backwardly protruded in the rear side surface of the knob 6.

A second connecting protrusion 42 is formed backwardly protruded in the rear side surface of the cable block 40.

The first and the second connecting protrusions 6*a* and 42 are formed to be the shape of a cylinder.

The switching lever 30 is formed to be the shape of a long bar, and disposed along the up-down direction.

A first connecting protrusion insertion slot, wherein the first connecting protrusion 6*a*, is inserted is formed in the one side of the switching lever 30; and a second connecting protrusion insertion slot, wherein the second connecting protrusion 42 is inserted, is formed in the other side thereof (of the switching lever 30). Accordingly, the knob 6 is rotatably connected to the one side of the switching lever 30, and the lock-releasing cable 1810 is rotatably connected to the other side thereof (of the switching lever 30).

A shaft insertion hole, wherein the rotating shaft 26 is inserted, is formed between the one end and the other end of the switching lever 30.

Accordingly, the rotating shaft 26 is disposed in the one side and the other side of the switching lever 30. That is, the rotating shaft 26 is disposed between the knob 6 and the cable block 40.

Due to the switching lever 30 installed in this way, when the knob 6 is pressed (moved to the left) the cable block 40 is moved towards the right. When the cable block 40 is moved towards the right, the locking plate 1500 is moved towards the right, the door is locked thereby. And, when the knob 6 is being pulled (moved to the right) the cable block 40 is moved towards the left. When the cable block 40 is moved towards the left, the locking plate 1500 is moved towards the left, the door becomes lock-released thereby.

In this way, the switching lever 30 reverses the direction of the force applied to the knob 6 and delivers the force to the locking plate 1500 according to "the principle of the lever."

Therefore, even when the withdrawing direction of the lock-releasing cable 1810 is changed, the operation of the knob 6 can be maintained same as usual.

Due to this, as illustrated in FIG. 16, when the vehicle door latch system is installed in the door 1, it is possible that the electrical products such as the motor 1610 and the PCB 1900 can be directing towards the upper side of the vehicle, therefore the flooding of the motor 1610 and the PCB 1900 is prevented.

A manual locking guide elongated hole 1515 is formed along the left-to-right direction in the upper portion of the right side end of the locking plate 1500. The manual locking guide elongated hole 1515 is formed in a way that the front side, back side, and the right side thereof are open.

A reinforcement structure is formed near the manual locking guide elongated hole 1515 in the front surface of the locking plate 1500, so that the strength of the locking plate can be enhanced.

A second stopping portion 1562 of the manual locking member 1560, which will be described later, is inserted in the manual locking guide elongated hole 1515.

In the center area of the manual locking member 1560, a shaft through-hole, where the manual locking member shaft 1561 is passing through, is penetratingly formed along the up-down direction.

The manual locking member shaft 1561 is received in the manual locking member receiving slot 1125.

The rear side of the manual locking member receiving slot 1125 is blocked by the manual locking member cover 1564 disposed in the rear side of the manual locking member shaft 1561, so that the manual locking member shaft 1561 is not separated from the manual locking member receiving slot 1125. A second stopping portion outlet hole, from which the second stopping portion 1562 is being pulled out, is formed in the manual locking member cover 1564.

The manual locking member 1560 is inserted into the manual locking member insertion hole 1118. Thus, the manual locking member 1560 is rotatably installed in the first housing 1110.

A first stopping portion 1563 which is caught by the manual locking member pressing portion 1407 of the first sub-locking member 1400*a*, is formed in the front side of the manual locking member 1560, and a second stopping portion 1562 which is caught by the locking plate 1500 is formed in the rear side thereof.

In this way, the first stopping portion 1563 and the second stopping portion 1562 are disposed spaced apart along the circumferential direction. The corners of the end portions of the first stopping portion 1563 and the second stopping portion 1562 are rounded.

Due to such manual locking member 1560 the structure becomes simple, and the locking of the door is released when a user inside the vehicle pulls the door in lever once while the door is locked, and the door 1 is opened when the door in lever is being pulled one more time.

The present exemplary embodiment further comprises a driving unit 1600 for rotating the latch 1200 or sliding the child locking member 1700.

As illustrated in FIG. 18, the driving unit 1600 comprises: a motor 1610; a reduction gear 1620 being rotated by the motor 1610; and a main gear engaged with the reduction gear 1620 and rotated thereby.

The driving unit 1600 is installed in the rear surface of the first housing 1110 and in the front surface of the third housing 1150.

The driving unit 1600 is disposed in the upper side of the housing 1100. Thus, when the vehicle door latch system is being installed in the door 1, the driving unit 1600 is disposed above the striker insertion slot 1105. And thus, the wetting of the motor 1610 is prevented even when the water is flowed into the striker insertion slot 1105.

The motor 1610 is connected to the PCB 1900 so that it may generate the driving force or stop the generation of driving force by receiving the signal from the PCB 1900.

The motor 1610 is disposed in a way that the angle between the shaft 1611 of the motor 1610 and the front surface of the housing 1100 becomes zero degree (horizontal) or a preferred angle (slope).

The shaft 1611 of the motor 1610 is disposed along the left-to-right direction.

A first worm 1613 is installed in the shaft 1611 of the motor 1610.

The reduction gear 1620 comprises a first worm gear 1621 gearing with the first worm 1613 and a second worm 1622 installed in the first worm gear 1621.

The shaft of the reduction gear 1620 is disposed along the up-down direction. The first worm gear 1621 is disposed in the upper side of the second worm 1622, and integrally formed. The maximum outer diameters of the first worm gear 1621 and the second worm 1622 are equal or similar.

Thus, when the motor 1610 is operated the first worm 1613 is rotated; and as the first worm 1613 is rotated the first worm gear 1621 is rotated; and when the first worm gear 1621 is rotated the second worm 1622 which is integrally formed in the first worm gear 1621 is rotated; and as the second worm 1622 is rotated the main gear 1630 is rotated.

The shaft of the reduction gear 1620 is rotatably installed in a reduction gear shaft supporting plate 1623. The reduction gear shaft supporting plate 1623 is disposed in the upper and lower portions of the reduction gear 1620 respectively. A supporting plate insertion slot for inserting the reduction gear shaft supporting plate 1623 is formed in the rear surface of the first housing 1110 and the front surface of the third housing 1150 so that the reduction gear 1620 can be easily installed in the housing 1100.

When such reduction gear 1620 is provided, the speed of the motor 1610 is greatly reduced so that the closing of the door through the motor 1610 is smoothly performed and the driving torque is obtained thereby. Also, the speed is reduced when the door is closed so that the door can be urgently opened when a safety accident like jamming of a part of human body or clothing between the vehicle door and the door-frame occurs.

The main gear 1630 is driven by the second worm gear, and receives the driving force of the motor 1610 via the reduction gear 1620.

The main gear 1630 is rotated centered around the main gear shaft 1114 disposed along the front-to-rear direction.

As illustrated in FIGS. 19 and 20, in the main gear 1630, a geared portion 1632, wherein gear teeth 1638 are formed, is formed in a portion of the peripheral surface of the main gear 1630; and a non-geared portion 1643, wherein no gear teeth 1638 are formed, is formed in the remaining portion of the peripheral surface thereof.

The geared portion 1632 is formed only in a portion of the right side of the main gear 1630.

The non-geared portion 1643 is formed in the remaining portion of the main gear 1630 not in the geared portion 1632. The non-geared portion 1643 is formed to be flat or curved.

That is, the gear teeth 1638 are not formed around the entire circumference of the main gear 1630 but only in a portion thereof. Therefore, the thickness, along the front-to-rear direction, of the main gear 1630 can be reduced while the durability of the main gear 1630 is maintained.

The thickness, along the front-to-rear direction, of the geared portion 1632 is formed to be thicker than that of the non-geared portion 1643. Therefore, the durability of the geared portion 1632 can be enhanced.

The main gear 1630 includes a plastic portion 1634 and a metal portion 1642 which is inserted into the plastic portion 1634. The main gear 1630 is formed by inserting the metal portion 1642 into the plastic portion 1634.

The plastic portion 1634 includes a plastic plate portion 1645 formed in the shape of a plate, and a geared portion 1632 backwardly and protrudedly formed in a portion of the outer circumferential surface of the plastic plate portion 1645.

Meanwhile, when a vehicle door latch system is installed in the door 1, the middle portion of the rear surface is disposed to face the window of the door when the door window is coming down. When coming down, the door window 2 is not coming down straightly but coming down slantly. Due to this feature, when the door window is coming down, the center portion of the left side of the rear surface of the vehicle door latch system is coming closer to the door window.

Thus, if the center portion of the left side of the rear side surface of the vehicle door latch system is backwardly protruded, it will encounter the coming door window. However, in the main gear 1630 disposed in the left rear side of the vehicle door latch system of this exemplary embodiment, the gear teeth 1638 of the main gear 1630 disposed at the left rear side are formed only in a portion of the right side of the outer circumferential surface, so that the gear teeth 1638 can be formed to be thick and the thickness of the left center portion of the main gear 1630 can be reduced while maintaining the durability thereof. Thus, the interference between the door window 2 and the vehicle door latch system 5 is prevented when the vehicle door latch system 5 is being installed in the door 1.

The plastic plate portion 1645 is formed in the shape of a circular disk, and the insert protrusions 1637 are backwardly and protrudedly formed in the rear side surface thereof. A plurality of the insert protrusions 1637 is formed around the insert hole 1636 wherein the main gear shaft 1114 is inserted.

A stopping unit 1631 is formed in the lower left portion of the front surface of the plastic plate portion 1645 for rotating the latch 1200. The stopping unit 1631 is formed in the shape of a bar, and protrudedly formed towards the front direction.

The stopping unit 1631 is installed slidingly along the front-to-rear direction in an outer container 1649 forwardly protruded in the front surface of the plastic plate portion 1645.

The outer container 1649 is formed in a way that the front side thereof is open and the inside thereof is hollow. A sliding guide elongated hole **1649*a* is formed in the left and the right sides of the outer container portion 1649. The guide elongated hole 1649*a* is formed long in length along the front-to-rear direction. The guide elongated hole 1649*a*** is penetratingly formed along the left-to-right direction.

The stopping unit 1631 includes a head portion **1631*a* and an inner container portion 1631*b* formed in the rear side of the head portion 1631*a***.

An inclined surface is formed in the left front surface of the head portion **1631*a*. Due to such inclined surface, the stopping unit pressing part 1330 can push the head portion 1631*a*** smoothly.

The end of the outer side of the head portion **1631*a* is outwardly formed protruded further than the latch 1200. Thus, even when the head portion 1631*a* is pressed by the stopping unit pressing part 1330, the interference between the rotating latch 1200 and the stopping unit pressing part 1330** is prevented.

The inner container portion 1631*b* is inserted into the outer container 1649.

An outer container stopping protrusion 1631*c* is formed outwardly protruded at both sides of the outer circumference of the inner container 1631*b*. The outer container stopping protrusion 1631*c* is inserted into the guide elongated hole 1649*a*.

The inner container portion 1631*b* is formed in a way that the rear side thereof is open and the inside thereof is hollow.

A stopping portion return spring 1648 which returns the stopping unit 1631 to its original position is disposed between the inner container portion 1631*b* and the outer container 1649.

A coil spring is provided as the return spring 1648. The front end of the return spring 1648 is inserted into the inner container 1631*b*.

Due to such stopping unit 1631 the door 1 can be manually opened by pulling the door lever or the door out lever even if the driving unit 1600 fails during closing the door 1 using the driving unit 1600 or after it has been closed.

In ordinary times, the stopping unit 1631 plays the role of holding the latch 1200 to the rotating member 1370 and the main locking member 1300 by automatically rotating the latch 1200 using the driving force of the motor 1610 if the door 1 is closed to some degree even if the door 1 is not closed completely when a user closes the door 1.

In addition, a fifth sensor detecting portion 1641 is formed in the outer circumferential surface of the plastic plate portion 1645 so as to be disposed in the rear side of the stopping unit 1631. The fifth sensor detecting portion 1641 is formed in a way that it presses the fifth sensor 1911, which is a limit switch, when the stopping unit 1631 of the main gear 1630 returns to the basic position. Thus, the main gear 1630 can be returned to the original position (basic position) again after moving the child locking member 1700, or being rotated for moving the latch 1200.

A part of the lower portion the plastic portion 1634 is cut-off. A main gear stopping protrusion 1710 is inserted into the space where the plastic portion 1634 is cut-off. Due to this, a child locking member stopping portion 1635 sliding the child locking member 1700 is formed in the lower portion of the plastic portion 1634.

The child locking member stopping unit 1635 plays the role of pushing the main gear stopping protrusion 1710 in accordance with the rotation of the main gear 1630 so that the child locking member 1700 is slided towards the left or right side by.

In addition, the main gear stopping protrusion 1710 is disposed in the front side of the metal portion 1642.

The metal portion 1642 includes a plate portion 1644 formed in the shape of a plate, and a plurality of the protrusions 1639 forwardly and protrudedly formed along the circumference of the plate portion 1644.

The plate portion 1644 is formed in the shape of a disk. In the center area of the plate portion 1644, the insert protrusion slots 1646 are formed around the insert hole 1636 wherein the main gear shaft 1114 is inserted. The insert protrusions 1637 are inserted into the insert protrusion slots 1646.

The protrusions 1639 are inserted into the geared portion 1632 and the inside of the stopping unit 1631 of the plastic portion 1634. Thus, the durability of the geared portion 1632 and the stopping unit 1631 can be enhanced further.

The protrusions 1639 which are inserted in the geared portion 1632 are formed divided in multiple numbers, and the protrusion 1639 which is disposed inside the stopping unit 1631 is formed to have a longer length than those of the protrusions 1639 inside the geared portion 1632.

Since the opening and the closing of the door 1 using the latch 1200, and the locking and the lock-releasing of the door 1 using the child locking member 1700 can be performed by a single driving unit 1600, the structure is simple, and it can be compactly configured, and the manufacturing cost can be reduced.

The vehicle door latch system further comprises the child locking member 1700 slidingly installed in the housing 1100.

The child locking member 1700 is installed in the rear side surface of the first housing 1110 of the housing in a way that it is movable along the left-to-right direction.

A child locking member receiving slot is formed in the rear side surface of the first housing 1110, wherein the child locking member receiving slot is formed so as to communicate with the locking member receiving slot 1112. The child locking member receiving slot is formed to have an open rear side.

The child locking member 1700 is disposed in the lower side of the driving unit 1600, and in the rear side of the locking plate 1500.

The child locking member 1700 is formed to have the shape of a plate just like the locking plate 1500.

In the left side of the child locking member 1700, a main gear stopping protrusion 1710 being caught by the child stopping member stopping unit 1635 is protrudedly formed toward the left side.

A third sensing unit installation portion 1740 is formed in the rear side of the center area of the child locking member 1700. The third sensing unit installation portion 1740 is disposed at the right side of the main gear stopping protrusion 1710.

The third sensing unit installation portion 1740 is formed in the shape of a bar vertically disposed along the up-down direction, and a third sensing unit 1741 is installed in the lower end thereof. A magnet may be provided as the third sensing unit 1741.

A seventh sensor 1904 and an eighth sensor 1902 for detecting the third sensing unit 1741 are provided spaced apart along the left-to-right direction in the PCB 1900. The seventh sensor 1904 and the eighth sensor 1902 detect whether it is a child lock-released state or a child lock state. This signal is transferred to the vehicle ECU and the like, and informs the driver about the child lock/lock-released state through lighting of an indicating lamp and the like.

A protrusion guide portion 1720 is formed in the right front surface of the third sensing unit installation portion 1740 in the child locking member 1700.

The protrusion guide portion 1720 is formed protruded towards the front direction (towards the first stopping lever part 1450*a*).

The protrusion guide portion 1720 is formed in the shape of a strip, and formed in a way that first, it is forwardly protruded and then bended towards the right. Thereby, an insertion space, wherein the child lock protrusion 1453 is inserted, is formed between the protrusion guide portion 1720 and the front surface of the child locking member 1700. The insertion space is formed in a way that the upper side, the lower side, and the right side thereof are open.

Since the shape of the horizontal cross-section of the protrusion guide portion 1720 is formed equally or similarly formed as the locking protrusion guide portion 1507, the detailed description thereof will be omitted.

An inclined surface is formed in the inner side surface (surface being contacted with the child lock protrusion 1453) of the protrusion guide portion 1720, and thus, the structure becomes simpler and the durability is enhanced as well.

The rotation of the first stopping lever part 1450*a* of the stopping lever unit is accomplished as the protrusion guide portion 1720 guides the child lock protrusion 1453.

The vehicle door latch system according to the present exemplary embodiment comprises: a locking member spring 1760 applying an elastic force to the child locking member 1700 in the opposite direction of an external force when the child locking member 1700 is moved by the external force; a locking guide member 1790 rotatably installed in the housing 1100; and a cam-part 1780 formed in the child locking member 1700 for guiding the locking guide member 1790 and formed with a stopping slot 1786.

In the present exemplary embodiment, the child locking member 1700 is a locking member; however, unlike this, the locking member can be a locking plate 1500.

The external force is formed by the main gear 1630 of the driving unit 1600, so that the door 1 can be automatically closed through the single driving unit 1600, and at the same time child locking can be performed automatically.

The main gear 1630 slides (moves) the child locking member 1700 towards the right.

The locking member spring 1760 is provided as a coil spring.

The right end of the locking member spring 1760 is received by the locking member spring receiving slot formed in the rear surface of the first housing 1110, and the left end is inserted into the spring insert protrusion 1761 protrudedly formed towards the right side of the child locking member 1700. In this way, the locking member spring 1760 is disposed between the housing 1110 and the child locking member 1700.

The locking guide member 1790 comprises a main body portion 1792 installed in the rear surface of the first housing 1110, and a rod portion 1791 rotatably installed in the main body portion 1792.

The main body portion 1792 is received by the main body part receiving slot formed in the rear surface of the first housing 1110.

The main body portion 1792 is formed to be the shape of a cylinder whose vertical cross-section is a circle.

The main body portion 1792 comprises an upper main body portion and a lower main body portion disposed in the lower portion of the upper main body portion.

The upper main body portion and the lower main body portion are formed to have a half circle vertical cross-section.

The contact surface between the upper main body portion and the lower main body portion is formed to be flat, and a rod insertion slot wherein the middle portion of the rod portion 1791 is inserted is formed in the contact surface.

The rod insert slot comprises a front-to-rear slot wherein the shaft portion disposed along the front-to-rear direction in the rod portion 1791 is inserted, and a withdrawing slot communicating with the front-to-rear slot where the rod portion 1791 is withdrawn from. The withdrawing slot is disposed along the left-to-right direction. The withdrawing slot is formed so as to be rotated within a predetermined angle towards the upper or lower side with respect to the shaft portion. That is, the withdrawing slot is formed to have a larger up-down width as it travels toward the outer side of the main body portion 1792.

The rod portion 1791 is formed in the shape of a wire, and disposed along the left-to-right direction.

The both of the middle portion of the rod portion 1791 are formed being bended towards the left, and both ends are bended towards the front or rear side so as to face the center.

The both ends of the rod portion 1791 are guided to the cam-part 1780.

The one side of the rod portion 1791 is disposed in the front side of the child locking member 1700, and the other side is disposed in the rear side of the child locking member 1700.

The middle portion of the rod portion 1791 is disposed along the front-to-rear direction and plays the role of a shaft portion.

The middle portion which is any one portion between the both ends of the middle portion of the rod portion 1791 is inserted into the front-to-rear slot and rotatably installed in the main body portion 1792.

Since the locking guide member 1790 is formed in this way, a simple structure can be maintained and a smoother left-to-right movement of the child locking member 1700 becomes possible as well.

The cam-part 1780 is formed to be the shape of a slot in the front and the rear surface of the child locking member 1700. Thus, the cam-part 1780 can be easily formed. The cam-parts 1780 formed in the front and the rear surface of the child locking member 1700 are formed to be identical. The one end of the one side of the rod portion 1791 is inserted in to the cam-part 1780, and the other end is inserted in to the rear side cam-part 1780.

The cam-part 1780 is disposed between the child protrusion guide portion 1720 and the spring insert protrusion 1761. The cam-part 1780 is disposed below the child protrusion guide portion 1720 and the spring insert protrusion 1761.

The cam-part 1780 comprises: a first portion 1781 disposed in the right side; a second portion 1785 successively formed to the first portion 1781; a fifth portion 1782 disposed in the lower side of the second portion 1785; a third portion continuous to the second portion 1785; a second inclined surface 1784 continuous to the third portion; a first inclined surface 1783 continuous to the second inclined surface 1784; and a fourth portion continuous to the first inclined surface 1783. Accordingly, the cam-part 1780 is formed to be the shape of a distorted heart.

The first portion 1781 is formed to be horizontal, and the second portion 1785 and the fifth portion 1782 are slantly formed. The fifth portion 1782 is formed to be longer than the second portion 1785. The angle formed between the fifth portion 1782 and the horizontal line passing through the point where the fifth portion 1782 and the second portion 1785 meet is formed to be smaller than the angle between the horizontal line and the second portion 1785.

The second portion 1785, the third portion, and the second inclined surface 1784 forms an upper pathway.

The first inclined surface 1783, the fourth portion, and the fifth portion 1782 forms a lower pathway. The upper pathway and the lower pathway are connected to each other.

The stopping slot 1786 is disposed at the left side of the cam-part 1780.

The stopping slot 1786 is disposed between the upper pathway and the lower pathway.

The stopping slot 1786 is concavely formed towards the right along the left-to-right direction.

The stopping slot 1786 is formed by the first inclined surface 1783 and the second inclined surface 1784 facing each other.

The first inclined surface 1783 is disposed in the lower side of the second inclined surface 1784.

The first inclined surface 1783 is formed longer than the second inclined surface 1784.

The vehicle door latch system 5 of the present invention can perform lock-releasing operation without any functional jamming even lock-releasing operation is performed while the door lever (not shown) is being pulled under the locking state of the door 1.

This will be described in sequence as follows.

The door lever (not shown) of the door 1, which is under locked state, is being pulled.

At this time, since the stopping lever unit 1450 is not caught by the sub-locking member 1400, the sub-locking member 1400 is being slided towards the opposite side of the main locking member 1300 along the door lever (not shown) which is being pulled without affecting the main locking member 1300.

If lock-releasing operation is performed using a key, a remocon, and the like during performing such operation, the stopping lever unit 1450 rotates forwardly in order to be connected to the sub-locking member 1400.

However, since the stopping lever unit 1450 is rotated while the door lever (not shown) is being pulled, the stopping lever unit 1450 is not connected to the sub-locking member 1400 which is spaced apart from the main locking member 1300, but instead, the stopping lever unit 1450 is entered into the space separated between the main locking member 1300 and the sub-locking member 1400.

At this time, if the door lever (not shown), which is being pulled, is released, the sub-locking member 1400 is moved towards the main locking member 1300 due to the elastic restoring force of the spring.

The sub-locking member 1400 enters the inside of the stopping lever unit 1450, and thus the coupling of the stopping lever unit 1450 to the sub-locking member 1400 is completed.

The sensors installed in the PCB 1900 of the vehicle door latch system 5 of the present invention are connected to a room lamp (not shown), an instrument panel (not shown), and the like, a user can easily recognize the opening and closing state of the door 1.

Hereinafter, an operational process of the vehicle door latch system 5 having the aforementioned configuration and according to the first exemplary embodiment of the present invention will be described.

<Door Closing>

In the FIGS. 22 to 25, closing processes of a door located in the side of a vehicle are shown.

As illustrated in FIG. 22, when the user closes the door 1, the striker 1101 presses the latch 1200, and the latch 1200 is rotated in a clockwise direction thereby.

The latch 1200 presses the sixth sensor 1910 while being rotated along the clockwise direction, and the control unit recognizes that the door 1 is closing, however, the motor 1610 is not operating yet. At this time, as illustrated in FIG. 23, the outer circumferential surface of the latch 1200 pushes the locking protrusion 1320 of the main locking member 1300, and the main locking member 1300 is pushed towards the right. Therefore, the first sensing unit 1351 is not detected by the first sensor 1901.

Next, the latch 1200 further rotates clockwise by the force of the user closing the door 1, as illustrated in FIG. 24, and the first sensing unit 1351 is detected by the first sensor 1901 as the locking portion 1371 of the rotating member 1370 is inserted into the auxiliary locking slot 1202.

In this way, when the sixth sensor 1910 and the first sensor 1901 are all detected, the control unit operates the motor 1610.

That is, after the latch 1200 is rotated along the clockwise direction for a certain degree while the latch 1200 is being pressed by the striker 1101, the motor 1610 begins to operate.

Due to this configuration, the erroneous operation of the motor 1610 is prevented when the door 1 is opened.

The protrusion 1215 of the latch 1200 is pushed in a clockwise direction by the clockwise rotation of the stopping unit 1631 installed in the front surface of the main gear 1630 due to the operation of the motor 1610. Consequently, the locking portion 1371 of the rotating member 1370 is inserted into the locking slot 1201 of the latch 1200, and the door 1 is closed thereby.

At this time, the locking portion 1371 of the rotating member 1370 is rotated towards the clockwise direction by the elastic force of the rotating spring 1390 and positioned inside the locking slot 1201, and the first surface of the latch 1200 is inserted into the latch insertion slot of the locking portion 1371 thereby.

As the stopping unit 1631 is being rotated by the motor 1610, and arrived at the door closing position, and then the locking portion 1371 is inserted into the locking slot 1201, and the first sensing unit 1351 is detected by the first sensor 1901 thereby. In this way, when the first sensing unit 1351 is detected by the first sensor 1901 while the motor is being operated for closing the door, the control unit determines that the stopping unit 1631 is being rotated up to the door closing position and rotates the stopping unit 1631 in a counterclockwise direction using the motor 1610. As illustrated in FIG. 25, the control unit operates the motor 1610 until the fifth sensing unit 1641 presses the fifth sensor 1911. Thus, the main gear 1630 is returned to the basic position. In such a way, since the main gear 1630 is returned to the basic position after the operations of door closing or door locking, the driver can manually lock the door or release the closing of the door.

When an emergency situation occurs such that fingers or clothes of a child are trapped between the door and the vehicle body while the door 1 is being closed by operating the motor 1610, the door lever (not shown) is being pulled, and then, the second sensor 1903 detects the first sensing unit 1351 which has been moved towards the right, and the motor 1610 is being rotated in the reversed direction, and the stopping unit 1631 is being moved to the lock-releasing position (basic position), and thus, the door 1 can be opened thereby.

<Door Locking>

In the FIGS. 26 to 28, locking processes of a door located in the side of a vehicle are shown.

As illustrated in the FIG. 26, the operation wherein the lock-released state of the door 1 becomes a locked state by a key, a remocon, a locking button, a knob, a door out lever sensor, a preset critical value of the vehicle and the like will be described.

When a door locking (signal) is entered through the motor 1651 of the locking driving unit 1650, the motor 1651 is operated and rotates the second gear 1653 in a clockwise direction.

When the second gear 1653 is rotated in a clockwise direction, the first rotating stopping portion 1656 pushes the locking stopping portion 1502 of the locking plate 1500 and slides the locking plate 1500.

At this time, the locking plate 1500 is being moved to the right side, as illustrated in FIG. 27, the first stopping lever part 1450*a* and the second stopping lever part 1450*b* are inserted into the insertion space 1509 along the inclined surface 1511 of the lever guide portion 1507, and the stopping protrusion 1455 is moved towards the rear side direction thereby, and the stopping protrusion 1455 is separated from the first sub-locking member 1400*a* and the second sub-locking member 1400*b* respectively. Due to this action, the door 1 becomes locked; therefore, the force will not be transferred to the main locking member 1300 when the door lever (not shown) is being pulled.

As illustrated in FIG. 29, the first rotating stopping portion 1656 pushes the locking plate 1500 until the second sensing unit 1521 of the locking plated 1500 is detected by the fourth sensor 1907, and returns to its original position.

In order to lock the door 1 using a key, the key is inserted into the key insertion slot and rotate the key connect 1550 counterclockwise with respect to the driver.

As the key connect 1550 is rotated, the first key stopping portion 1554 pushes the locking stopping portion 1502 of the locking plate 1500, and the locking plate 1500 is slided thereby.

At this time, the locking plate 1500 is moved towards right side, and the stopping protrusion 1455 is separated from the first sub-locking member 1400*a* and the second sub-locking member 1400*b* respectively. Due to this action, the door 1 is locked.

The locking is informed to the user when the control unit receives the signal from the fourth sensor 1907. The user takes out the key after rotating the key in the opposite direction. Due to this, the key connect 1550 is returned to its original position.

<Door Lock-Releasing>

In the FIGS. 29 and 30, lock-releasing processes of a door located in the side of a vehicle are shown.

As illustrated in FIG. 29, The operation wherein a locked state of a door 1 becomes a lock-released state by a key, a remocon, a locking button, a knob, a door out lever sensor, and a preset critical value of a vehicle speed and the like will be described.

When a door lock-releasing (signal) is entered through the motor 1651 of the locking driving unit 1650, the motor 1651 is operated and rotates the second gear 1653 in a counterclockwise direction.

When the second gear 1653 is rotated in a counterclockwise direction, the second rotating stopping portion 1657 pushes the locking stopping portion 1502 of the locking plate 1500 and slides the locking plate 1500.

At this time, the locking plate 1500 is being moved to the left side, and the first stopping lever part 1450*a* and the second stopping lever part 1450*b* are separated from the insertion space 1509 of the locking protrusion guide portion 1507, and the stopping protrusion 1455 is moved towards the front direction thereby, and the stopping protrusion 1455 is caught by the first sub-locking member 1400*a* and the second sub-locking member 1400*b* respectively. Due to this, the door 1 becomes lock released; therefore, the force will be transferred to the main locking member 1300 when the door lever (not shown) is being pulled.

The second rotating stopping portion 1657 pushes the locking plate 1500 until the second sensing unit 1521 of the locking plated 1500 is detected by the third sensor 1905, and returns to its original position.

In order to release the locking of the door 1 using a key, the key is inserted into the key insertion slot and rotate the key connect 1550 clockwise with respect to the driver.

As the key connect 1550 is rotated, the second key stopping portion 1552 pushes the locking stopping portion 1502 of the locking plate 1500, and the locking plate 1500 is slided thereby.

At this time, the locking plate 1500 is moved towards left side, and the stopping protrusion 1455 is caught by the first sub-locking member 1400*a* and the second sub-locking member 1400*b* respectively. Due to this action, the door 1 is released from the locking.

The lock-releasing is informed to the user when the control unit receives the signal from the third sensor 1905. The user takes out the key after rotating the key in the opposite direction. Due to this, the key connect 1550 is returned to its original position.

<Lock-Releasing of the Door from Inside the Vehicle Using Door in Lever>

As illustrated in FIG. 32, when the door 1 is in a locked state, as illustrated in FIG. 33, if the door in lever (not shown) is being pulled once, the first sub-locking member 1400*a* is being slided to the right side.

At this time, the manual locking member pressing portion 1407 of the first sub-locking member 1400*a* is slided towards the right, and at the same time pushes the first stopping portion 1563 of the manual locking member 1560. Due to this action, the second stopping portion 1562 of the manual locking member 1560 is moved towards the left according to "the principle of the lever". In addition, the second stopping portion 1562 moves the locking plate 1500 towards the left.

As illustrated in FIG. 34, as the locking plate 1500 is being moved to the left side, and the first stopping lever part 1450*a* and the second stopping lever part 1450*b* are separated from the insertion space 1509 of the lever guide portion 1507, and the stopping protrusion 1455 is moved towards the front direction by the second return spring 1460, and the stopping protrusion 1455 is caught by the first sub-locking member 1400*a* and the second sub-locking member 1400*b* respectively. Due to this action, the door 1 becomes lock released.

At this time, if the door in lever (not shown) is pulled one more time, the latch 1200 is separated from the locking portion 1371 of the locking member 1300, and the door 1 is opened thereby.

<Door Locking from Inside the Vehicle Using Child Locking Member>

When the driver inputs a door lock signal from inside the vehicle through button and the like using the child locking member 1700, the motor 1610 of the driving unit 1600 is operated. As illustrated in FIG. 36, when the motor 1610 is operated the main gear 1630 is rotated. When the main gear rotates 1630 counterclockwise the main gear stopping protrusion 1710 is caught by the second stopping portion 1635, and the child locking member 1700 is also slided towards the right. That is the main gear 1630 pushes the locking member 1700 towards the right.

In this way, when a first external force is applied to the child locking member 1700, the locking member spring 1760 is contracted, and the rod portion 1791 located in the first portion 1781 of the cam-part is moved to the lower pathway and inserted in to the stopping slot 1786. At this state, the child locking member 1700 receives elastic force of the locking member spring 1760 towards the left; therefore, the position of the child locking member 1700 is stably maintained. That is, the state wherein the child locking member 1700 is moved towards the right is maintained.

In this way, when the child locking member 1700 is slided towards the right, as illustrated in FIG. 37, the child protrusion 1453 of the first stopping lever part 1450*a* is caught by the child protrusion guide portion 1720 and guided towards the rear side. Due to this action, the first stopping lever part 1450*a* is separated from the first stopping threshold 1405*a* of the first sub-locking member 1400*a*. The first sub-locking member 1400*a* and the main locking member 1300 are separated, and thus the first sub-locking member 1400*a* and the main locking member 1300 are not slided together.

Meanwhile, the motor 1610 is operating until the third sensing unit 1741 is detected by the eighth sensor 1902.

In this way, after the child locking is enforced automatically through the driving unit 1600, as illustrated in FIG. 38, the motor 1610 is rotated reversely and moved towards its basic position. When the main gear 1630 is rotated clockwise, it is not held by the child locking member 1700.

<Door Lock-Releasing from Inside the Vehicle Using Child Locking Member>

When the driver inputs a door lock-releasing signal from inside the vehicle through button and the like using the child locking member 1700, the motor 1610 of the driving unit 1600 is operated. As illustrated in FIG. 39, when the motor 1610 is operated the main gear 1630 is also rotated counterclockwise. When the main gear 1630 is rotated counterclockwise for lock-releasing of the locked state, the main gear 1630 is rotated counterclockwise for a certain amount of time, and then rotated clockwise so that it is returned to its basic position.

When the main gear 1630 rotates counterclockwise, the main gear stopping protrusion 1710 is caught by the child locking member stopping portion 1635, and the locking member 1700 is also slightly slided towards the right. That is, the main gear 1630 pushes the locking member 1700 towards the right. In this way, when an external force is applied to the locking member 1700 second time (again), the rod portion 1791 is separated from the stopping slot 1786.

Later, when the main gear 1630 is rotated clockwise, the child locking member 1700 is not caught by the main gear 1630 so that it receives only the elastic force of the locking member spring 1760 toward the left side. Therefore, the child locking member 1700 is slided towards the left due to the elastic force of the locking member spring 1760.

As illustrated in FIG. 40, the rod portion 1791 wherein the locking member 1700 is to be slided towards the left is moved to the upper pathway and returned to the first portion 1781 of the cam-part 1780.

In this way, when the child locking member 1700 is slided towards the left, as illustrated in FIG. 41, the child protrusion 1453 of the first stopping lever part 1450*a* is separated from the child protrusion guide portion 1720 and the right side of first stopping lever part 1450*a* the moved towards the front side due to the elastic force of the second return spring 1460. Due to this action, the first stopping lever part 1450*a* is caught by the first stopping threshold 1405*a* of the first sub-locking member 1400*a*. The first sub-locking member 1400*a* and the main locking member 1300 are connected, and thus the first sub-locking member 1400*a* and the main locking member 1300 are slided together.

Meanwhile, when the third sensing unit 1741 is detected by the seventh sensor 1904 the control unit informs that the child locking is released.

In this way, in the child locking member 1700 of the present exemplary embodiment, when an external force is applied first time, the end of rod portion 1791 is moved to the lower pathway so as to be caught by the stopping slot 1786, and when an external force is applied second time, the end of the rod portion 1791 is separated from the stopping slot 1786 and being moved to the upper pathway.

Due to this, the child locking member 1700 is moved when an external force is applied first time, and the moved position after the movement is maintained, and when an external force is applied second time towards the same direction, it is returned to its original position.

Thus, the vehicle door latch system is maintained in a simple form, and at the same time, the releasing of the locking of the child locking member 1700 is prevented when the latch 1200 is rotated by the main gear 1630 even the child locking member 1700 and the latch 1200 are moved by the same main gear 1630.

<Door Opening when Motor Fails>

As illustrated in FIG. 42, the motor 1610 may fail under the situations like when the stopping unit 1631 is moved to the door closing position for automatically closing the door 1 using the motor 1610, or during moving, or during the time of returning to its basic position.

In such cases, when the door lever is being pulled, the locking member 1300 is moved to the right, as illustrated in FIG. 43, and the stopping unit pressing part 1330 is also moved to the right.

Due to this operation, the stopping unit pressing part 1330 presses the head portion 1631*a* of the stopping unit 1631. When the head portion 1631*a* is being pressed the head portion 1631*a* is moved towards the rear side direction further than the protrusion 1215 of the latch 1200, and so the coupling between the stopping unit 1631 and the latch 1200 is released thereby.

Later, as illustrated in FIG. 44, when the user pulls the door 1, the striker 1101 rotates the latch 1200 counterclockwise, and the door 1 is opened thereby.

In this way, even the driving unit 1600 fails during the time of closing the door 1 through the driving unit 1600 or after the door is closed, the door 1 can be manually opened by pulling the door lever.

When the user releases the door lever, the stopping unit 1631 is being slided by the return spring 1648 and returned to its original position.

Meanwhile, as illustrated in FIG. 45, even when the door lever is pulled by a user to open the door 1 or to release the door locking, at normal times (when the stopping unit 1631 is in its basic position) not in a state of emergency, the stopping unit 1631 is not pressed by the stopping unit pressing part 1330 due to the bended region 1332. Therefore, the increase in the operational force for moving the main locking member 1300 at normal times is prevented.

<Assembling of Vehicle Door Latch System>

Assembling process of the above described vehicle door latch system according to the first exemplary embodiment is as follows.

Members (locking plate, driving unit, child locking member 1700, etc.) which are being installed in the rear side surface of the first housing 1110 are installed. Then, the third housing 1150 is coupled to the rear side surface of the first housing 1110 with bolts or rivets.

The main locking member 1300, the sub-locking member 1400, and the like are installed in the front surface of the first housing 1110. The latch 1200, the first return spring 1250, the rotating member 1370, and the rotating spring 1390 are installed in the rear side surface of the second housing 1130 by the first return spring stopping shaft 1251, the rotating shaft 1380, and the return spring stopping shaft 1391. Next, the first housing 1110 and the second housing 1130 are coupled to each other with bolts or rivets, and the assembling is completed thereby.

Through such assembling processes, the assembling processes of the vehicle door latch system may become more facilitated.

Embodiment 2

In describing the vehicle door latch system according to the second exemplary embodiment of the present invention, same symbols will be used for the same or similar elements as those of the vehicle door latch system according to the first exemplary embodiment of the present invention, and the detailed description and illustration will be omitted.

As illustrated in FIG. 46, the vehicle door latch system according to the second exemplary embodiment is characterized in that the lock-releasing cable connecting portion is formed at the left side of the locking plate, and the lock-releasing cable 2810 which is in the opposite direction of the door lever connecting portion 2800 is withdrawn to the left side of the housing 2100.

The knob 6 disposed close to the window of the door 1 is directly connected to the lock-releasing cable 2810.

Even in such case, by extending the lock-releasing cable 2810 long in length the motor 2610 can be installed in the door so as to be disposed in the upper portion of the striker insertion slot. Due to this, the flooding of the motor 2610 can be prevented.

Embodiment 3

In describing the vehicle door latch system according to the third exemplary embodiment of the present invention, same symbols will be used for the same or similar elements as those of the vehicle door latch system according to the first and second exemplary embodiments of the present invention, and the detailed description and illustration will be omitted.

As illustrated in FIGS. 47 to 51, the vehicle door latch system according to the third exemplary embodiment is characterized in that and comprises: a locking member spring 3760 applying an elastic force to a child locking member 3700 in the opposite direction of an external force when the child locking member 3700 is moved by the external force; a locking guide member 3790 rotatably installed in any one of the housing and the child locking member 3700; and a cam-part 3780 formed in the remaining one and guiding the locking guide member 3790 and formed with a stopping slot 3786.

In the present exemplary embodiment, the locking guide member 3790 is rotatably installed in the child locking member 3700, and the cam-part 3780 is formed in the rear surface of the first housing 3110 of the housing.

The locking member spring 3760 is provided as a coil spring, and horizontally disposed along the left-to-right direction.

The locking member spring 3760 is disposed between a cam cover 3730, which will be described later, and the child locking member 3700.

A first spring receiving slot wherein the front side of the locking member spring 3760 is received is formed in the right rear surface of the child locking member 3700. The rear and right side of the first spring receiving slot is formed to be open.

A second spring receiving slot wherein the rear side of the locking member spring 3760 is received is formed along the left-to-right direction inside of the cam cover 3730. The front and left side of the second spring receiving slot is formed to be open.

The right end of the locking member spring 3760 is supported at the cam cover 3730, that is, the first housing 3110, and the left end is supported at the spring pressing portion 3794 of the locking guide member 3790. The spring pressing portion 3794 of the locking guide member 3790 is disposed between the second flat portion 3752 of the child locking member 3700 and the left end of the locking member spring 3760. Thus, the elastic force of the locking member spring 3760 is transferred not only to the child locking member 3700 but also to the locking guide member 3790.

The locking guide member 3790 is formed in the shape of a bar, and rotatably installed in the right front side of the child locking member 3700.

A guide member moving slot 3751 is formed in the right front side of the child locking member 3700 so that the locking guide member 3790 is received and being moved therein. The front side of the guide member moving slot 3751 is formed to be open.

In the locking guide member 3790, a cam guide portion 3793 which is guided by the cam-part 3780, and a spring pressing portion 3794 which receives the elastic force of the locking member spring 3760 are formed.

The cam guide portion 3793 is formed in the shape of a cylinder, and formed forwardly protruded in the right end of the locking guide member 3790. When the locking guide member 3790 is installed in the child locking member 3700 the cam guide portion 3793 is further forwardly protruded than the other surfaces of the neighboring child locking member 3700.

In the locking guide member 3790, the portion adjacent to cam guide portion 3793 is formed to have a taper whose up-down width is getting narrower as it travels towards the cam guide portion 3793.

A hinge is formed rearwardly protruded in the left rear side of the locking guide member 3790.

In the child locking member 3700, a hinge hole wherein the hinge of the locking guide member 3790 is penetrating through is formed so as to be penetrated along the front-to-right direction. The hinge hole is formed to be the shape of a half-circle whose right side is curved and the left side is flat. The hinge hole is formed to have a larger cross-sectional area than the cross-sectional area of the hinge of the locking guide member 3790. Thus, even the hinge hole is formed to be the shape of a half-circle, the locking guide member 3790 can be smoothly rotated with respect to the child locking member 3700.

Due to this, the locking guide member 3790 is rotatably installed in the child locking member 3700. The front side of the hinge hole is communicating with the guide member moving slot 3751. The rear side of the hinge hole is communicating with the first spring receiving slot.

The spring pressing portion 3794 is integrally formed to the rear end of the hinge of the locking guide member 3790. The spring pressing portion 3794 is disposed in the left rear of the locking guide member 3790. Due to this, the number of component of the locking guide member 3790 is reduced and the structure becomes simple as well.

The shape of the cross-section of the spring pressing portion 3794 is formed to be a half-circle, and in the spring pressing portion 3794, a first flat portion 3794*a* is formed in the opposite surface of the surface which receives the elastic force of the locking member spring 3760. In the spring pressing portion 3794, the edge portion where the first flat portion 3794*a* and the curved portion meet is formed to be rounded.

In the child locking member 3700, a second flat portion 3752 facing the first flat portion 3794*a* is formed.

The horizontal center of the cam guide portion 3793 and the horizontal center of the spring pressing portion 3794 are disposed spaced apart along the up-down direction. In the present exemplary embodiment, the center of the cam guide portion 3793 is disposed in the upper side of the center of the spring pressing portion 3794.

Therefore, when the external force is removed, the first flat portion 3794*a* and the second flat portion 3752 are contacted by the locking member spring 3760 so that the cam guide portion 3793 of the locking guide member 3790 is facing upward. Thus, the child locking member 3700 can be smoothly returned.

The cam-part 3780, is integrally formed in the front side of the inner side of the cam cover 3730 installed in the rear surface of the first housing 3110 of the housing.

In the cam cover 3730, a sliding slot 3731 wherein the child locking member 3700 and the locking guide member 3790 are being slided is formed along the left-to-right direction. The sliding slot 3731 is formed to have an open left side and a closed right side. The sliding slot 3731 is communicating with the second spring receiving slot. Thus, the right side of the child locking member 3700 is inserted into the cam cover 3730.

Due to this, the cam cover 3730 can protect the components by surrounding the locking member spring 3760, the locking guide member 3790, and the child locking member 3700, and at the same time, it can be modularized so that the assemblability is further enhance.

The assembling hooks are formed respectively in the right upper and lower portions of the child locking member 3700. Also, assembling hook coupling holes wherein the assembling hooks are inserted are formed respectively in the upper and lower portions of the cam cover 3730.

The assembling hook coupling holes are formed long in length along the left-to-right direction, and the child locking member 3700 can be slided along the left-to-right direction with respect to the cam cover 3730 while the assembling state of the child locking member 3700 and the cam cover 3730 is maintained.

Due to the assembling hooks and the assembling hook coupling holes, the modularization becomes more facilitated.

A cam cover coupling protrusion 3732 which is inserted into the cam cover insertion slot formed in the rear surface of the first housing 3110 is formed forwardly protruded in the lower portion of the front surface of the cam cover 3730. Therefore, due to such cam cover coupling protrusion 3732, the cam cover 3730 can be stably installed in the first housing 3110.

The cam-part 3780 is formed in the shape of a slot. The cam-part 3780 is communicating with the sliding slot 3731.

The cam-part 3780 is formed of (comprises): a first inclined surface 3781 whose height is getting lower as it travels towards the right; a second inclined surface 3782 being continuously formed from the lower end of the first inclined surface 3781 whose height is getting higher as it travels towards the right; a third inclined surface 3783 being continuously formed from the lower end of the first inclined surface 3782 whose height is getting higher as it travels towards the left; a first bend region being continuously formed from the third inclined surface 3783, having an arc-like curvature concave towards the left, forming a stopping slot 3786; a fourth inclined surface being continuously formed from the first bend region; and a second bend region 3787 being continuously formed from the fourth inclined surface and having a curvature upwardly convex so that the height is getting higher as it travels towards left. The second bend region 3787 is connected to the upper portion of the first inclined surface 3781. Since the cam-part 3780 is formed in this way, the cam guide portion 3793 is not easily separated from the stopping slot 3786 when an external force is not applied.

The first inclined surface 3781, the second inclined surface 3782, the third inclined surface 3783, the first bend region, the fourth inclined surface, and the second bend region 3787 are formed by (in) the cam protrusion portion protruded from the internal wall of the cam cover 3730 towards the rear direction.

The first inclined surface 3781, the second inclined surface 3782, and the third inclined surface 3783 form the lower pathway, and the fourth inclined surface and the second bend region 3787 form the upper pathway.

The cam-part 3780 is formed in a way that the front portion formed by the third inclined surface 3783, the first bend region, the fourth inclined surface, and the second bend region 3787 is to be open. Due to this, the cam cover 3730 can be easily manufactured through injection molding.

<Door Locking from Inside the Vehicle using Child Locking Member>

When the driver inputs a door lock signal from inside the vehicle through button and the like using the child locking member 3700, the motor of the driving unit is operated. When the motor is operated the child locking member 3700 is also slided towards the right.

In this way, when an external force is applied to the child locking member 3700 first time, the locking member spring 3760 is contracted, and the locking guide member 3790 located in the left side of the cam-part 3780 is moved to the lower pathway and inserted into the stopping slot 3786. At this state, the child locking member 3700 receives the elastic force of the locking member spring 3760 towards the left side, and thus, the position of the child locking member 3700 is stably maintained thereby. Due to this, as described in the first exemplary embodiment, the door is not opened even the door in lever is being pulled.

<Door Lock-Releasing from Inside the Vehicle using Child Locking Member>

When the driver inputs a door lock-releasing signal from inside the vehicle through button and the like using the child locking member 3700, the motor of the driving unit is operated. When the motor is operated, the main gear is also rotated counterclockwise just like the door locking case. When the main gear is rotated counterclockwise for lock-releasing of the locked state, the main gear is rotated counterclockwise for a certain amount of time, and then rotated clockwise so that it is returned to its basic position.

When the main gear rotates counterclockwise, the child locking member 3700 is also slightly slided towards the right. In this way, when an external force is applied to the locking member 3700 second time (again), the cam guide portion 3793 of the locking guide member 3790 is facing upward by the elastic force of the locking member spring 3760, and separated from the stopping slot 3786.

Later, when the main gear is rotated clockwise, the child locking member 3700 is not caught by the main gear so that it receives only the elastic force of the locking member spring 3760 toward the left side. Therefore, the child locking member 3700 is slided towards the left due to the elastic force of the locking member spring 3760.

The locking guide member 3790 wherein the child locking member 3700 is to be slided towards the left is moved to the upper pathway and returned to the left side of the cam-part 3780.

In this way when the child locking member 3700 is to be slided towards the left, the door can be opened through the door in lever.

Meanwhile, the vehicle door latch system according to the third exemplary embodiment is provided with a second housing 3130 disposed in the front side of the first housing 3110 and separated into two parts. The separated parts of the second housing 3130 can be formed with different materials respectively. The second housing 3130 comprises a second housing 3130*a* made of metal, and a second housing 3130*b* made of plastic. By forming the second housing 3130 in this way, the durability can be maintained, and at the same time, the weight of the device can be reduced as well.

The second housing 3130*a* made of metal is disposed at the left side of the device, and the second housing 3130*b* made of plastic is disposed in the lower right portion of the device.

A plurality of installation holes is formed in the second housing 3130*a* made of metal for bolt-coupling of the device to the door. Also, latch, rotating member, and the like are installed in the second housing 3130*b* made of metal.

Embodiment 4

In describing the vehicle door latch system according to the fourth exemplary embodiment of the present invention, same symbols will be used for the same or similar elements as those of the vehicle door latch system according to the first, second, and third exemplary embodiments of the present invention, and the detailed description and illustration will be omitted.

As illustrated in FIGS. 52 to 61, a vehicle door latch system according to the fourth exemplary embodiment is characterized in that and comprises: a housing; a latch 4200 rotatably installed in the housing; a door closing member installed in the housing and locking the latch 4200; and a driving unit rotating the latch 4200; wherein the driving unit comprises: a main gear 4630 rotating the latch 4200; and a fifth sensor 4911 detecting the position of the main gear 4630, and wherein, in the main gear 4630, a first main gear sensing portion 4641 detected by the fifth sensor 4911 and a second main gear sensing portion 4633 are provided, and wherein the first main gear sensing portion 4641 and the second main gear sensing portion 4633 are disposed spaced apart along the circumferential direction.

The door closing member comprises: a sliding member slidingly installed in the front surface of the first housing 4110 of the housing; and a rotating member 4370 rotatingly installed in the front surface of the front surface of the first housing 4110 of the housing and connected to the sliding member.

The sliding member comprises: a main locking member 4300 locking the latch 4200; and a sub-locking member disposed in one side of the main locking member 4300.

The main locking member 4300 and the sub-locking member are connected by the connecting means same as the one in the above described exemplary embodiment.

The driving unit comprises: a motor 4610; a first worm 4613 installed in the shaft of the motor 4610; a reduction gear 4620 gearing with the first worm 4613; and a main gear 4630 gearing with the reduction gear 4620 and rotating the latch 4200.

In addition, in the first housing 4110, the fifth sensor 4911 detecting the position of the main gear 4630 is installed. The fifth sensor 4911 is disposed so as to be detected when the main gear 4630 is in the basic position. Since the detailed installation location and the installation structure of the fifth sensor 4911 are described in the above described exemplary embodiments, the description thereof will be omitted.

The main gear 4630 is rotatably installed in the rear surface of the first housing 4110 so that it is disposed in the rear side of the latch 4200.

A stopping unit 4631 rotating the latch 4200 is forwardly and protrudedly formed in the main gear 4630. The stopping unit 4631 is caught by the protrusion 4215 of the latch 4200.

The stopping unit 4631 is installed in the main gear 4630 so that it can be slided along the front-to-rear direction same as in the previously described exemplary embodiments.

Also, a first main gear sensing portion 4641 and a second main gear sensing portion 4633 being detected by the fifth sensor 4911 are provided in the main gear 4630.

The first main gear sensing portion 4641 is integrally formed in an outer container of the stopping unit 4631.

Meanwhile, a child locking member 4700, which will be described later, is disposed between the rear surface of the first housing 4110 and the front surface of the main gear 4630.

The first main gear sensing portion 4641 is integrally formed with the child locking member stopping portion.

The main gear stopping protrusion of the child locking member 4700 is being caught in the child locking member stopping portion. Through such child locking member stopping portion, the driving unit plays the role of moving the child locking member 4700 to the child locking position or the child lock-released position.

That is, the stopping unit 4631 also plays the role of the first main gear sensing portion and the child locking member stopping portion.

The second main gear sensing portion 4633 is disposed in the rear side of the child locking member 4700 so as not to be caught by the child locking member 4700 when the main gear 4630 is being rotated.

The first main gear sensing portion 4641 and the second main gear sensing portion 4633 can be disposed spaced apart along the circumferential direction.

More specifically, the second main gear sensing portion 4633 is disposed further to the right side than the first main gear sensing portion 4641.

The first main gear sensing portion 4641 and the second main gear sensing portion 4633 are outwardly and protrudedly formed in the outer circumferential surface of the main gear 4630. Due to this, the first main gear sensing portion 4641 and the second main gear sensing portion 4633 can be formed in a simple structure.

The first main gear sensing portion 4641 and the second main gear sensing portion 4633 are formed in the non-geared portion of the main gear 4630.

The outer circumferential surfaces of the first main gear sensing portion 4641 and the second main gear sensing portion 4633 are slantly formed so as to be further outwardly protruded as they travel towards the center portion, so that the fifth sensor 4911 provided as a limit switch can be smoothly pressed.

In the main locking member 4300 of the sliding member, a stopping unit pressing part 4330 pressing the stopping unit 4631 is formed. Since the detailed shape of the stopping unit pressing part 4330 is described in the above described exemplary embodiments, the description thereof will be omitted.

A locking portion 4371 and an insertion protrusion 4373 are formed in the rotating member 4370.

In addition, in the rotating member 4370, a latch insertion slot 4372 wherein an upwardly protruded first surface 4203 in the latch 4200 is inserted is formed. The latch insertion slot 4372 is formed to have an open lower portion, and disposed between the locking portion 4371 and the insertion protrusion 4373. Due to such a latch insertion slot 4372, when closing the door, the state wherein the latch 4200 is locked to the rotating member 4370 is stably maintained.

In the main locking member 4300 of the sliding member, a rotating member insertion slot 4317 wherein the insertion protrusion 4373 is inserted is formed.

When the rotating member 4370 is pressed by the latch 4200 and being moved towards the right, since the left-to-right width of the rotating member insertion slot 4317 is formed to be wider than the insertion protrusion 4373, the main locking member 4300 is not moved towards the right. That is, the width of the rotating member insertion slot 4317 is formed to be wider towards the direction of the rotation of the rotating member 4370 than the insertion protrusion 4373. However, when the main locking member 4300 is moving towards the right, the rotating member 4370, which is interlocked thereto, is also rotated towards the right.

Due to this, the main locking member 4300 is not moved even the rotating member 4370 is pressed towards the right by the latch 4200, and thus the pressing of the stopping unit 4631 by the stopping unit pressing part 4330 is prevented when the door is closed. Therefore, the mis-operating is prevented when the side door of the vehicle is closed through the driving unit.

<Door Closing>

In the FIGS. 52 to 54, closing processes of a door located in the side of a vehicle are shown.

When the user closes the door being already opened, the striker 1101 is inserted into the locking slot 4201 and presses the latch 4200, and the latch 4200 is rotated clockwise thereby.

The latch 4200 presses the sixth sensor while being rotated clockwise, and the locking portion 4371 of the rotating member 4370 is inserted into the auxiliary locking slot 4202. The control unit receives the signal from the sixth sensor and operates the motor 4610 of the driving unit so that the stopping unit 4631 is rotated clockwise. The latch 4200 is caught by the stopping unit 4631, thus, the latch 4200 is also rotated clockwise. At this time, as illustrated in FIG. 52, the outer circumferential surface (between the auxiliary locking slot and the locking slot) of the latch 4200 pushes the locking portion 4371 of the rotating member 4370. However, in the rotating member insertion slot 4317, a space is formed wherein the insertion protrusion 4373 of the rotating member 4370 can be escaped so that the main locking member 4300 maintains its original position without being pushed towards the right.

Next, as illustrated in FIG. 53, when the stopping unit 4631 moves to the door closing position as it is being rotated by the motor 4610, the locking portion 4371 is inserted into the locking slot 4201, and the second main gear sensing portion 4633 is detected by the fifth sensor 4911. The control unit (not shown) receives the signal from the fifth sensor 4911 and reversely rotates the motor 4610. The control unit rotates the main gear 4630 until the first main gear sensing portion 4641 is detected by the fifth sensor 4911. That is, as illustrated in FIG. 54, the control unit stops the operation of the motor 4610 when the first main gear sensing portion 4641 presses the fifth sensor 4911.

Thus, the main gear 4630 returns to the basic position. In this way, the main gear 4630 returns to the basic position after the door closing or locking operation, and therefore, the driver can release the locking and closing of the door manually.

In this way, the vehicle door latch system of the present exemplary embodiment can rotate the latch 4200 to the door closing position with a single sensor, and can return the main gear 4630 to its basic position as well.

In addition, as illustrated in FIG. 55, in the latch 4200, an auxiliary locking slot 4202 wherein the locking portion 4371 formed in the rotating member 4370 of the door closing member, and a locking slot 4201 wherein the locking portion 4371 is inserted second time are formed.

The locking slot 4201 and the auxiliary locking slot 4202 are disposed space apart along the circumferential direction in a way that the up-down traveling distance d of the striker 1101 between the time when the locking unit 4371 is inserted into the auxiliary locking slot 4201 (FIG. 55(*a*)) and the time when the locking portion 4371 is inserted into the locking slot 4201 (FIG. 55(*b*)) equals or greater than 12 mm.

Due to this, the traveling distance becomes longer than the 7 mm which is a typical traveling distance of the striker 1101 of the prior art, so that the driver can more easily recognize the process wherein the door is closing automatically by the motor 4610. Besides, there is an advantage of enhancing the safety due to the increase in the clearance space for pinch-protection.

A striker stopping protrusion 4204 wherein the striker 1101 is being caught is additionally formed in the latch 4200.

The striker stopping protrusion 4204 is disposed inside the locking slot 4201, therefore, the separation of the striker 1101 after insertion into the locking slot 4201 effectively prevented.

The stopping protrusion 4204 is formed in the surface facing the surface (surface wherein the locking portion 4371 is caught by) wherein the first surface 4203 is formed.

In the striker stopping protrusion 4204, the surface which is facing the striker 1101 when inserted into the locking slot 4201, and the surface facing the striker 1101 when separated from the locking slot 4201 are slantly formed so that the striker 1101 can be easily inserted and separated into and from the locking slot 4201.

Also, the first return spring 4250 returning the latch 4200 is provided as a coil spring same as in the above described exemplary embodiments.

In the one end and the other end of the first return spring 4250, a first bend region 4252 and a second bend region 4253 whose bended angle is larger than 90° is formed. The first bend region 4252 is bended upward at a right angle, and the second bend region 4253 is bended forward at a right angle.

The first bend region 4252 of the first return spring 4250 is caught by the first return spring stopping shaft 4251, and the coil portion is wound around the latch rotating shaft, and the second bend region 4253 is inserted into the spring insertion portion 4213 of the latch 4200. In this way the first bend region 4252 and the second bend region 4253 are formed in the first return spring 4250 so that the assemblability is further enhanced.

Also, the return spring which returns the rotating member 4370 is provided as a coil spring as same as the first return spring 4250, and a first and a second bend regions whose bended angle is larger than 90° may be formed in the both ends.

The locking plate 4500 locking or lock-releasing the door is slidingly formed in the rear surface of the first housing 4110 so as to be disposed in the rear side of the child locking member 4700.

The locking plate 4500 is moved to the locking or lock-releasing position by the locking driving unit.

A stopper elongated hole 4571 is formed along the left-to-right direction at the right lower portion of the locking plate 4500. The stopper elongated hole 4571 is penetratingly formed along the front-to-rear direction.

The up-down widths of the both sides of the stopper elongated hole 4571 are formed to be larger than the up-down width of the middle portion. That is, a thinner (waist-like) region 4576 is formed in the middle portion of the stopper elongated hole 4571.

A stopper protrusion 4107 formed rearwardly protruded in the rear surface of the first housing 4110 is inserted into the stopper elongated hole 4571.

Therefore, the locking plate 4500 is positioned stably in the locking position or the lock-releasing position as long as no separate force is applied thereto.

In addition, in the locking plate 4500, a pair of slits 4578 formed penetratingly along the front-to-rear direction are formed along the left-to-right direction in the upper and lower sides of the thinner region 4576 of the stopper elongated hole 4571. Owing to such slits 4578, the locking plate 4500 can be elastically deformed more smoothly when the stopper protrusion 4107 is passing through the thinner region 4576 of the stopper elongated hole 4571, A key connect 4550 is installed so that it penetrates the second gear 4653 of the locking driving unit.

A first key stopping portion 4554 and a second key stopping portion 4552 are respectively disposed in the upper side of a first rotating stopping portion 4656 and a second rotating stopping portion 4657 formed in the second gear 4653.

Slanted surfaces 4556 are respectively formed in the lower sides of the first key stopping portion 4554 and the second key stopping portion 4552.

The slanted surfaces 4556 are formed in a way that the up-down widths of the first key stopping portion 4554 and the second key stopping portion 4552 are getting thinner as they travel towards the ends. Since the first key stopping portion 4554 and the second key stopping portion 4552 are formed in such a way, obstruction of other members and the like is prevented, and thus the drivability is further enhanced.

The child locking member 4700 connects or separates the first sub-locking member and the main locking member 4300 by moving the above described connecting means.

The cam-part 4780 which stops the child locking member 4700 at the child locking position or at the child lock-releasing position is formed in the cam cover 4730 installed in the rear surface of the first housing 4110.

A cam cover coupling protrusion 4732 is formed in the front surface of the cam cover 4730, and a cam cover coupling slot 4121 wherein the cam cover coupling protrusion 4732 is inserted is formed in the rear surface of the first housing 4110.

The cam cover coupling protrusion 4732 is disposed at the left side of the cam-part 4780.

The cam cover coupling protrusion 4732 comprises a vertical portion formed along the up-down direction, and a horizontal portion connected to the middle portion of the vertical portion and formed along the left-to-right direction.

More specifically, the cam cover coupling protrusion 4732 is formed like a rotated "T" in general. Owing to such cam cover coupling protrusion 4732, the coupling strength of the cam cover 4730 becomes more increased, and thus the assembling of the cam cover 4730 can be performed more smoothly.

Meanwhile, a shaft of the reduction gear 4620 of the driving unit is rotatably installed in the reduction gear shaft supporting plate 4623. That is, in the reduction gear shaft supporting plate 4623, a shaft through hole wherein the shaft of the reduction gear 4620 is inserted is formed along the up-down direction.

The reduction gear shaft supporting plate 4623 is inserted in a supporting plate insertion slot 4122 formed in the rear surface of the first housing and installed therein.

The reduction gear shaft supporting plate 4623 is formed in the shape of a rectangle, and the shaft through hole is mostly disposed in the rear side of the reduction gear shaft supporting plate 4623. The reduction gear shaft supporting plate 4623 is formed in this way, and thus, the reduction gear shaft supporting plate 4623 can be stably inserted into the supporting plate insertion slot 4122. Owing to this, the reduction gear shaft supporting plate 4623 can be easily installed in the housing, and at the same time, the coupling strength of the reduction gear shaft supporting plate 4623 is further enhanced as well.

A PCB insertion slot 4102 wherein the PCB 4900 is inserted is formed at the lower side of the right rear surface of the first housing 4110 in a way that the rear side thereof is open.

In the inner wall of the first housing 4110, a PCB support portion 4104 supporting the both sides of the PCB 4900 is formed. In the PCB support portion 4104, an insertion slot wherein the both sides of the PCB 4900 are inserted is formed along the front-to-rear direction. Thus, a PCB separation space is formed between the lower side of the PCB 4900 and the surface located in the first housing 4110 and facing the lower side of the PCB 4900. A solder and the like for connecting the wires can be disposed in the separation space, therefore the PCB 4900 can be installed in the housing more easily.

Preferably, a PCB separation space is formed between the upper side of the PCB 4900 and the surface located in the first housing 4110 and facing the upper side of the PCB 4900.

As described above, although the present invention has been described with reference to the preferred exemplary embodiments, various changes and alterations of the present invention can be made by those skilled in the art without departing from the spirit and the scope of the present invention written in the claims described herein below.

DESCRIPTION OF SYMBOLS

Description of Numerals for Major Elements in Drawings

1100: housing
1200: latch
1300: main locking member
1400: sub-locking member
1450: stopping lever unit
1500: locking plate
1600: driving unit
1700: child locking member
1800: door lever connecting unit
1900: PCB

The invention claimed is:

1. A vehicle door latch system characterized in that and comprising:

a housing;

a latch rotatably installed in the housing;

a door closing member installed in the housing and locking the latch;

a locking member movably installed in the housing and locking the latch;

a key connect, rotatably installed in the housing, wherein a key insertion slot for inserting a key is formed in the one side thereof; and a locking driving unit moving the locking member; and wherein a locking stopping portion is formed in the locking member; and wherein the locking driving unit comprises:

a motor;

a first gear connected to the motor; and a second gear interlocked with the first gear; and wherein a connect through hole wherein the key connect is penetrating through is formed in the second gear, and in the second gear, two of a rotating stopping portion wherein the locking stopping portion is caught by are formed spaced apart along the circumferential direction so that the locking member is moved as the motor operates; and wherein in the key connect, two of a key stopping portion wherein the locking stopping portion is caught by are formed spaced apart along the circumferential direction so that the locking member is moved as the key connect is rotated, wherein the door closing member comprises a sliding member slidingly installed in the housing, wherein the sliding member slidingly installed in the housing comprises a main locking member locking the latch, and a sub-locking member slidingly installed in the housing and disposed in one side of the main locking member, wherein a connecting means further included for sliding both of the main locking member and the sub-locking member, wherein the locking member is slidingly installed in the housing, wherein as the locking member is slid, the connecting means is moved so that the main locking member and the sub-locking member can be slid together, or only the sub-locking member can be slid, wherein the connecting means includes:

a stopping lever part, rotatably installed in the main locking member, formed with a stopping protrusion; and a stopping threshold, formed in the sub-locking member, wherein the stopping protrusion is caught, wherein a protrusion guide portion is formed in the locking member, and wherein a protrusion is formed in the stopping lever part, and thus the stopping lever part can be rotated as the protrusion guide portion guides the protrusion.

2. The vehicle door latch system according to claim 1, wherein the locking member is a locking plate.

3. The vehicle door latch system according to claim 1, wherein the rotating stopping portion is protrudedly formed in an upper surface of the second gear.

4. The vehicle door latch system according to claim 1, wherein the key stopping portion is disposed in an upper side of the rotating stopping portion.

5. The vehicle door latch system according to claim 1, wherein the second gear is provided as a worm gear.

6. The vehicle door latch system according to claim 2, wherein the rotating stopping portion is protrudedly formed in an upper surface of the second gear.

7. The vehicle door latch system according to claim 2, wherein the key stopping portion is formed by cutting off a part of the key connect.

8. The vehicle door latch system according to claim 2, wherein the key stopping portion is disposed in an upper side of the rotating stopping portion.

9. The vehicle door latch system according to claim 2, wherein the second gear is provided as a worm gear.

* * * * *